US008035291B2

(12) United States Patent
Nishimura et al.

(10) Patent No.: US 8,035,291 B2
(45) Date of Patent: Oct. 11, 2011

(54) FIELD EMISSION ELECTRODE, MANUFACTURING METHOD THEREOF, AND ELECTRONIC DEVICE

(75) Inventors: Kazuhito Nishimura, Nangoku (JP); Hideki Sasaoka, Kochi (JP)

(73) Assignees: Kochi Industrial Promotion Center, Kochi-shi (JP); Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 12/779,583

(22) Filed: May 13, 2010

(65) Prior Publication Data

US 2010/0219744 A1 Sep. 2, 2010

Related U.S. Application Data

(63) Continuation of application No. 11/287,838, filed on Nov. 28, 2005, now Pat. No. 7,755,271.

(30) Foreign Application Priority Data

Nov. 26, 2004 (JP) ..... 2004-343203
Aug. 31, 2005 (JP) ..... 2005-252928
Oct. 13, 2005 (JP) ..... 2005-299468

(51) Int. Cl.
*H01J 1/62* (2006.01)
*H01J 63/04* (2006.01)

(52) U.S. Cl. ..... 313/495; 313/496; 313/309; 313/336; 313/351; 313/346 R

(58) Field of Classification Search ..... 313/495–497, 313/309–311, 336, 351, 346 R
See application file for complete search history.

(56) References Cited

U.S. PATENT DOCUMENTS

| | | | |
|---|---|---|---|
| 5,608,283 | A | 3/1997 | Twichell et al. |
| 5,900,301 | A | 5/1999 | Brandes et al. |
| 6,504,292 | B1 | 1/2003 | Choi et al. |
| 2001/0015605 | A1 | 8/2001 | Yoshiki |
| 2001/0024078 | A1 | 9/2001 | Dimitrijevic et al. |
| 2003/0132393 | A1 | 7/2003 | Dimitrijevic et al. |
| 2003/0143398 | A1 | 7/2003 | Ohki et al. |
| 2004/0178713 | A1 | 9/2004 | Na et al. |
| 2005/0168122 | A1 | 8/2005 | Dahl et al. |

(Continued)

FOREIGN PATENT DOCUMENTS

JP 08-236010 A 9/1996

(Continued)

OTHER PUBLICATIONS

Ahalapitiya Hewage Jayatissa et al, "Enhanced Field Emission Current From Diamond-Like Carbon Films Deposited by Laser Ablation of $C_{60}$ Fullerene", J. Phys.D: Appl. Phys. vol. 32 (1999) pp. 1443-1446. 1999 IOP Publishing Ltd., Bristol, GB, XP007900678, ISSN: 0022-3727.

(Continued)

*Primary Examiner* — Joseph L Williams
*Assistant Examiner* — Kevin Quarterman
(74) *Attorney, Agent, or Firm* — Holtz, Holtz, Goodman & Chick, PC

(57) ABSTRACT

An electron emission film having a pattern of diamond in X-ray diffraction and formed of a plurality of diamond fine grains having a grain diameter of 5 nm to 10 nm is formed on a substrate. The electron emission film can restrict the field intensity to a low level when it causes an emission current to flow, and has a uniform electron emission characteristic.

21 Claims, 37 Drawing Sheets

U.S. PATENT DOCUMENTS

| | | | |
|---|---|---|---|
| 2005/0200260 | A1 | 9/2005 | Swain et al. |
| 2005/0275329 | A1 | 12/2005 | Hiraki et al. |
| 2006/0066199 | A1 | 3/2006 | Ichikawa et al. |
| 2006/0104885 | A1 | 5/2006 | Chih et al. |

FOREIGN PATENT DOCUMENTS

| | | | |
|---|---|---|---|
| JP | 09-045215 | A | 2/1997 |
| JP | 9-161655 | A | 6/1997 |
| JP | 09-326231 | A | 12/1997 |
| JP | 2001-202871 | A | 7/2001 |
| JP | 2001-357771 | A | 12/2001 |
| JP | 2002-093305 | A | 3/2002 |
| JP | 2003-59391 | A | 2/2003 |
| JP | 2004-362959 | A | 12/2004 |
| JP | 2004-362960 | A | 12/2004 |
| JP | 2005-015831 | A | 1/2005 |

OTHER PUBLICATIONS

Korean Office Action (and English translation thereof) dated Apr. 28, 2008, issued in a counterpart Korean Application.

Japanese Office Action dated Jun. 2, 2009 and English translation thereof issued in a counterpart Japanese Application No. 2005-252928.

Japanese Office Action dated Jun. 2, 2009 and English translation thereof issued in a counterpart Japanese Application No. 2005-299468.

CURRENT-VOLTAGE CHARACTERISTIC OF ELECTRON EMISSION FILM

FIG. 24A
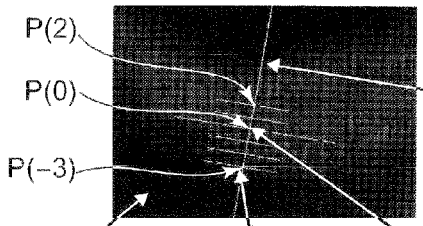
FIG. 24B
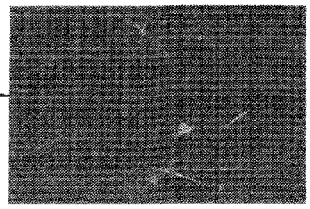
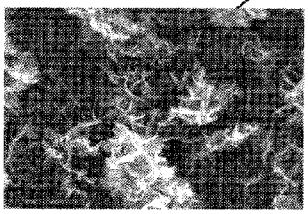
FIG. 24C
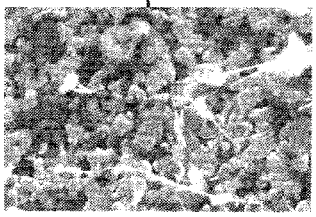
FIG. 24D
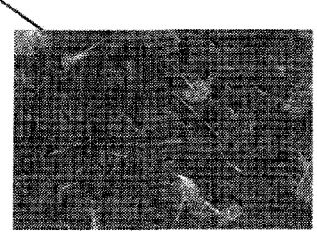
FIG. 24E
FIG. 25
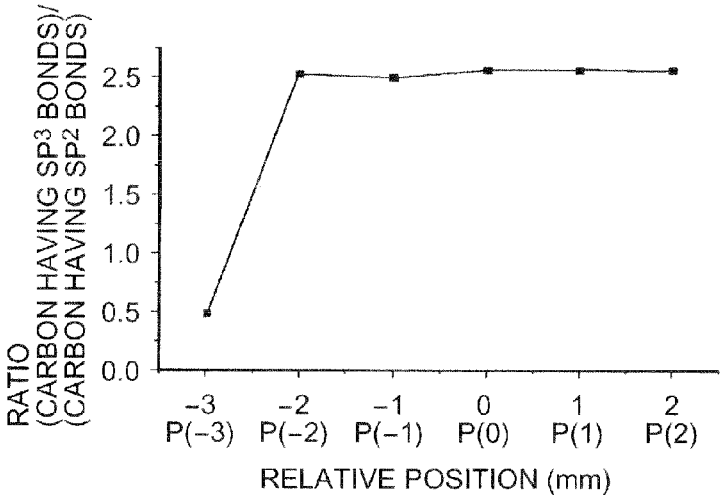

FIELD EMISSION ELECTRODE, MANUFACTURING METHOD THEREOF, AND ELECTRONIC DEVICE

CROSS-REFERENCE TO RELATED APPLICATION

The present application is a Continuation Application of U.S. application Ser. No. 11/287,838 filed Nov. 28, 2005 now U.S. Pat. No. 7,755,271, which is based on Japanese Patent Application Nos. 2004-343203 filed on Nov. 26, 2004, 2005-252928 filed on Aug. 31, 2005, and 2005-299468 filed on Oct. 13, 2005, all of which are incorporated herein by reference in their entirety.

BACKGROUND OF THE INVENTION

1. Field of the Invention

The present invention relates to a field emission electrode which emits electrons by field emission, a manufacturing method thereof, and an electronic device.

2. Description of the Related Art

Field-emission cold cathodes can emit electrons into a vacuum space by applying an electric field to their emitter, and have gained attention as electron emission elements to replace hot cathodes. Various researches have been made to achieve a smaller threshold field intensity (a field intensity which will cause an emission current of 1 mA/cm$^2$) and more stability and uniformity of emission currents.

Techniques for improving the electron emission characteristic of a field emission cold cathode have roughly two tendencies.

One is to make searches into the structures of electron emission materials to achieve a structure for a more enhanced electric field concentration. By sharpening the tip of an electron emission material from which electrons are to be emitted, a strong electric field that can pull out electrons is formed near the tip, which allows electrons to be emitted at a low applied voltage. Hence, many reports about applications of carbon nano tube (hereinafter referred to as CNT), carbon nano fiber, etc. as field-emission type electron emission elements have been made so far. Carbon nano tube is a carbon material with sharp tips that has a minute structure of a nanometer size with a high aspect ratio.

Unexamined Japanese Patent Application KOKAI Publication No. 2003-59391 discloses a manufacturing method of a field emission cold cathode using CNT.

According to this manufacturing method, a substrate to serve as the electron emission electrode is etched to be provided with bosses and recesses thereon, and the surface of the bosses is covered with a conductive material such as Al and then has CNT adhered thereon. After grains of the CNT, which has been produced aside from the substrate by arc discharge, are adhered to the bosses of the substrate by electrophoresis, the conductive material is melted to flow into clearances of the CNT.

The other tendency for improving the electron emission characteristic of the field emission cold cathode is to reduce the potential barrier near the surface of the electron emission material, which is the site to emit electrons therefrom.

It is effective for this purpose to use a material having a small electric affinity as the electron emission material. Especially, diamond has not only negative electron affinity but also a high degree of hardness, and thus is chemically stable. Diamond is therefore suitable as the material for electron emission elements.

However, in case of an electron emission element made of diamond, the higher the crystallinity of diamond is, the lower the basic electric conductivity is, giving rise to a problem that a favorable electric contact is hard to obtain between the diamond and the substrate serving also as an electrode.

To deal with this problem, Unexamined Japanese Patent Application KOKAI Publication No. H9-161655 teaches incorporating impurities such as nitrogen in diamond thereby to improve the electron emission characteristic.

The structure for enhancing the field concentration can have a higher field concentration as the shape of the tip as the electron emission site is sharper, but becomes so less durable. The technique of Unexamined Japanese Patent Application KOKAI Publication No. 2003-59391 has to undergo complicated manufacturing steps after production of the CNT, and suffers a problem that the ratio of CNT that adheres with respect to the yield is low because the CNT grains are physically moved in the dispersion liquid by electrophoresis.

On the other hand, the electron emission element made of diamond is highly durable because of its rigid crystalline structure and is less liable to deteriorate. Furthermore, diamond has a low work function and thus can emit electrons with a low field concentration.

However, the high electric resistivity of diamond is an obstacle against meeting a condition of a field intensity of 1V/μm or less at a current density of 1 mA/cm$^2$, which is one standard in promoting practical use of electron emission elements. This obstacle cannot have been counteracted so far by any of the enhancement of field concentration by improving the surface structure of the emitter film, impartment of a lower resistivity to diamond by doping impurities, improvement of the electric contact between diamond and the conductive substrate.

Accordingly, an object of the present invention is to provide a field emission electrode easy to manufacture and having a high current density at a low field intensity, a manufacturing method of such an electrode, and an electronic device.

SUMMARY OF THE INVENTION

To achieve the above object, a field emission electrode according to the present invention comprises an electron emission film including a plurality of diamond fine grains having a grain diameter of 5 nm to 10 nm.

Another field emission electrode according to the present invention comprises an electron emission film including a plurality of diamond fine grains and having a ratio (D-band intensity)/(G-band intensity) of 2.5 to 2.7.

Another field emission electrode according to the present invention comprises:

an electron emission film including a plurality of diamond fine grains; and sticks formed on a surface of the electron emission film.

A manufacturing method of a field emission electrode according to the present invention comprises a step of supplying a material gas which includes carbon in its composition into a process chamber to generate plasma in the process chamber, and forming an electron emission film including a plurality of diamond fine grains on a substrate in the process chamber.

Another manufacturing method of a field emission electrode according to the present invention comprises:

a step of supplying a material gas which includes carbon in its composition into a process chamber to generate plasma in the process chamber, and forming a layer of carbon-nanowall on a substrate in the process chamber; and a step of forming an electron emission film including a plurality of diamond fine grains on the layer of carbon-nanowall.

Another manufacturing method of a field emission electrode according to the present invention comprises a step of supplying a material gas which includes a compound containing carbon in its composition into a process chamber to generate plasma in the process chamber, thereby forming an electron emission film including a plurality of diamond fine grains, and sticks disposed on a surface of the electron emission film.

An electronic device according to the present invention comprises:

a field emission electrode which comprises an electron emission film including a plurality of diamond fine grains having a grain diameter of 5 nm to 10 nm;

an opposite electrode which is provided so as to face the field emission electrode; and a fluorescent film which emits light by electrons emitted from the field emission electrode.

Another electronic device according to the present invention comprises:

a field emission electrode which comprises an electron emission film including a plurality of diamond fine grains and having a ratio (D-band intensity)/(G-band intensity) of 2.5 to 2.7;

an opposite electrode which faces the field emission electrode; and a fluorescent film which emits light by electrons which are field-emitted from the field emission electrode.

Another electronic device according to the present invention comprises:

a field emission electrode which comprises an electron emission film including a plurality of diamond fine grains and having a ratio (carbon having $sp^3$ bonds)/(carbon having $sp^2$ bonds) of 2.5 to 2.7;

an opposite electrode which faces the field emission electrode; and a fluorescent film which emits light by electrons which are field-emitted from the field emission electrode.

Another electronic device according to the present invention comprises:

a field emission electrode which comprises an electron emission film including a plurality of diamond fine grains and having resistivity of 1 kΩ·cm to 18 kΩ·cm;

an opposite electrode which faces the field emission electrode; and a fluorescent film which emits light by electrons which are field-emitted from the field emission electrode.

Another electronic device according to the present invention comprises:

a field emission electrode which comprises an electron emission film including a plurality of diamond fine grains, and sticks formed on a surface of the electron emission film;

an opposite electrode which is formed so as to face the field emission electrode; and a fluorescent film which emits light by electrons emitted from the field emission electrode.

A field emission electrode or an electronic device according to the present invention can realize field emission having a high current density at a low field intensity.

BRIEF DESCRIPTION OF THE DRAWINGS

These objects and other objects and advantages of the present invention will become more apparent upon reading of the following detailed description and the accompanying drawings in which:

FIGS. 24A to 24E show expanded image of some regions of the electron emission film;

FIG. 25 is a diagram showing a ratio (carbon having $sp^3$ bonds)/(carbon having $sp^2$ bonds) at each position of the electron emission film shown in FIG. 24A;

FIGS. 45A and 458 are an image showing a state of light emission by a fluorescent tube in a case where the density of the number of sticks is 5000 sticks/$mm^2$ to 15000 sticks/$mm^2$, and a photographed image of the surface of the electron emission film obtained by a scanning electron microscope;

DETAILED DESCRIPTION OF THE PREFERRED EMBODIMENTS

The embodiments of the present invention will now be specifically explained with reference to the drawings.

Embodiment 1

Figure 1:
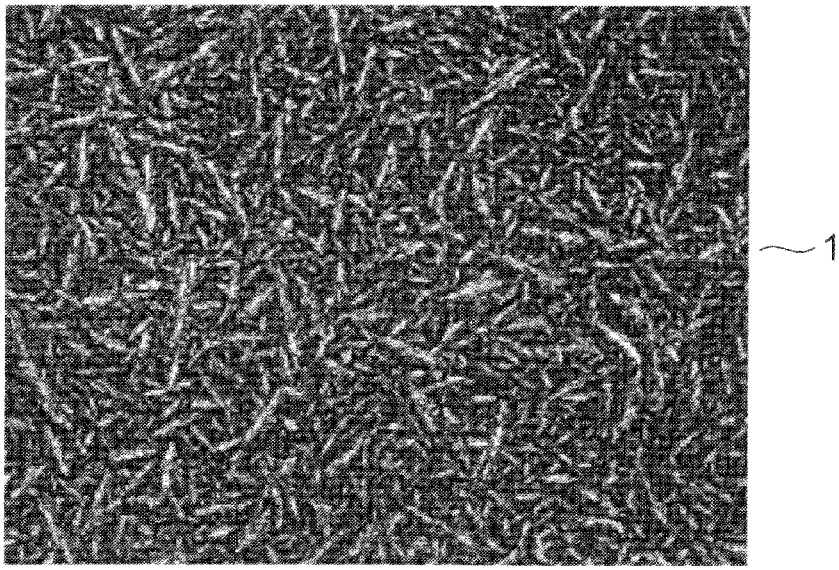
FIG. 1 is a scanned image of the surface of an electron emission film according to the embodiment 1 of the present invention, obtained by a scanning electron microscope.

FIG. 1 is an image obtained by scanning the surface of a diamond thin film, as the electron emission portion of a field emission electrode according to the embodiment 1 of the present invention, by using a scanning electron microscope.

Figure 2:
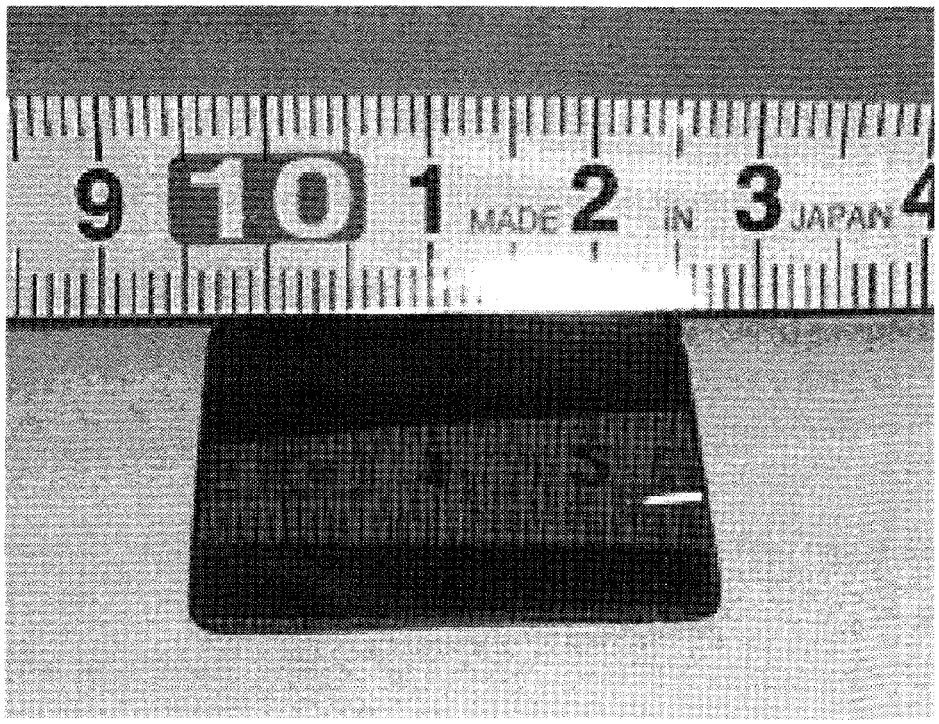
FIG. 2 is an image showing specular reflection on the electron emission film.

FIG. 2 is an image showing specular reflection on the electron emission film.

Figure 3:
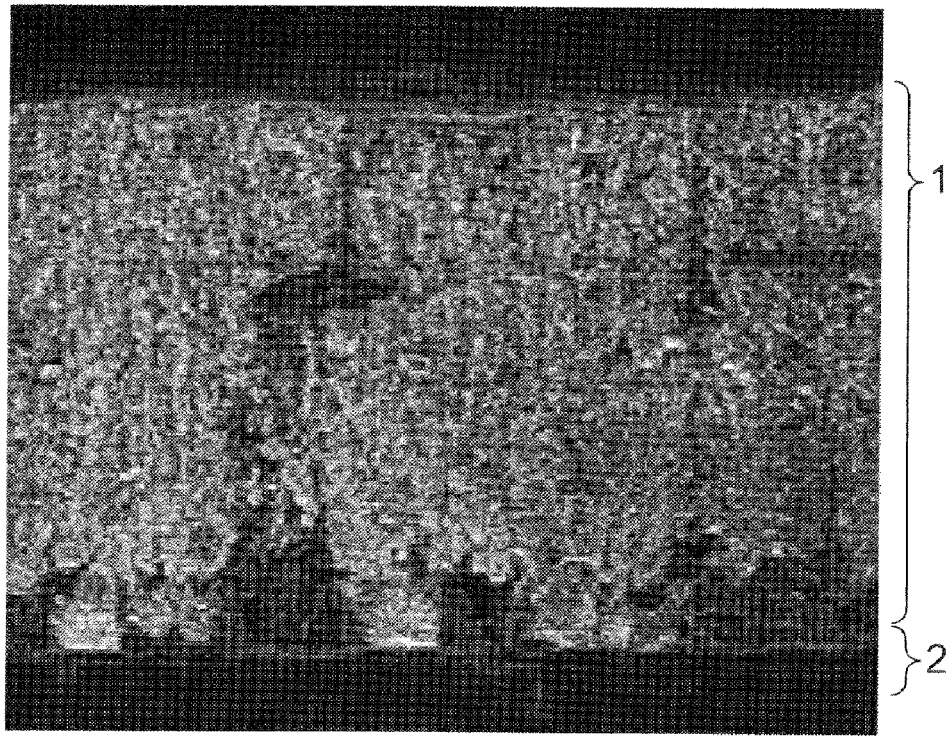
FIG. 3 is a secondary electron image showing a cross section of the electron emission film and a substrate.

FIG. 3 is a secondary electron image showing a cross section of the electron emission film and a substrate.

Figure 4:
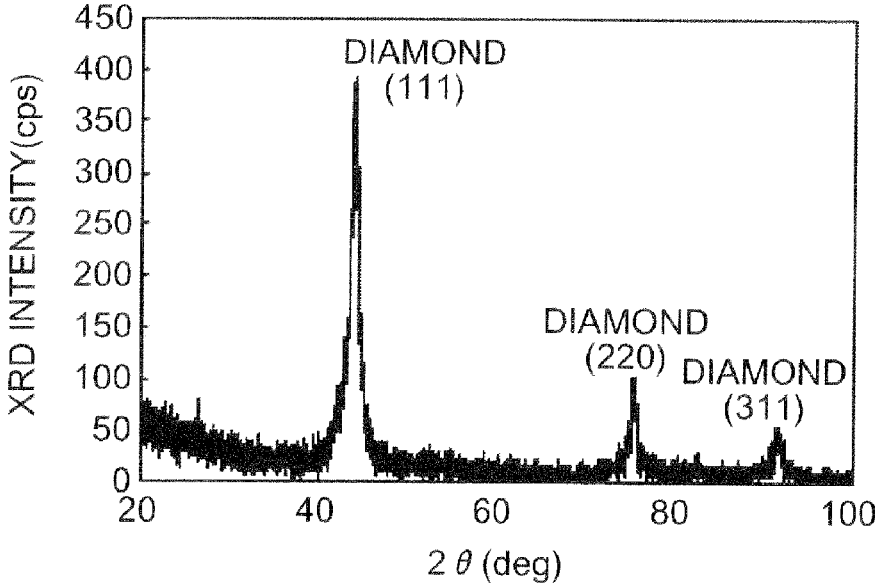
FIG. 4 is a diagram showing an X-ray diffraction pattern of an electron emission film.

FIG. 4 is a diagram showing the X-ray diffraction pattern of the electron emission film.

Figure 5:
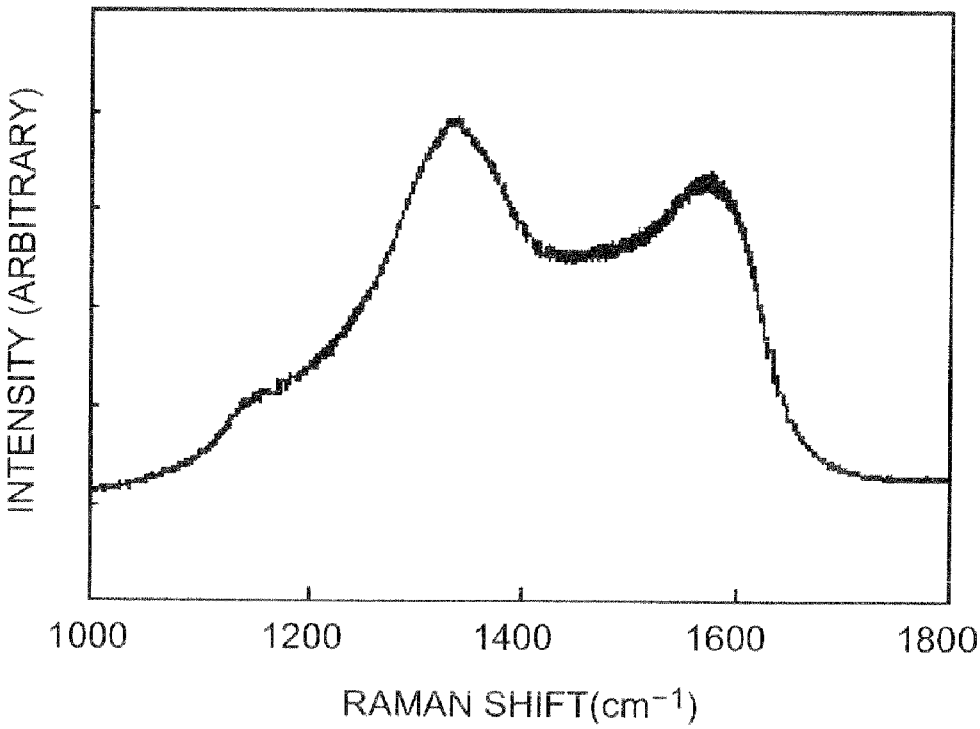
FIG. 5 is a diagram showing a Raman spectroscopy spectrum of the electron emission film.

FIG. 5 is a diagram showing Raman spectroscopy spectrum of the electron emission film.

This electron emission film 1 is a diamond thin film made of diamond crystal grains having a grain diameter of 5 nm to 10 nm, and is formed on a substrate 2 made of a conductive material or a semiconductive material. The substrate 2 and the electron emission film 1 constitute a field emission cold cathode.

Microscopic observation of the surface of the electron emission film 1 by using a scanning electron microscope shows that a plurality of diamond fine grains having a grain diameter of 5 nm to 10 nm are aggregated in the number of about several tens to several hundreds thereby to form a tissue like a bamboo leaf having a length of about 100 μm or more. The electron emission film 1 seems flat with no bosses and recesses to the naked eye, and therefore has specular reflection thereon as shown in FIG. 2.

As shown in FIG. 3, it is observed that the electron emission film 1 is formed of a simple tissue whose thickness from the surface of the substrate 2 to its film surface is almost uniform, and a plurality of diamond crystal grains with a grain diameter of 5 nm to 10 nm and black carbon very thinly covering the surface of the diamond crystal grains are present. The X-ray diffraction pattern through the electron emission film 1 has conspicuous peaks of the diamond crystal as shown in FIG. 4. Note that diamond-like carbon shows no so high orientation as diamond, hence does not show such sharp peaks as shown in FIG. 4 by X-ray spectrum.

When the electron emission film 1 is subjected to Raman spectroscopy using laser light having a wavelength of 532 nm, peaks are observed at near 1350 $cm^{-1}$ and near 1580 $cm^{-1}$ as shown in FIG. 5. The half-value width of the peak at near 1350 $cm^{-1}$ is 50 $cm^{-1}$ or more.

It is apparent that the electron emission film 1 is formed not only of diamond crystal grains, because the electron emission film 1 shows a very small resistivity of several kΩ·cm as compared to the resistivity inherent in diamond, in spite of its possession of the diamond structure.

That is, the presence of the diamond structure in the composition of the electron emission film 1 has been confirmed from the X-ray diffraction pattern, and the presence in the electron emission film 1 of carbon including carbon having a graphite structure containing $sp^2$ bonds and showing conductivity can be confirmed because a broad peak whose half-value width is 50 cm or more has been observed in the Raman spectroscopy spectrum, which means that the electron emission film 1 is a complex material in which such carbon is formed in the clearances between the diamond crystal grains and in the outermost surface of the electron emission film 1.

Next, a thin film forming method for forming the electron emission film 1 on the substrate 2 will be explained.

A silicon monocrystal wafer which has, for example, a crystal surface (100) is cut into squares having a side length of 30 mm, and the surface of the square is scratched to form recesses (grooves) whose average roughness is 3 μm or less, by using diamond fine grains having a grain diameter of 1 to 5 μm, which are to be used as nuclei for growing the electron emission film 1. The scratched wafer will be the substrate 2. Degreasing and ultrasonic cleaning are simultaneously applied to the substrate 2 embossed and recessed by scratching.

Figure 6:
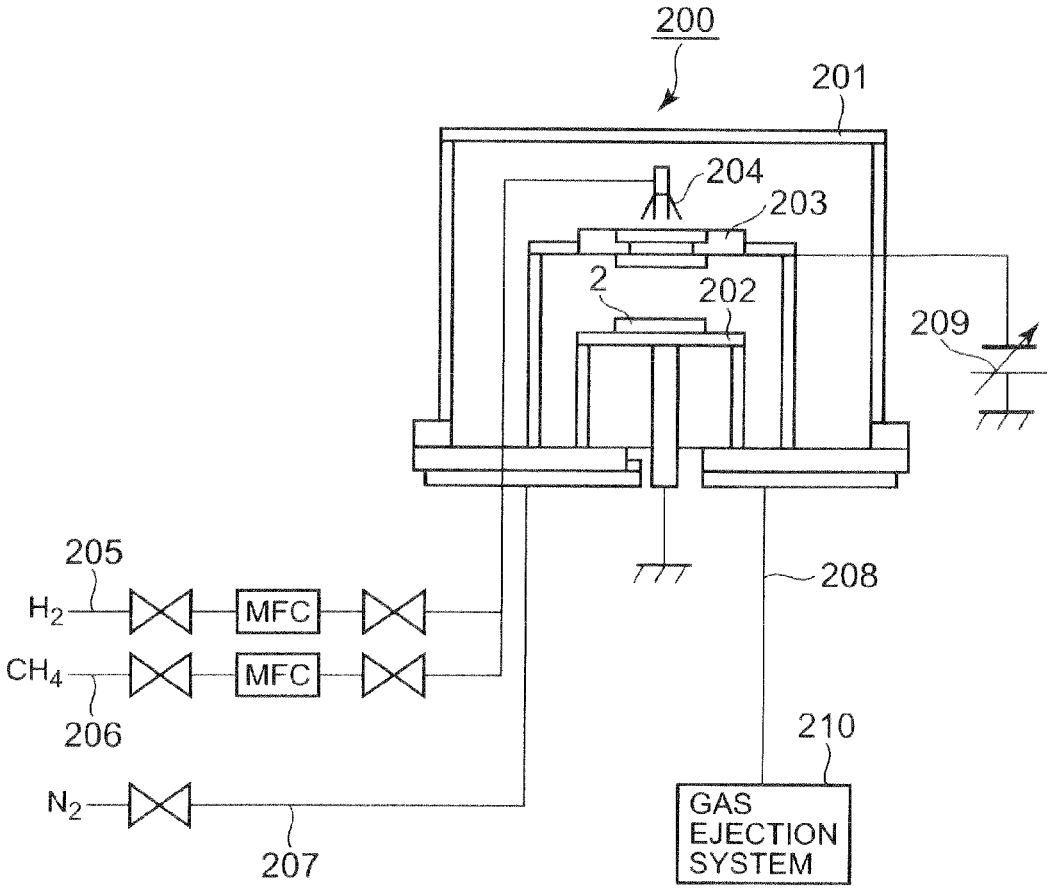
FIG. 6 is a diagram showing a DC plasma CVD system.

The substrate 2 is then placed on a susceptor 202 in a DC plasma CVD system 200 having the configuration shown in FIG. 6.

The DC plasma CVD system 200 is a general-purpose processing system, and comprises a process chamber 201, a susceptor 202, an upper electrode 203, a process gas showerhead 204, gas supply pipes 205 and 206, a purge gas supply pipe 207, a gas ejection pipe 208, and a direct-current (DC) power source 209.

The susceptor 202 serves also as a lower electrode and has a process target placed thereon. The upper electrode 203 has a lower voltage applied thereto than that applied to the lower electrode 202.

The gas supply pipe 205 comprises a mass flow controller (MK) and valves, and introduces hydrogen gas to the showerhead 204. The gas supply pipe 206 comprises an MFC and valves, and introduces gas comprising a compound containing a carbon in its composition that includes at least one of (1) a hydrocarbon compound such as methane, ethane, acetylene, etc., (2) an oxygen-containing hydrocarbon compound such as methanol, ethanol, etc., (3) an aromatic hydrocarbon such as benzol, toluene, etc., (4) carbon monoxide, and (5) carbon dioxide, to the showerhead 204.

The purge gas supply pipe 207 introduces nitrogen gas as purge gas to the process chamber 201, after the electron emission film 1 is formed. The gas ejection pipe 208 is connected to a gas ejection system 210 for ejecting gas from the process chamber 201. The DC power source 109 applies a DC current between the susceptor 202 and the upper electrode 203.

When the substrate 2 is placed on the susceptor 202, the interior of the process chamber 201 is depressurized, and then hydrogen gas and gas (material gas) comprising a compound containing a carbon such as methane are introduced from gas supply sources to the showerhead 204 through the gas supply pipes 205 and 206. The material gas is supplied into the process chamber 201 to form the electron emission film 1 on the surface of the substrate.

The gas comprising a compound containing carbon in its composition is preferably 3vol % to 30vol % of the whole material gas. For example, the mass flow of methane is set at 50 SCCM while that of hydrogen is set at 500 SCCM, and the whole pressure is set at 0.05 to 0.15 atm, preferably at 0.07 to 0.1 atm. The substrate 2 is rotated at 10 rpm, and the state of plasma and the temperature of the substrate 2 are controlled by adjusting the voltage output from the DC power source 209 to between the susceptor (lower electrode) 202 and the upper electrode 203 such that the temperature variation on the substrate 2 is restricted within 5° C.

When the electron emission film 1 is being formed, the portion of the substrate 2 where the electron emission film 1 is to be formed is maintained at a temperature of 840° C. to 890° C. for 120 minutes. Particularly, an electron emission film 1 of a stable characteristic could be obtained when the temperature of the portion of the substrate 2 where the electron emission film 1 is to be formed was 860° C. to 870° C. These temperatures were measured by a spectroscopic method. It was confirmed that the electron emission film 1 including diamond fine grains can be grown even if the gas comprising a compound containing carbon in its composition is less than 3vol % of the whole material gas, but the electron emission characteristic of such a film is extremely poor.

At the end of the film formation, the voltage application between the susceptor 202 and the upper electrode 203 is stopped, and then the supply of the process gas is stopped. Nitrogen gas is supplied into the process chamber 201 through the purge gas supply pipe 207 to restore the atmospheric pressure, and the substrate 2 is taken out.

Through the above-described steps, the electron emission film 1 is formed.

Figure 7:
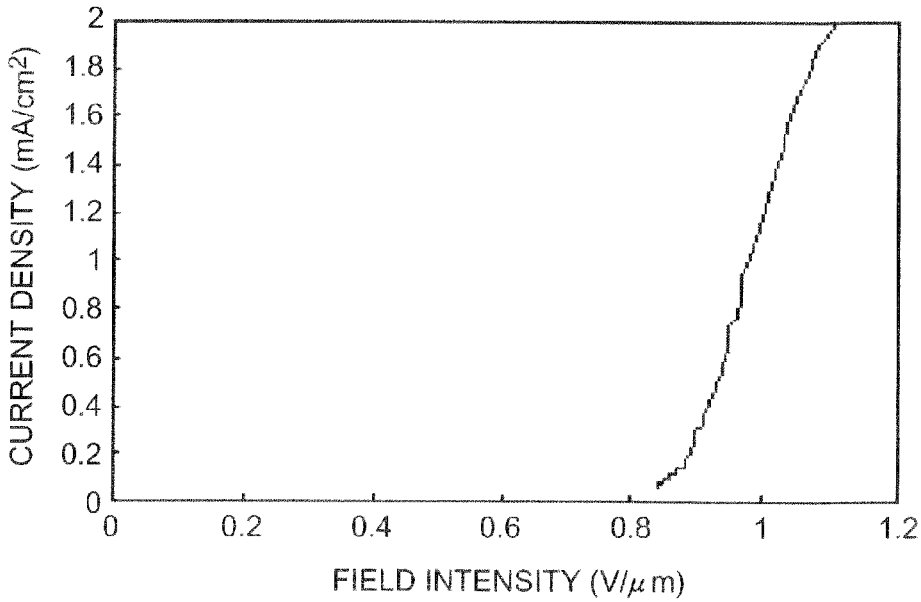
FIG. 7 is a diagram showing the electron emission characteristic of a field emission cold cathode comprising the electron emission film and substrate.

FIG. 7 is a diagram showing the electron emission characteristic of a field emission electrode constituted by the electron emission film 1 and the substrate 2.

Figure 8:
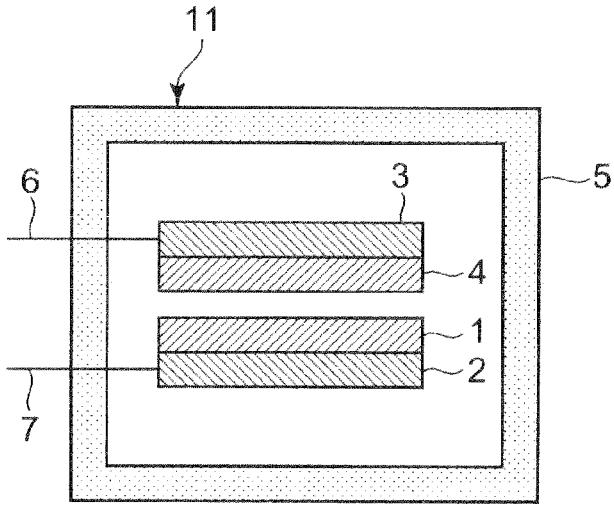
FIG. 8 is a schematic cross section of an electronic device constituted by a field emission fluorescent tube comprising a field emission electrode including the electron emission film.

FIG. 8 is a schematic cross sectional view of an electronic device constituted by a field emission fluorescent tube 11 comprising a field emission electrode including the electron emission film 1 having such a diamond structure.

Figure 9:
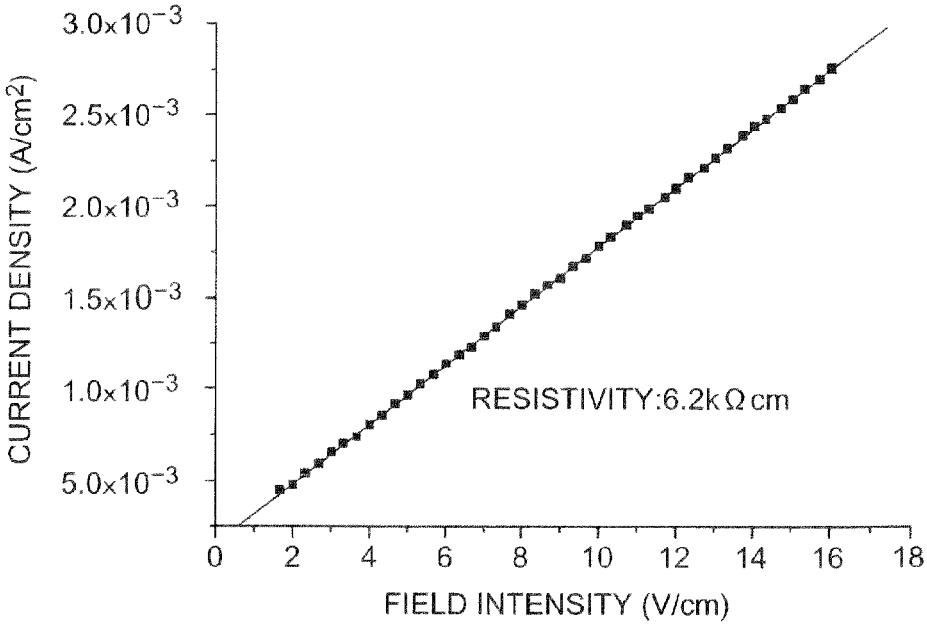
FIG. 9 is a diagram showing the current-voltage characteristic of the electron emission film according to the embodiment 1.

FIG. 9 is a diagram showing a current-voltage characteristic of the electron emission film 1 formed through the above-described steps.

Figure 10:
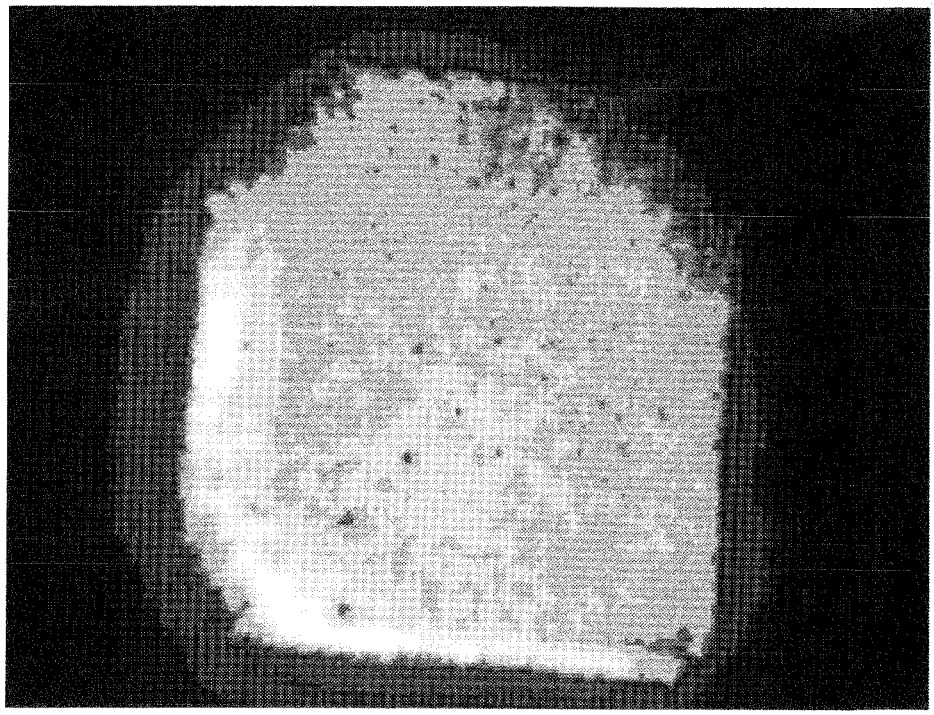
FIG. 10 is a diagram showing a state of light emission by a fluorescent plate, caused by electron emission from the electron emission film.

FIG. 10 is a diagram showing a state of light emission caused by electron emission from the electron emission film 1.

Though it is apparent from XRD measurement that the electron emission film 1 has a diamond structure, it shows, as shown in FIG. 9, a resistivity of about 6 kΩ·cm, which is much smaller than the resistivity of smaller than $10^{15}$Ω·cm inherent in diamond.

The resistivity of a favorable electron emission film 1 was 1 kΩ·cm to 18Ω·cm. The electron emission film 1 allows presence of carbon including carbon having $sp^2$ bonds of the above-described graphite structure between the diamond fine grains, and of which carbon, carbon having the graphite structure showing conductivity contributes to lowering the resistivity of the whole electron emission film 1.

To evaluate the field emission electrode (cold cathode) formed through the above-described steps, the field intensity in case of the current density of cold electrons emitted from the electron emission film 1 being 1 mA/cm$^2$ is 0.95V/μm, as shown in FIG. 7. Since the electron emission film 1 can show conductivity of 1 kΩ·cm to 18 kΩ·cm, it can have an excellent electron emission characteristic.

The field emission fluorescent tube 11 comprising the field emission electrode including the electron emission film 1 comprises, as shown in FIG. 8, a cathode electrode as field emission electrode including the electron emission Y film 1 formed on the substrate 2, an anode electrode 3 as opposite electrode formed of a fluorescent film 4 on the surface facing the electron emission film 1, and a glass tube 5 which seals the cathode electrode and the anode electrode 3 in a vacuum atmosphere. A wire 7 made of nickel is connected to the electron emission film 1 or the substrate 2, and a wire 6 made of nickel is connected to the anode electrode 3.

The fluorescent plate is observed as causing, due to electron emission, light emission with a high luminance at a low voltage, as shown in FIG. 10. Since being able to be driven at a low voltage like this, the electron emission film 1 can elongate its life of electron emission. The field emission fluorescent tube 11 is one called VFD (Vacuum Fluorescent Display) which causes light emission by making cold electrons collide against the fluorescent film 4 by applying a predetermined voltage between the anode electrode 3 and the cathode electrode, and can also be used in an FED (Field Emission Display) having a flat panel structure which includes a plurality of such light emission regions as pixels.

Since such an electron emission film 1 has the nanodiamond aggregates in its emitter surface, it can produce a high current density at a low field intensity and can have a high durability because it has no hysteresis in its electron emission characteristic.

Embodiment 2

Figure 11:
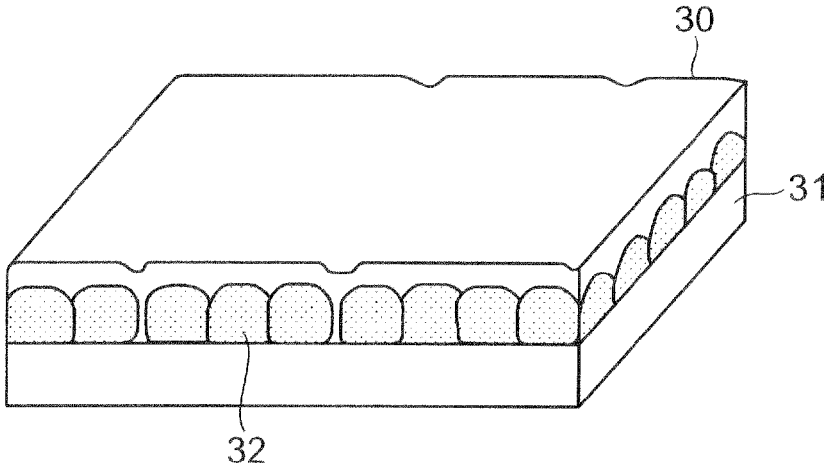
FIG. 11 is a model diagram schematically showing an electron emission film according to the embodiment 2 of the present invention.

FIG. 11 is a diagram schematically showing an electron emission film 30 according to the embodiment 2 of the present invention.

Figure 12:
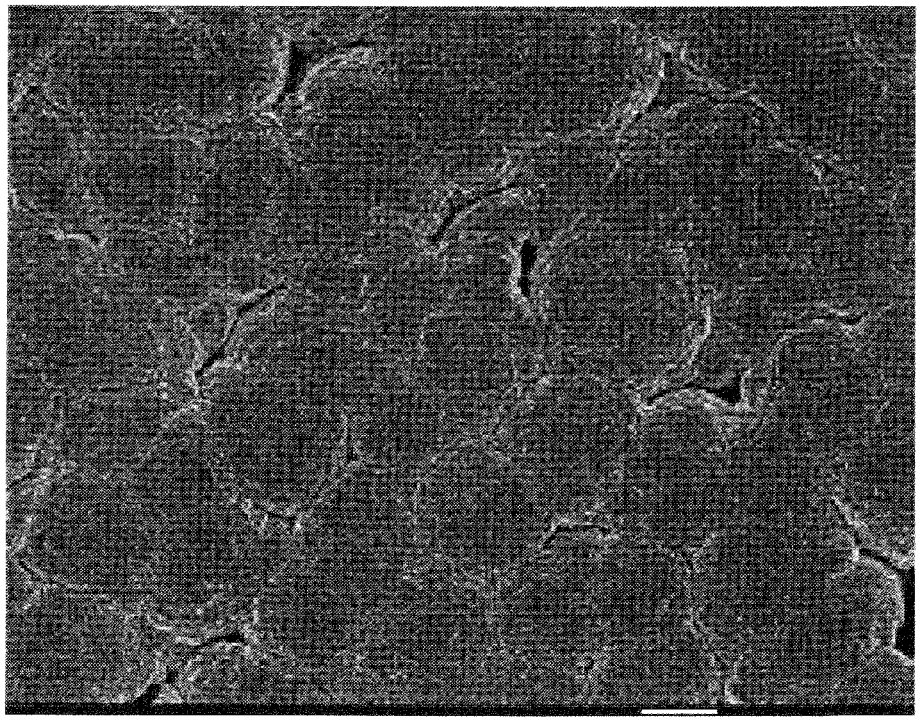
FIG. 12 is an image obtained by scanning the surface of the electron emission film of FIG. 11 by using a scanning electron microscope.

FIG. 12 is an image obtained by scanning the surface of the electron emission film 30 of FIG. 11 including diamond fine grains, by using a scanning electron microscope.

Figure 13:
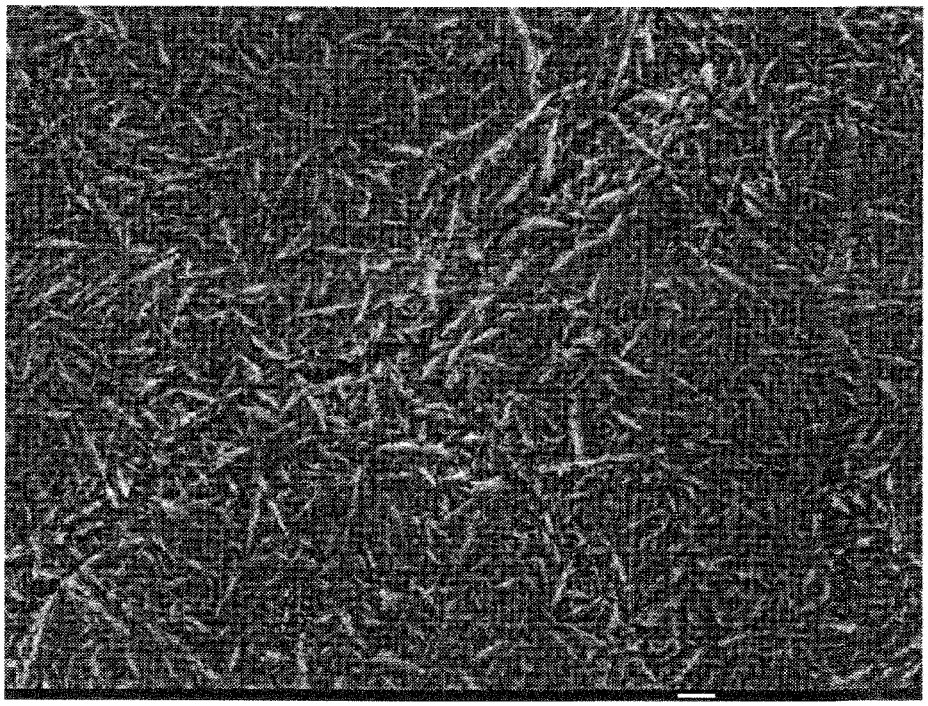
FIG. 13 is an expanded image of the electron emission film of FIG. 12.

FIG. 13 is an expanded image of the electron emission film 30 of FIG. 12.

Figure 14:
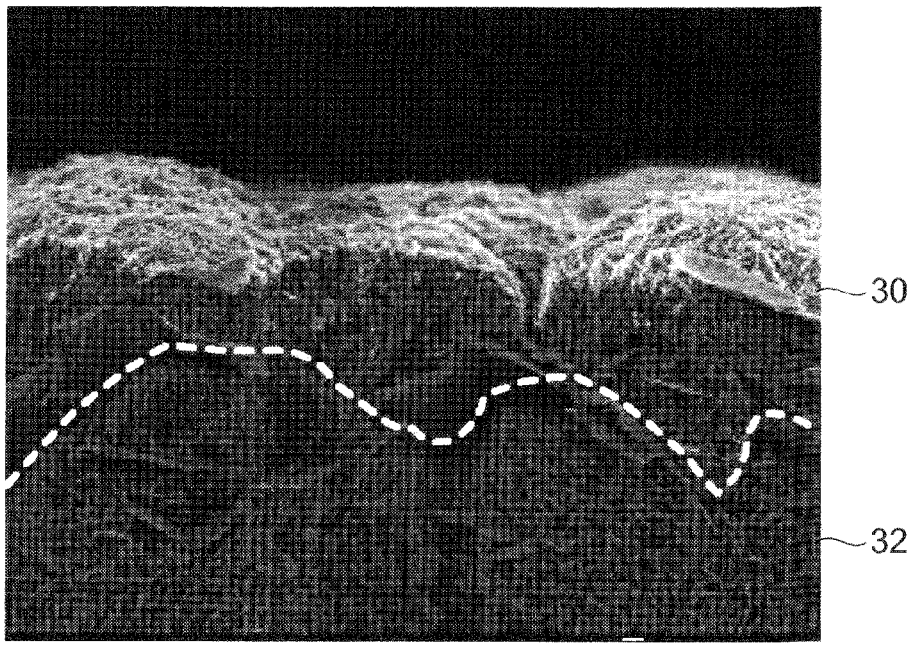
FIG. 14 is a secondary electron image showing a cross section of the electron emission film of FIG. 11 and a carbon-nanowall.

FIG. 14 is a secondary electron image showing a cross section of the electron emission film 30 of FIG. 12 and of a carbon-nanowall 32.

The electron emission film 30 according to the embodiment 2 includes a diamond structure in its composition likewise the electron emission film 1 according to the embodiment 1, but is not formed directly on a substrate as in the embodiment 1 but is formed on the carbon-nanowall 32 which is formed on a substrate 31.

The carbon-nanowall 32 is formed of a plurality of carbon thin flakes of a petal (fan) shape having a curved surface which are uprightly bonded to the others in random directions. The carbon-nanowall 32 has a thickness of 0.1 nm to 10 μm. Each carbon thin flake is formed of several to several tens of graphene sheets having a lattice interval of 0.34 nm.

The electron emission film 30 is formed of a plurality of diamond fine grains having grain diameter of 5 nm to 10 nm, and has an aggregate of several tens to several hundreds of diamond fine grains in its surface as in the embodiment 1, which form a bamboo-leaf-like tissue as shown in FIG. 13. A plurality of such bamboo-leaf-like tissues are gathered to form dense colonies whose surface is generally circular. Such an electron emission film 30 covers the carbon-nanowall 32, as shown in FIG. 11. The colony diameter of the electron emission film 30 is about 1 μm to 5 μm, and it is preferable that the colonies are grown to such an extent enough to completely cover the carbon-nanowall 32 with no uncovered portion left.

The method of forming such an electron emission film 30 will be explained.

First, for example, a nickel plate is cut into substrates 31 and then sufficiently degreased and cleaned by ultrasonic using ethanol or acetone.

The substrate 31 is placed on the susceptor 202 in the DC plasma CVD system 200 having the configuration of FIG. 6.

When the substrate 31 is placed on the susceptor 202, the process chamber 201 is depressurized, hydrogen gas and gas comprising a compound (carbon-containing compound) containing carbon such as methane in its composition are introduced to the showerhead 204 from the gas supply sources through the gas supply pipes 205 and 206, and the material gas is supplied into the process chamber 201.

The gas comprising a compound containing carbon in its composition is preferably 3vol % to 30vol % of the whole material gas. For example, the mass flow of methane is set at 50 SCCM while that of hydrogen is set at 500 SCCM, and the whole pressure is set at 0.05 to 0.15 atm, preferably at 0.07 to 0.1 atm. The substrate 31 is rotated at 10 rpm, and the state of plasma and the temperature of the substrate 31 are controlled by adjusting the voltage output from the DC power source 209 to between the susceptor (lower electrode) 202 and the upper electrode 203 such that the temperature variation on the substrate 31 is restricted within 5° C.

While the carbon-nonowall 32 is being formed, the portion of the substrate 31 where the carbon-nanowall 32 is to be formed is maintained at 900° C. to 1100° C. These temperatures were measured by a spectroscopic method. Continuously with the gas atmosphere unchanged, the temperature of the portion where a plurality of diamond fine grains are to be formed is set at 10° C. or more lower than that of the substrate 31 when the carbon-nanowall 32 was being formed, thus to be 890° C. to 950° C., more preferably to be 920° C. to 940° C., thereby forming the electron emission film 30, which is formed of a plurality of densely gathered diamond fine grains having been grown from the nucleus of carbon-nanowall 32. The period of time in which the temperature of the electron emission film 30 is maintained is preferably about 30 minutes to 120 minutes. It was found that the electron emission film 30 was formed at temperatures of a higher range than that of the embodiment 1. This shows that the base film affects the temperature at which the electron emission film 30 is formed, and it was further found that changes in the plasma irradiation condition causes changes in the appropriate temperature range. However, by decreasing the temperature to be lower than that of the substrate 31 at the time the carbon-nanowall 32 was being formed thereon, the electron emission film 30 was formed relatively quickly. Especially, by an abrupt temperature decrease of 10° C. or more, the film being formed quickly transformed into the electron emission film 30. The electron emission film 30 covers the entire surface of the carbon-nanowall 32, and its topmost surface is flatter than the surface of the carbon-nanowall 32 as shown in FIG. 14. It was confirmed that the electron emission film 30 including diamond fine grains can be grown even if the gas comprising a compound containing carbon in its composition is less than 3vol % of the whole material gas, but the electron emission characteristic of such a film is extremely poor.

A radio-spectrometer is employed as the temperature measuring device used for such film formation. Therefore, if such an electron emission film 30 was directly formed on the substrate, radiation from the electron emission film 30 would become unstable so that a bad influence would be given on the temperature measurement. However, since the emissivity of the carbon-nanowall 32 is 1, using the carbon-nanowall 32 as the base film and setting 0.7 as the emissivity of the upper film in accordance with diamond as the main component of the upper film would allow the temperature to be measured stably.

At the end of the film formation, the voltage application between the susceptor 202 and the upper electrode 203 is stopped, and then the supply of the process gas is stopped. Nitrogen gas is supplied into the process chamber 201 through the purge gas supply pipe 207 to restore the atmospheric pressure, and then the substrate 31 is taken out.

The electron emission film 30 shown in FIG. 11 is formed through the above-described steps.

By appropriately selecting the conditions such as the mixture ratio of the material gas, the gas pressure, the bias voltage of the substrate 31, etc., and by maintaining the temperature of the portion where the carbon-nanowall 32 is to be formed to be higher than the film forming temperature set for the electron emission film 30 formed of diamond fine grains and to be in the range of 90° C. to 1100° C. for 30 minutes, the layer of carbon-nanowall 32 is formed on the substrate 31. Subsequently, by decreasing the temperature of the portion where the electron emission film 30 formed of diamond fine grains is to formed by 10° C. from the temperature at which the carbon-nanowall 32 was formed, the electron emission film 30 is formed on the carbon-nanowall 32. The carbon-nanowall 32 has an excellent electron emission characteristic, but has bosses and recesses of several microns, which makes the carbon-nanowall 32 difficult to form a uniform emission site thereon. A uniform surface shape can be obtained by forming the electron emission film 30 formed of diamond fine grains on the carbon-nanowall 32.

The electron emission film 30 formed by the above-described steps will now be evaluated.

Figure 15:
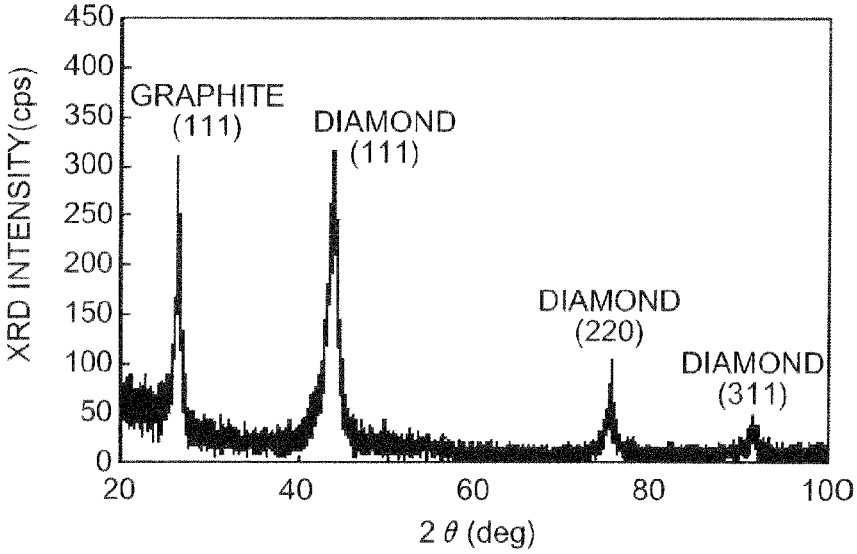
FIG. 15 is a diagram showing an X-ray diffraction pattern of the electron emission film.

FIG. 15 is a diagram showing the X-ray diffraction pattern of the electron emission film 30.

To check the X-ray diffraction pattern of the electron emission film 30, conspicuous peaks of the diamond crystal and also a peak of the graphite were observed. Taken together with FIG. 4, it is obvious that this peak of the graphite structure is attributed to the carbon-nanowall 32. Further, the principal surface of the electron emission film 30 is not only of diamond fine grains, but also a very thin film covering the diamond fine grains was found thereon. It was confirmed that this film is of carbon including graphite carbon showing conductivity, taking into consideration the fact that the resistivity of the excellent electron emission film 30 was several kΩ·cm, and the composition of the material gas used in the above-described manufacturing steps. The electron emission film 30 allows presence of carbon including carbon having $sp^2$ bonds of the above-described graphite structure in its topmost surface and between the diamond fine grains, and of which carbon, carbon having the graphite structure showing conductivity contributes to lowering the resistivity of the whole electron emission film 30.

Figure 16:
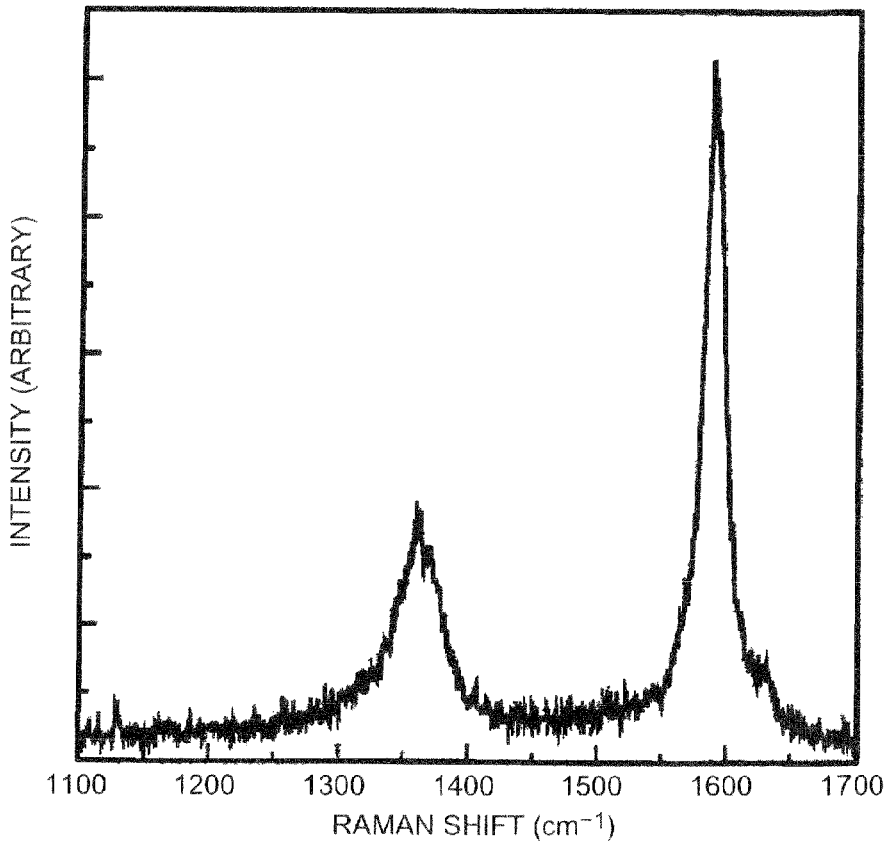
FIG. 16 is a diagram showing a Raman spectroscopy spectrum of the carbon-nanowall.

FIG. 16 shows the spectrum of the carbon-nanowall 32 obtained by Raman spectroscopy before the electron emission film 30 is formed thereon.

The carbon thin flakes of the carbon-nanowall 32 show a sharp ratio of intensity between a G-band peak at near 1580 $cm^{-1}$ having a half-value width of less than 50 $cm^{-1}$, which is due to the vibration of carbon atoms in the hexagon lattices formed by carbon-carbon bonds ($sp^2$ bonds) of the graphite structure, and a D-band peak at near 1350 $cm^{-1}$ having a half-value width of less than 50 $cm^{-1}$, which is due to $sp^3$ bonds, and show almost no other peaks. It is therefore obvious that a carbon-nanowall 32 formed of a dense and highly-pure graphite structure has been grown.

When the electron emission film 30 is subjected to Raman spectroscopy using laser light having a wavelength of 532 nm, peaks are observed at near 1350 $cm^{-1}$ and near 1580 $cm^{-1}$, likewise the electron emission film 1 of the embodiment 1. The half-value width of the peak at near 1350 $cm^{-1}$ is 50 $cm^{1}$ or more. That is, the presence in the composition of the electron emission film 30 of crystalline diamond is confirmed from the X-ray diffraction pattern and a broad peak whose half-value width is 50 $cm^{-1}$ or more has been observed in the Raman spectroscopy spectrum, which suggests the presence of carbon having $sp^2$ bonds which are the main factor for the possession by the electron emission film 30 of conductivity and the presence of carbon including amorphous carbon having a resistivity of mega Ω·cm level. The electron emission film 30 is a complex material of these kinds of carbon.

Likewise the embodiment 1, though it is apparent from XRD measurement that the electron emission film 30 has a diamond structure, it shows a resistivity of 20 kΩ·cm or less, which is much smaller than the resistivity of smaller than $10^{16}$Ω·cm inherent in diamond.

The resistivity of a favorable electron emission film 30 was 1 kΩ·cm to 18 kΩ·cm. It can therefore be recognized that in the electron emission film 30, the substance formed in the uppermost surface and in the clearances between the diamond fine grains includes the above-described carbon having $sp^2$ bonds, and this $sp^2$ bond carbon has the graphite structure and contributes to lowering the resistivity of the whole electron emission film 30.

Figure 17:
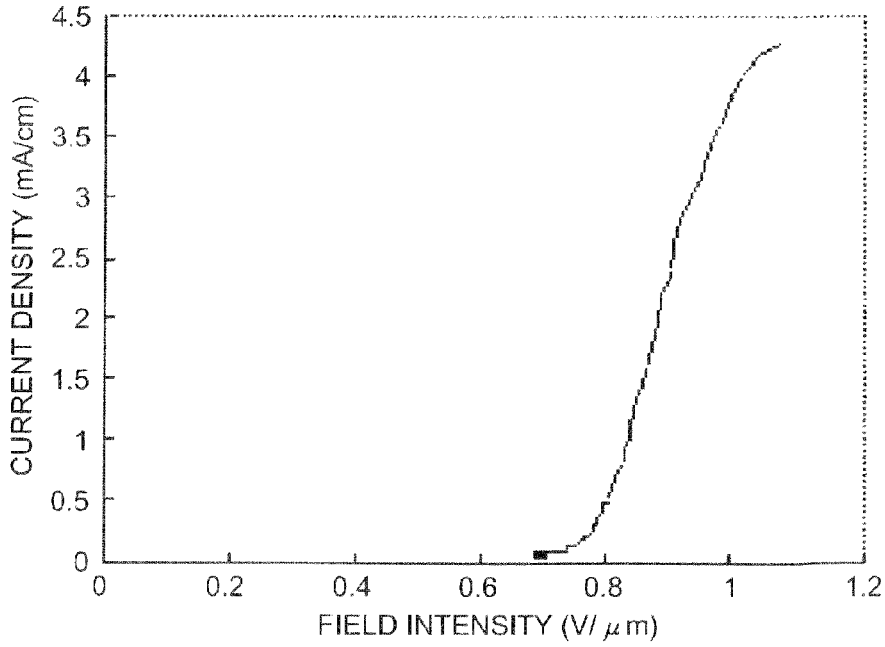
FIG. 17 is a diagram showing the electron emission characteristic of a field emission cold cathode comprising the electron emission film and carbon-nanowall.

FIG. 17 is a diagram showing the electron emission characteristic of a field emission cold cathode constituted by the electron emission film 30, the substrate 31, and the carbon-nanowall 32.

The field intensity in case of the current density of cold electrons emitted from the field emission cold cathode constituted by the electron emission film 30, the substrate 31, and the carbon-nanowall 32 being 1 mA/$cm^2$ is, as shown in FIG. 17, 0.84V/μm. This electron emission characteristic is more favorable than that of the embodiment 1.

The presence of the carbon-nanowall 32 having high plasticity between the substrate 31 and the electron emission film 30 makes it easier to grow the electron emission film 30 including diamond fine grains and graphite carbon, which then makes it possible to ease the condition, as a criterion for selecting the substrate 31, that the substrate 31 has to be made of a material on which a film of diamond fine grains can be formed, or to ease the stress caused by the difference in thermal expansion coefficient, i.e., a thermal shock caused during the cooling process after the film formation by heating, which would produce a gap between the substrate 31 and the diamond fine grains to thereby cause the electron emission film to be separated or produce cracks between the plurality of aggregates of diamond fine grains.

Figure 18:
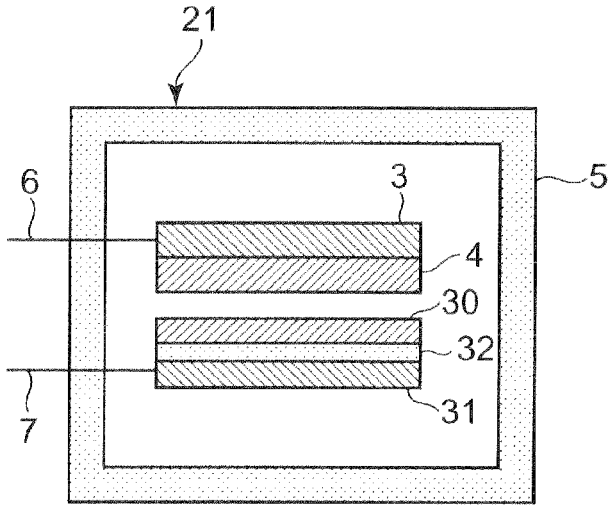
FIG. 18 is a schematic cross section of an electronic device constituted by a field emission fluorescent tube comprising a field emission electrode including the electron emission film.

FIG. 18 is a schematic cross sectional view of an electronic device constituted by a field emission fluorescent tube 21 comprising a field emission electrode including the electron emission film 30.

As shown in FIG. 18, the field emission florescent tube 21 comprising the field emission electrode including the electron emission film 30 comprises a cathode electrode which is a field emission electrode including the electron emission film 30 that covers the carbon-nanowall 32 formed on the substrate 31, an anode electrode 3 as an opposite electrode formed of a fluorescent film 4 on a surface facing the electron emission film 30, and a glass tube 5 that seals the cathode electrode and the anode electrode 3 in a vacuum atmosphere. A wire 7 made of nickel is connected to the electron emission film 30 or to the substrate 31, and a wire 6 made of nickel is connected to the anode electrode 3.

The field emission fluorescent tube 21 is a fluorescent tube called VFD (Vacuum Fluorescent Display) that causes light emission by causing cold electrodes to collide against the fluorescent film 4 by applying a predetermined voltage between the anode electrode 3 and the cathode electrode. It is also possible to use the field emission fluorescent tube 21 in an FED (Field Emission Display) having a flat panel structure which includes a plurality of such light emission regions as pixels.

Since such an electron emission film 30 has the nanodiamond aggregates in its emitter surface, it can produce a high current density at a low field intensity and can have a high durability because it has no hysteresis in its electron emission characteristic.

The present invention is not limited to the above-described embodiments 1 and 2, but can be modified in various manners.

For example, the substrate may be made of at least one of rare earth, copper, silver, gold, platinum, and aluminum, other than silicon monocrystal wafer and nickel.

The mixture ratio of the hydrogen gas and the carbon-containing compound as the material gas may be arbitrarily selectively changed.

Figure 19:
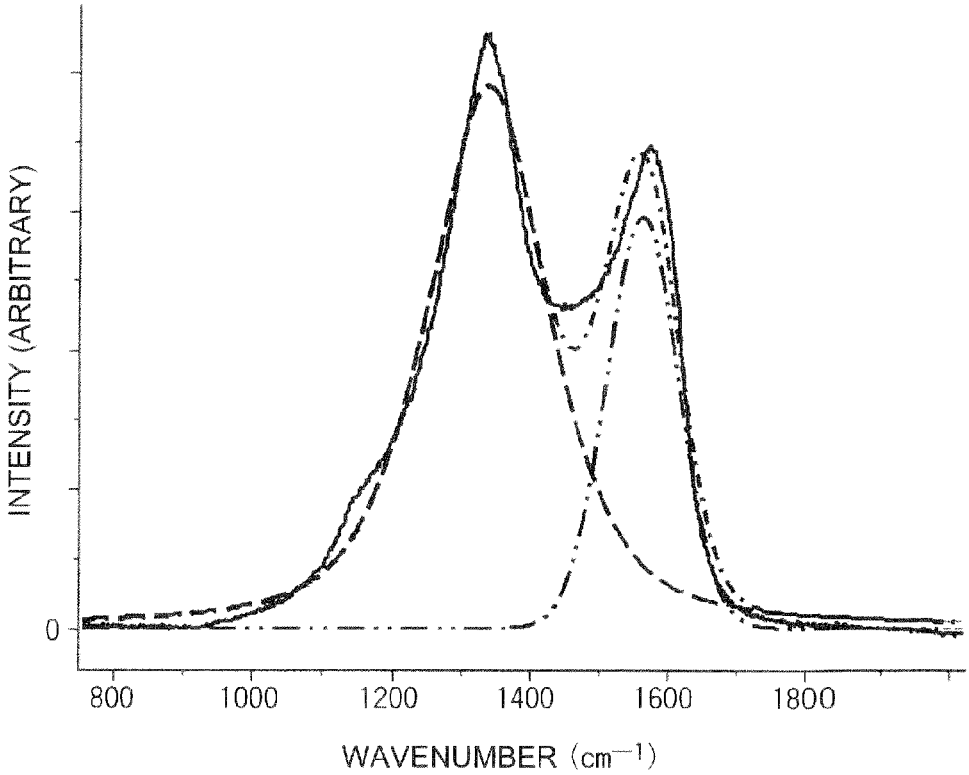
FIG. 19 is a diagram showing a Raman spectrum of a carbon film including aggregates of a plurality of diamond fine grains, which is to be the electron emission film according to the embodiment 1 and embodiment 2.

In FIG. 19, the solid line indicates the Raman spectrum obtained from the carbon film including the plurality of diamond fine grain aggregates that serves as the electron emission film 1 of the embodiment 1, and obtained from the carbon film including the plurality of diamond fine grain aggregates that serves as the electron emission film 30 of the embodiment 2. According to the embodiment 2, though the carbon-nanowall 32 is provided under the electron emission film 30, the same behavior as that indicated by the Raman spectrum of the embodiment 1 is shown, as long as the electron emission film 30 is formed to an extent sufficient to entirely cover the carbon-nanowall 32.

Now, the portion ranging from 750 $cm^{-1}$ to 2000 $cm^{-1}$ is extracted from the Raman spectrum, and with the line that connects both ends of the extracted portion seen as a baseline, the values existing on the baseline are eliminated from the spectrum. Then, by the nonlinear least-squares method, the spectrum is fit to a pseudo-Voigt function indicated by the following equation (1) where the initial values of the position are 1333 $cm^{-1}$ and 1580 $cm^{-1}$.

$$F(x)=a*\{g*\exp(-(\sqrt{2}*(x-p)/w^2))+(1-g)*1/(1+(x-p)/w^2)\} \quad \text{[Equation 1]}$$

where a=amplitude, g=Gauss/Lorenz ratio, p=position, and w=line width.

According to the nonlinear least-squares method, not only the peak intensity but also the peak position and the line width are allowed some tolerance, in fitting the spectrum to the pseudo-Voigt function. Hence, as long as the initial values to be set first are appropriate ones, an optimum parameter that would restrict the error (×2) between the actually-observed spectrum and the set function to the minimum can be obtained. Therefore, it is unnecessary to minutely and precisely set the peak wavelength. If spectrum fitting by the least-squares method under the following initial condition is available, a parameter that can have the optimum area ratio will be obtained.

The applied initial value conditions are, a: the local maximum value of the actually-observed peak existing between 1250 $cm^{-1}$ and 1400 $cm^{-1}$, g: 0.6, p: 1333 $cm^{-1}$, and w: 200 $cm^{-1}$ for the portion of the electron emission film where $sp^3$ bonds are formed, whereas a: the local maximum value of the actually-observed peak existing between 1530 $cm^{-1}$ and 1630 $cm^{-1}$, g: 1, p: 1580 $cm^{-1}$, and w: 100 $cm^{-1}$ for the portion of the electron emission film where $sp^2$ bonds are formed. Though the nonlinear least-squares method is not algorithm-dependent, the Marquardt method is more preferable.

In this manner, the area ratio between the D band whose peak is at near 1333 $cm^{-1}$ and the G band whose peak is at near 1580 $cm^{-1}$, i.e., a ratio (D-band intensity)/(G-band intensity) is obtained. In FIG. 19, the dashed line indicates the combined component of the D-band intensity and G-band intensity, the broken line indicates the D-band intensity component extracted from the combined component, and the double-dashed line indicates the G-band intensity component extracted. The ratio (D-band intensity)/(G-band intensity) can be paraphrased as a ratio (the number of $sp^3$ bonds in the film)/(the number of $sp^2$ bonds in the film), i.e., a ratio (carbon having $sp^3$ bonds)/(carbon having $sp^2$ bonds).

Figure 20:
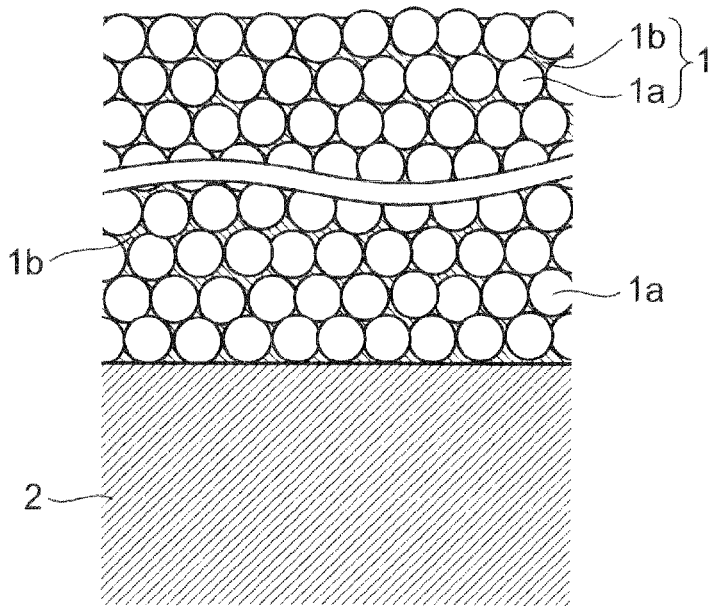
FIG. 20 is a schematic cross section showing a structure model of the electron emission film shown in FIG. 3.
Figure 21:
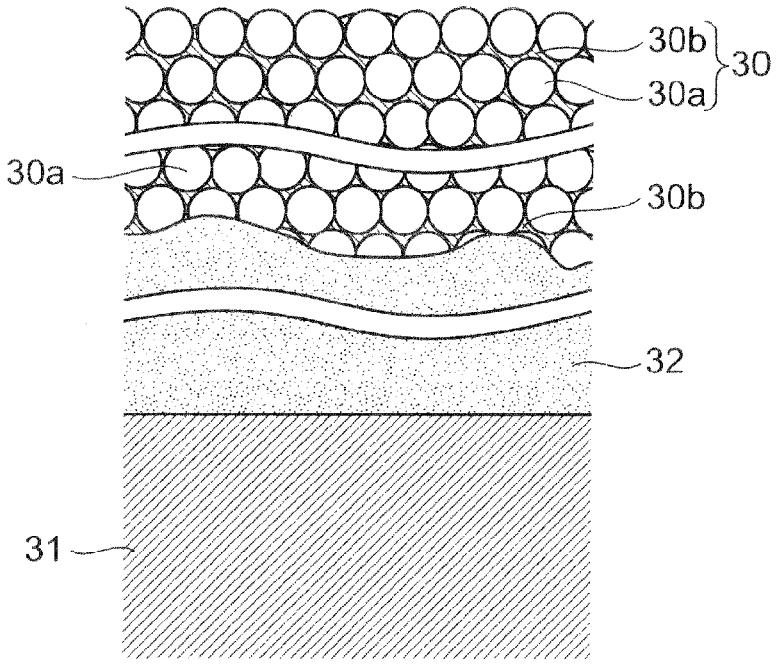
FIG. 21 is a schematic cross section showing a structure model of the electron emission film shown in FIG. 11.
Figure 22:
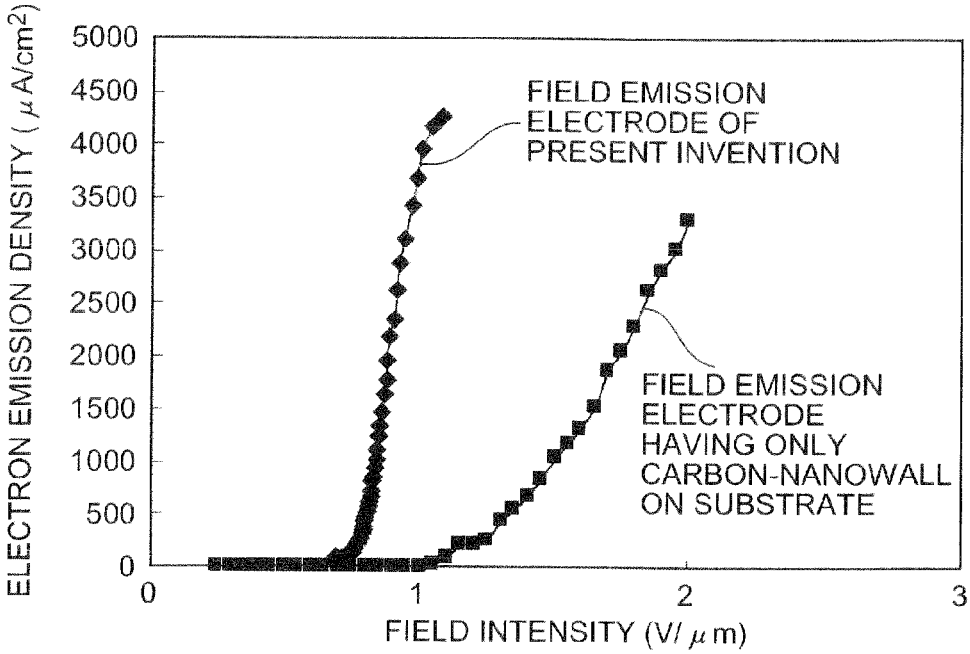
FIG. 22 is a diagram showing the field emission characteristic of the electron emission film according to the present invention and of a carbon-nanowall according to a comparative example.

Accordingly, although the electron emission film 1 of the embodiment 1 and the electron emission film 30 of the embodiment 2 are seemingly a single-layer film as a whole, they have, when microscopically seen, a complex structure including the aggregates of diamond fine grains formed of carbon of $sp^3$ bonds indicated as D band and having a grain diameter of about 5 nm to 10 nm, and carbon of $sp^2$ bonds indicated as G band and existing between the diamond fine grains. For example, FIG. 20 illustrates the electron emission film 1 shown in FIG. 3 more understandably, where the carbon 1*b* of $sp^2$ bonds indicated as G band exists in the clearances in the aggregates of diamond fine grains 1*a*, 1*a*, . . . . Likewise, FIG. 21 illustrates the electron emission film 30 shown in FIG. 11 more understandably, where the carbon 30*b* of $sp^2$ bonds indicated as G band exists in the clearances in the aggregates of diamond fine grains 30*a*, 30*a*, . . . . Assuming that the thickness of the electron emission film is 3 μm, several hundreds of diamond fine grains are continuously stacked in the thickness-wise direction. These diamond fine grains are insulative, but the carbon of $sp^2$ bonds in the clearances has conductivity, and therefore the film as a whole has conductivity. It was confirmed that the field emission electrode including the electron emission film 1 or the electron emission film 30 causes field emission at a lower voltage and has a more excellent electron emission characteristic than a field emission electrode of a comparative example in which a carbon-nanowall having the same structure as the carbon-nanowall 32 is formed on the substrate, as shown in FIG. 22.

Since each diamond fine grain in such an electron emission film has a negative electron affinity and has a very small grain diameter of 10 nm or less, electrons can be emitted by the tunnel effect. Furthermore, not only the carbon of $sp^2$ bonds that exists in the clearances between the diamond fine grains at a predetermined abundance ratio imparts conductivity to the film as a whole to thereby facilitate field emission, but also it is so arranged that the diamond fine grains be not stacked so continuously that the tunnel effect cannot be obtained. That is, if about a hundred diamond fine grains having a grain diameter of 10 nm are stacked in a predetermined direction with substantially no clearances therebetween, the thickness of the diamond will seemingly be 1000 nm, which will substantially inhibit the occurrence of the tunnel effect even if a strong field is applied. However, since the presence of the carbon of $sp^2$ bonds having conductivity separates the respective diamond fine grains, each diamond fine grain can exhibit the tunnel effect. This tunnel effect allows an electron emitted from the substrate upon a voltage application to be once injected into the nearest diamond fine grain, field-emitted from this diamond fine grain, and again injected into a diamond fine grain adjacent to that diamond fine grain in the field direction, subsequently repeatedly causing such electron emission in the field direction of the electron emission film and finally causing the electron to be emitted from the outermost surface of the electron emission film.

Figure 23A:
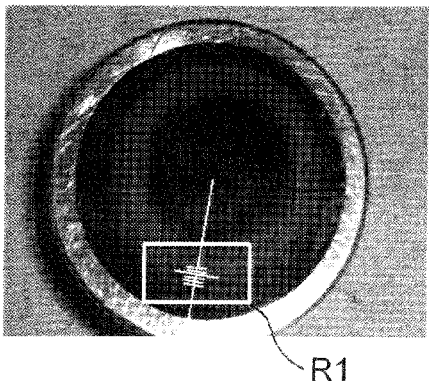
FIGS. 23A and 23B show images of the electron emission film.
Figure 23B:
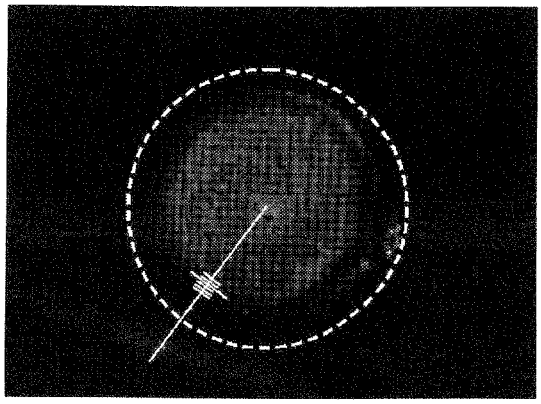

FIG. 23A is an image of the formed electron emission film, and FIG. 23B is an image showing light excited by a fluorescent body due to field emission by this electron emission film in a case where the fluorescent body and a transparent conductor are disposed above the electron emission film.

FIG. 24A is an expanded image of a region RI of FIG. 23A.

FIG. 24B is an SEM image of a position that is indicated by the arrow of FIG. 24A, and located more inside the positions indicated in the later-described FIG. 24C, FIG. 24D, and FIG. 24E in the electron emission film, and that is a position of the film where diamond fine grains are densely aggregated upon the substrate and where the most favorable electron emission characteristic is exhibited. At this position, the ratio (carbon having $sp^3$ bonds)/(carbon having $sp^2$ bonds) is 2.55, and the grain diameter of the diamond fine grains is 5 nm to 10 nm.

FIG. 24C is an SEM image of a position that is indicated by the arrow of FIG. 24A, and located more outside the positions indicated in FIG. 24A and in the later-described FIG. 24D and FIG. 24E in the electron emission film, and that is a position where substantially only the carbon-nanowall is formed upon the substrate. At this position, the electron emission characteristic is the worst, which is almost the same as that of the comparative example shown in FIG. 22. At this position, the ratio (carbon having $sp^3$ bonds)/(carbon having $sp^2$ bonds) is 0.1.

FIG. 24D is an SEM image of a position that is indicated by the arrow of FIG. 24A, and located more outside the position shown in FIG. 24B and more inside the position shown in FIG. 24C, and that is a position where multiple diamond fine grains stacked over the petal-shaped graphene sheets of carbon-nanowall formed upon the substrate are aggregated in a spherical shape. One sphere is formed of multiple diamond fine grains. This sphere is obtained when diamond fine grains are grown over the end portion of the grown petal-shaped graphene sheets. The electron emission characteristic at this position is better than that of the carbon-nanowall of FIG. 24C, but is worse than the film position of FIG. 24B where the diamond fine grains are densely aggregated. At this position, the ratio (carbon having $sp^3$ bonds)/(carbon having $sp^2$ bonds) is 0.5, and the grain diameter of the diamond fine grains is 5 nm to 10 nm.

FIG. 24E is an SEM image of a position that is indicated by the arrow of FIG. 24A, and located more outside the position shown in FIG. 24B and more inside the position shown in FIG. 24D, and that is a position where the diamond fine grains are more further grown into crystalline phase than at the position shown in FIG. 24D and the spheres are bonded together to make the surface of the film relatively smooth, however with some clearances sparsely left between the spheres. The electron emission characteristic at this position is better than that of the carbon-nanowall of FIG. 24D and is slightly worse than that of the film position of FIG. 24B where the diamond fine grains are densely aggregated, but is sufficient as the electron emission film. At this position, the ratio (carbon having $sp^3$ bonds)/(carbon having $sp^2$ bonds) is 2.50, and the grain diameter of the diamond fine grains is 5 nm to 10 nm.

FIG. 25 shows the ratios (carbon having $sp^3$ bonds)/(carbon having $sp^2$ bonds) at the respective positions of the electron emission film, where the position P(0) shown in FIG. 24A is set as a relative position "0", and positions P(1) and p(2) are reached by moving from the position P(0) towards the position shown in FIG. 24B by 1 mm and 2 mm respectively, and positions P(−1), P(−2), and P(−3) are reached by moving from the position P(0) towards the position shown in FIG. 24D by 1 mm, 2 mm, and 3 mm respectively.

Sufficient light emission was achieved at a low voltage where the ratio (carbon having $sp^3$ bonds)/(carbon having $sp^2$ bonds) was around 2.5, whereas a relatively high voltage was required to achieve light emission at the ratio (carbon having $sp^3$ bonds)/(carbon having $sp^2$ bonds) of 0.5. The positions showing a particularly excellent electron emission characteristic had the ratio (carbon having $sp^3$ bonds)/(carbon having $sp^2$ bonds) of 2.50 or more.

Figure 26:
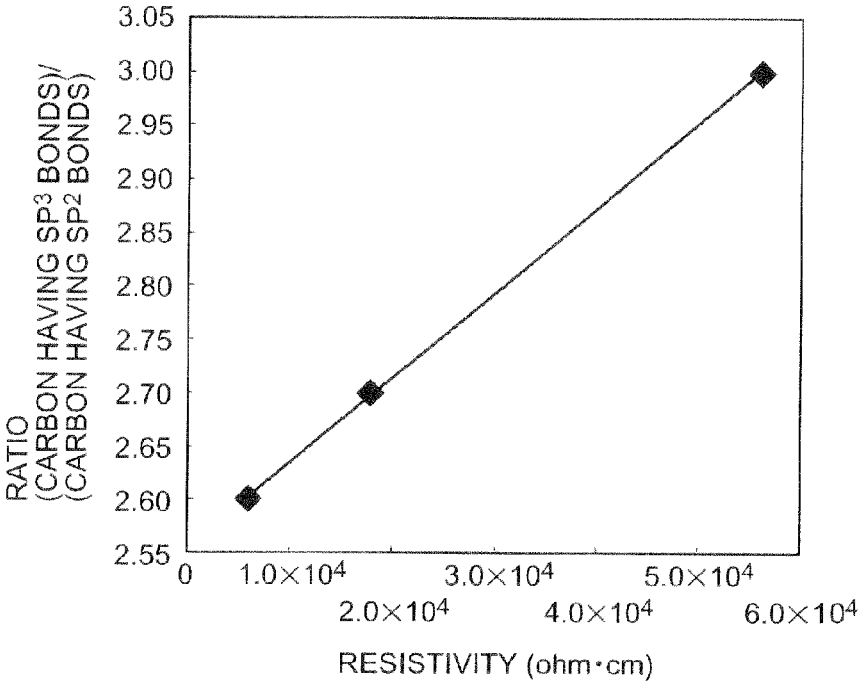
FIG. 26 is a graph showing the relationship between the ratio (carbon having $sp^3$ bonds)/(carbon having $sp^2$ bonds) and resistivity.

FIG. 26 is a graph showing the resistivity of films which were so formed as to have a ratio (carbon having $sp^3$ bonds)/(carbon having $sp^2$ bonds) that is shifted to a higher level.

An electron emission film having the ratio (carbon having $sp^3$ bonds)/(carbon having $sp^2$ bonds) of 2.6 has the resistivity of $0.6\times10^4$(Ω·cm), and its electron emission characteristic is better than that of an electron emission film having the ratio (carbon having $sp^3$ bonds)/(carbon having $sp^2$ bonds) of 2.50 to 2.55.

An electron emission film having the ratio (carbon having $sp^3$ bonds)/(carbon having $sp^2$ bonds) of 2.7 has the resistivity of $1.8\times10^4$(Ω·cm), and its electron emission characteristic is worse than that of the electron emission film having the ratio (carbon having $sp^3$ bonds)/(carbon having $sp^2$ bonds) of 2.6 but is equivalent to a film having the ratio (carbon having $sp^3$ bonds)/(carbon having $sp^2$ bonds) of 2.55, which is sufficient as the electron emission film of a field emission electrode.

An electron emission film having the ratio (carbon having $sp^3$ bonds)/(carbon having $sp^2$ bonds) of 3.0 has the resistivity of $5.6\times10^4$(Ω·cm), and its electron emission characteristic is worse than that of an electron emission film having the ratio (carbon having $sp^3$ bonds)/(carbon having $sp^2$ bonds) of 2.50. This is due to that the conductivity is lowered as the abundance ratio of the carbon having $sp^2$ bonds is lowered, in addition to that the less presence of the carbon having $sp^2$ bonds in the clearances between the diamond fine grains makes the thickness of the diamond seemingly larger and reduces the ratio of positions from where tunnel electrons can be efficiently emitted.

FIG. 27 are images showing the states of light emission by a fluorescent body formed on an anode electrode, in a case where the anode electrode is disposed at a position apart by 4.5 mm from a cathode electrode including the electron emission film of the present invention, and a pulse voltage of 6 kV (1 kHz, duty ratio of 1%) is applied between the anode electrode and the cathode electrode.

Figure 27A:
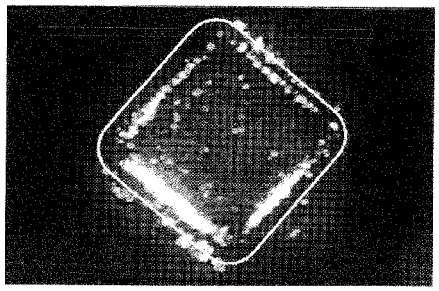
FIGS. 27A to 27D are images showing states of light emission by electron emission films having different resistivities.
Figure 27B:
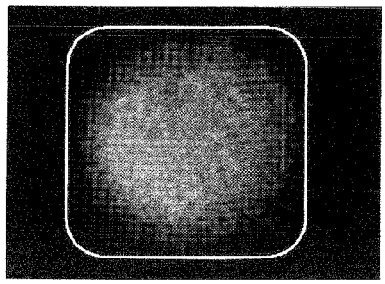
Figure 27C:
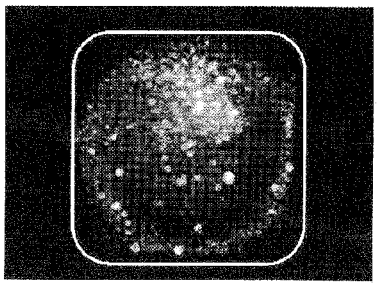
Figure 27D:
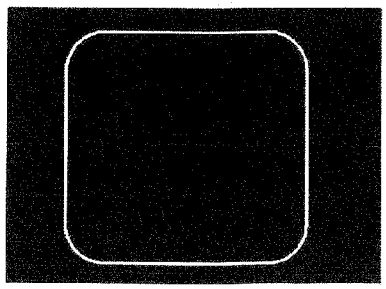

FIG. 27A shows the state of light emission in a case where the resistivity of the electron emission film is 1 kΩ·cm. FIG. 27B shows the state of light emission in a case where the resistivity of the electron emission film is 6 kΩ·m. FIG. 27C shows the state of light emission in a case where the resistivity of the electron emission film is 18 kΩ·cm. FIG. 27D shows the state of light emission in a case where the resistivity of the electron emission film is 56 kΩ·cm. It was confirmed that the electron emission film of FIG. 27D causes light emission by applying a stronger field. The ratio (carbon having $sp^3$ bonds)/(carbon having $sp^2$ bonds) of the electron emission film of FIG. 27A is 2.5.

After such electron emission films were repeatedly manufactured, it was found that an electron emission film from which a favorable electron emission characteristic was obtained had the ratio (carbon having $sp^3$ bonds)/(carbon having $sp^2$ bonds) of 2.5 to 2.7. Particularly, an electron emission film from which a more favorable electron emission characteristic which would allow the threshold field intensity to be 1.5V/μm or lower was obtained had the ratio (carbon having $sp^3$ bonds)/(carbon having $sp^2$ bonds) of 2.55 to 2.65. Furthermore, an electron emission film which was the most stable and had a favorable electron emission characteristic had the ratio (carbon having $sp^3$ bonds)/(carbon having $sp^2$ bonds) of 2.60 to 2.62.

Further, an electron emission film having the resistivity of 1 kΩ·cm to 18 kΩ·cm had a favorable electron emission characteristic.

Figure 28:
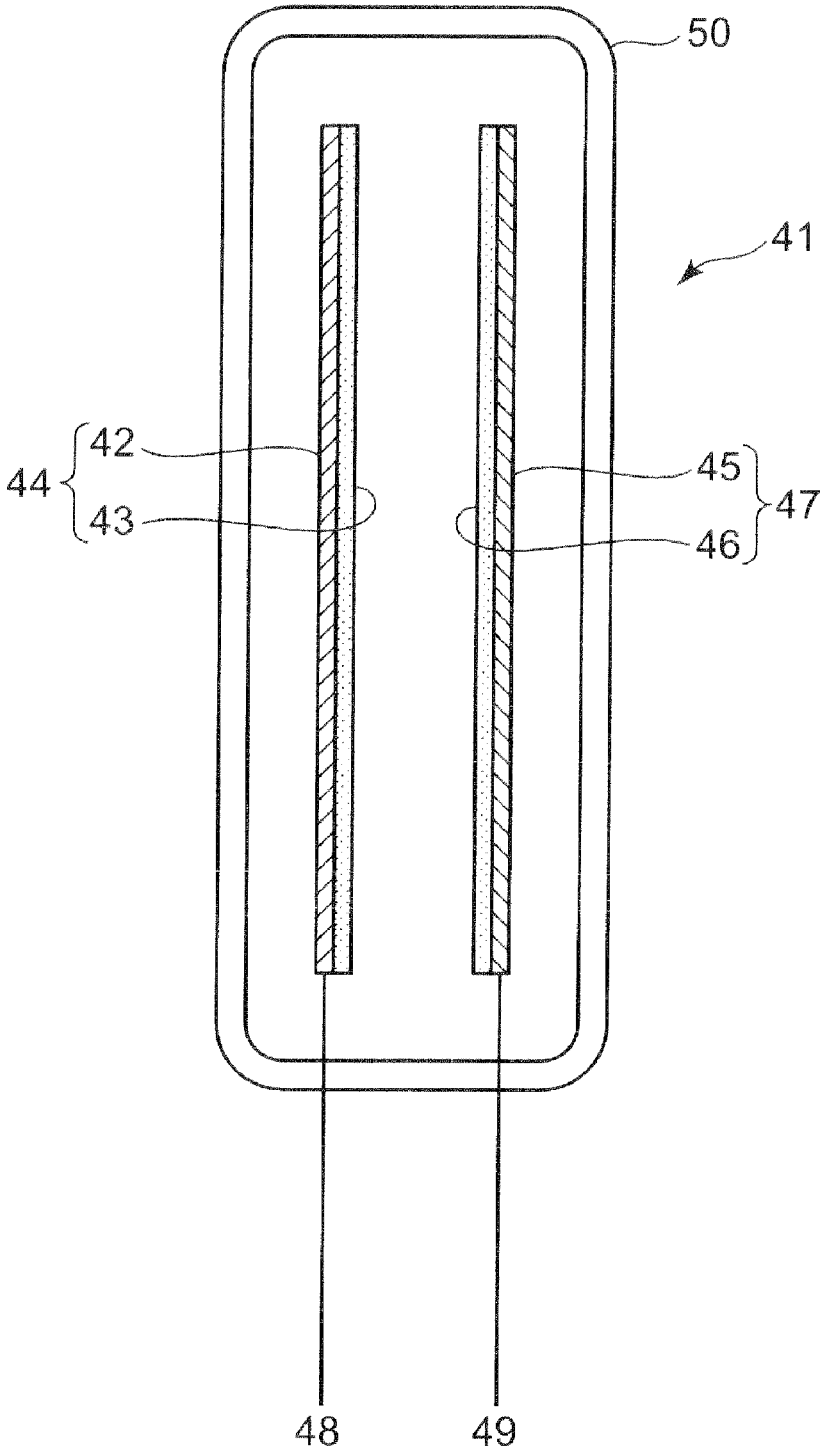
FIG. 28 is a schematic cross section of a fluorescent tube employing a field emission electrode including the field emission film according to the present invention.

FIG. 28 is a diagram showing a fluorescent tube comprising the above-described electron emission film including diamond fine grains, in which an electron emission film 43 is formed on a substrate 42 comprising a semiconductor or a conductor. A carbon-nanowall may intervene between the electron emission film 43 and the substrate 42, as described in the embodiment 2. A cathode electrode 44 comprising the substrate 42 and the electron emission film 43 faces an anode electrode 47 which is apart from the cathode electrode 44 by a predetermined distance. The anode electrode 47 is disposed on a surface where an opposite conductor 45 and the electron emission film 43 face each other. The anode electrode 47 comprises a fluorescent film 46 which is formed to contact the opposite conductor 45. The opposite conductor 45 is preferably made of a material such as, for example ITO, that has a high transmissivity to the light emitted by the fluorescent film 46.

The cathode electrode 44 and the anode electrode 47 are sealed inside a glass tube 50 having an interior vacuum atmosphere. A wire 48 connected to the substrate 42 and a wire 49 connected to the opposite conductor 45 are led out from the glass tube 50. This kind of fluorescent tube 41 can emit light at a low threshold voltage.

A light source that comprises the electron emission film of the present invention can be applied to an FED (Field Emission Display), a backlight for a liquid crystal panel, and other light sources for home-use, or can be applied to a backlight for a personal computer, a digital camera, a cellular phone, etc., and a vehicle-mountable light source.

Embodiment 3

Figure 29:
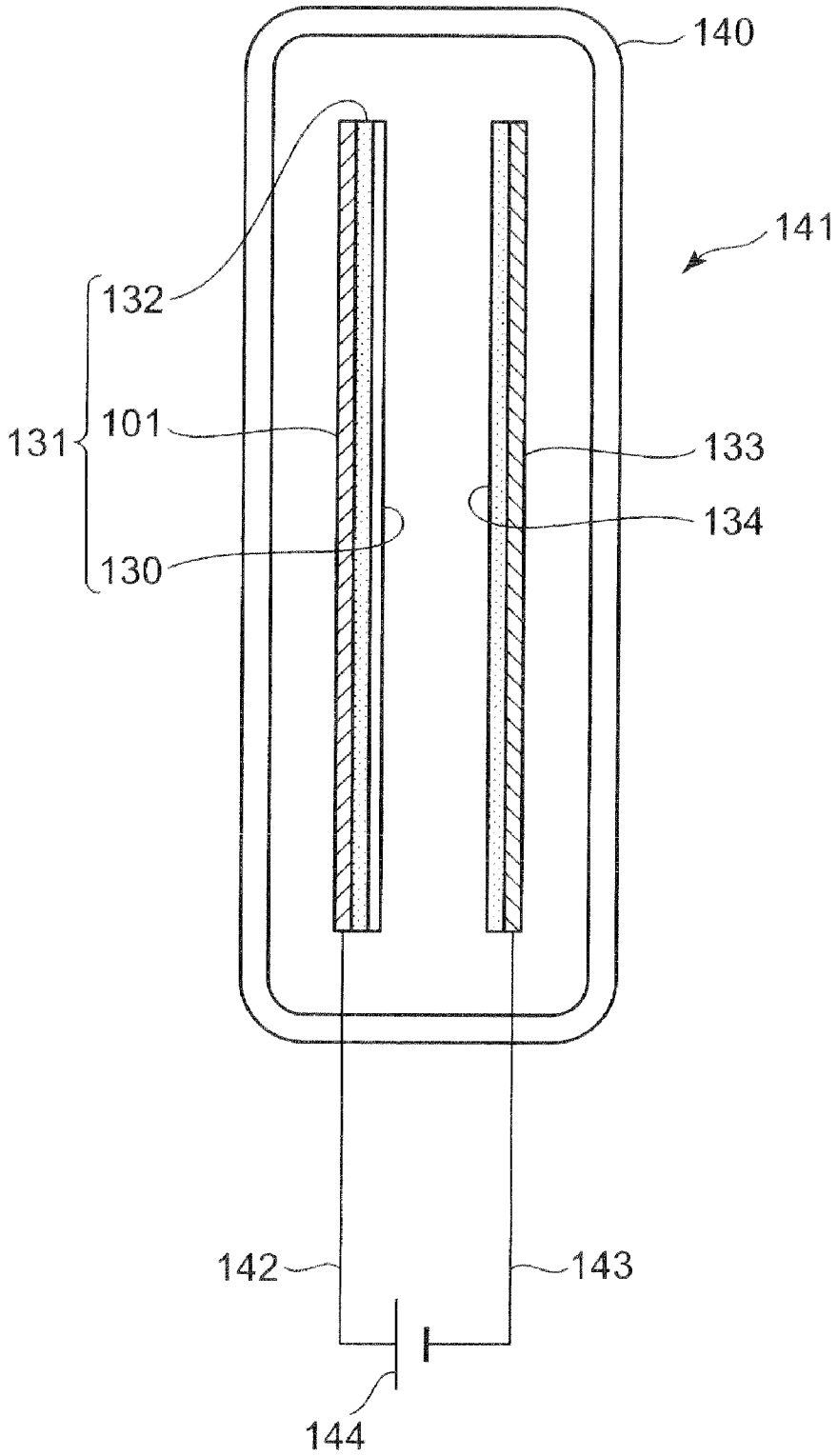
FIG. 29 is a diagram showing a fluorescent tube comprising a field emission electrode according to the embodiment 3.

Another embodiment of the present invention will now be specifically explained with reference to the drawings. FIG. 29 is a diagram showing a fluorescent tube 141 that comprises a field emission electrode according to the present embodiment.

A field emission electrode 131 according to the present embodiment functions as a cathode electrode, and comprises an electron emission film 130 that is formed on a carbon-nanowall 132 as a base layer formed on a substrate 101. An anode electrode 133 comprises a transparent conductive film made of a transparent conductive material selected at least from tin-doped indium oxide (ITO; Indium Tin Oxide), zinc-doped indium oxide, indium oxide ($In_2O_3$), tin oxide ($SnO_2$), zinc oxide (ZnO), and cadmium-tin oxide, or a conductive film made of an opaque conductive material such as nickel, aluminum, etc., and is disposed so as to face the field emission electrode 1

31 apart therefrom by a predetermined distance. The electron emission film 130 of the field emission electrode 131 is disposed on a surface facing the anode electrode 133, and a fluorescent film 134 which will emit light by being excited by electrons emitted from the electron emission film 130 is disposed between the anode electrode 133 and the field emission electrode 131.

The field emission electrode 131 and the anode electrode 133 are sealed inside a glass tube 140 having a vacuum atmosphere inside. A wire 142 made of nickel or the like and connected to the substrate 101 and a wire 143 made of nickel or the like and connected to the anode electrode 133 are led out from the glass tube 140. The wire 142 and wire 143 that are led out are connected to a power source 144. The power source 144 causes a predetermined potential difference between the anode electrode 133 and the field emission electrode 131. At this time, cold electrodes emitted from the electron emission film 130 of the field emission, electrode 131 due to the field are attracted toward the anode electrode 133 due to the field between the field emission electrode 131 and the anode electrode 133 to collide on the fluorescent film 134, which is thereby caused to emit visible light. Such a fluorescent tube 141 can emit light at a low threshold voltage. Further, since the electron emission characteristic of the electron emission film 130 has no hysteresis, the durability of the electron emission film 130 is high.

The above-described fluorescent tube 141 is one called a VFD (Vacuum Fluorescent Display) which causes light emission by causing cold electrons collide against the fluorescent film 134 by applying a predetermined voltage between the anode electrode 133 and the field emission electrode 131, and can also be used in an FED (Field Emission Display) that has a flat panel structure including a plurality of such light emission regions as pixels.

Figure 30:
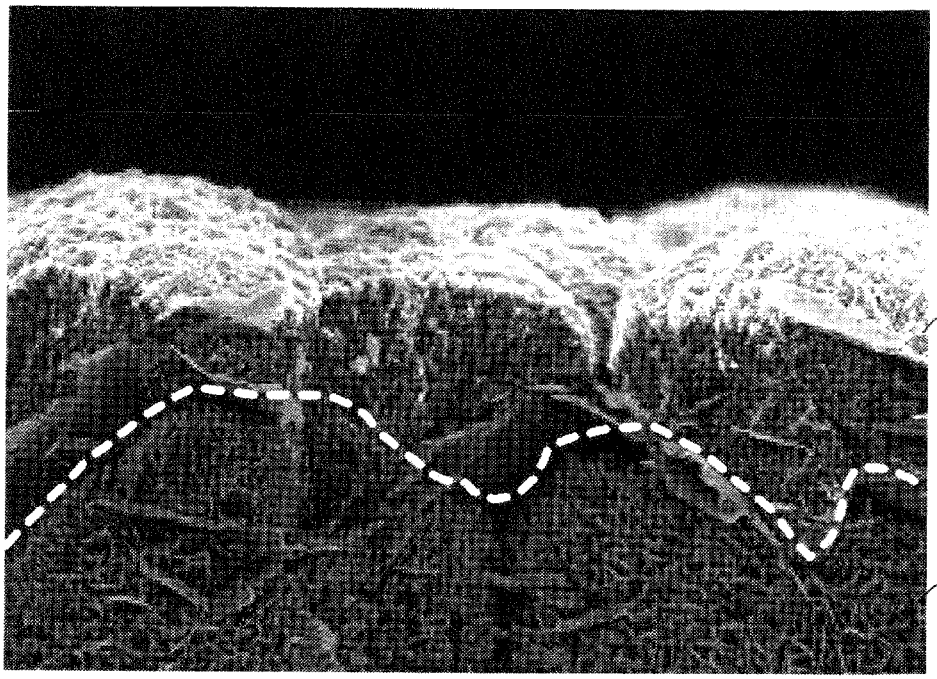
FIG. 30 is an image showing a cross section of the field emission electrode.

FIG. 30 is an image showing a cross section of the field emission electrode 131 of FIG. 29 obtained by a scanning electron microscope. The field emission electrode 131 according to the present embodiment comprises the carbon-nanowall 132 formed on the substrate 101, and the electron emission film 130 on the carbon-nanowall 132 including a plurality of diamond fine grains.

The carbon-nanowall 132 is formed of a plurality of carbon thin flakes of a petal (fan) shape having a curved surface which are uprightly bonded to the others in random directions. The carbon-nanowall 132 has a thickness of 0.1 nm to 10 μm. Each carbon thin flake is formed of several to several tens of graphene sheets having a lattice interval of 0.34 nm.

Figure 31:
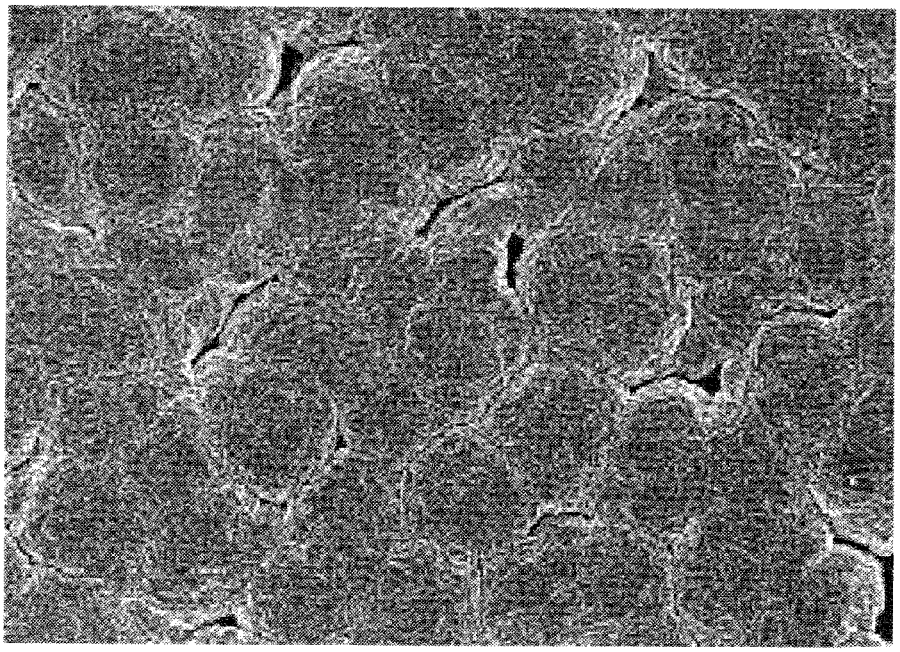
FIG. 31 is an image of the surface of an electron emission film.
Figure 32:
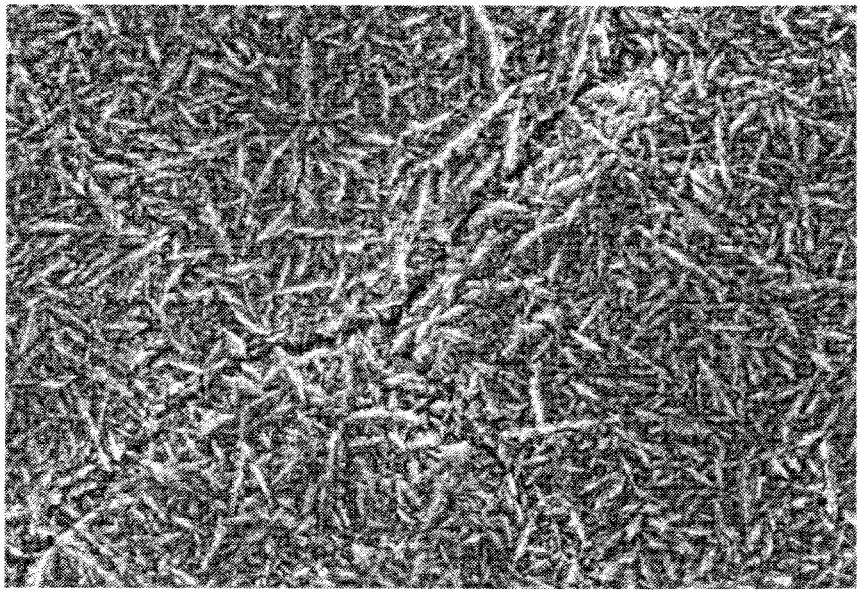
FIG. 32 is an image obtained by expanding the surface of the electron emission film of FIG. 31.

FIG. 31 is an image obtained by scanning the surface of the electron emission film 130 of FIG. 29 by using a scanning electron microscope. FIG. 32 is an image obtained by further expanding the image of the electron emission film 130 of FIG. 31. The electron emission film 130 includes a plurality of diamond fine grains having a grain diameter of 5 nm to 10 nm, and carbon including carbon having a graphite structure and deposited on the outermost surface and between the diamond fine grains. When seen from the top, tissues having a bamboo leaf shape made of several tens to several hundreds of aggregated diamond find grains are formed in the electron emission film 130, as shown in FIG. 32. That is, a plurality of bamboo-leaf-shaped tissues in the surface being aggregated, colonies having a generally circular dome shape when seen from the above are formed as shown in FIG. 31. The colonies, when being grown, contact the adjacent colonies to fill the clearances therebetween, and thereby form the electron emission film 130 whose surface is relatively smooth. The electron emission film 130 covers the carbon-nanowall 132. The diameter of the colonies in the electron emission film 130 is about 1 μm to 5 μm, and it is preferable that the colonies be grown to an extent enough to completely cover the carbon-nanowall 132 with no clearances left therein.

Although it is clear that the electron emission film 130 has the diamond structure not the diamond-like carbon (DLC) structure because diamond peaks were found in it by XRD measurement, it shows a very small resistivity of 20 kΩ·cm or lower, as compared to the resistivity of smaller than $10^{16}$Ω·cm inherent in diamond. The resistivity of an electron emission film 130 having a favorable electron emission characteristic was 1 kΩ·cm to 18 kΩ·cm.

Figure 33:
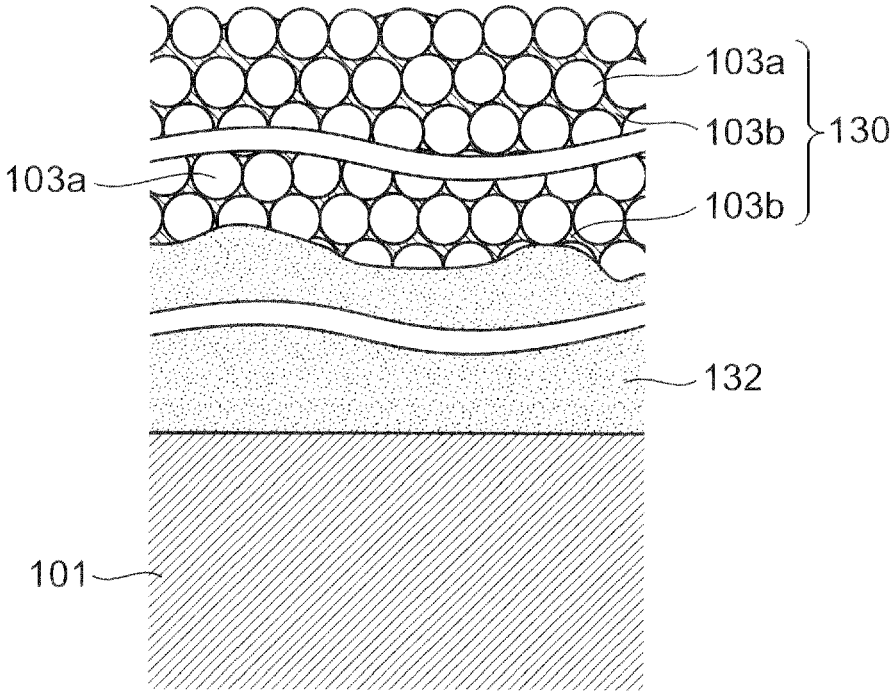
FIG. 33 is a model diagram showing an expanded cross section of the electron emission film including a bamboo-leaf-like shape shown in FIG. 32.

FIG. 33 is a model diagram showing a further-expanded cross section of the electron emission film 130 shown in FIG. 32 including bamboo-leaf-shaped tissues. The reference numeral 103*a* in FIG. 33 indicates diamond fine grains having a grain diameter of 5 nm to 10 nm, which are stacked in the thickness-wise direction. Carbon 103*b* having the graphite structure and formed of $sp^2$ bonds indicated as G band exists in the clearances in the aggregates of diamond fine grains 103*a*, 103*a*, . . . . Assuming that the thickness of the electron emission film 130 is 3 μm, several hundreds of diamond fine grains are continuously stacked in the thickness-wise direction. These diamond fine grains are insulative, but the carbon 103*b* including carbon of $sp^2$ bonds existing in the clearances has conductivity due to its graphite structure, and therefore the film 130 as a whole has conductivity.

Figure 34:
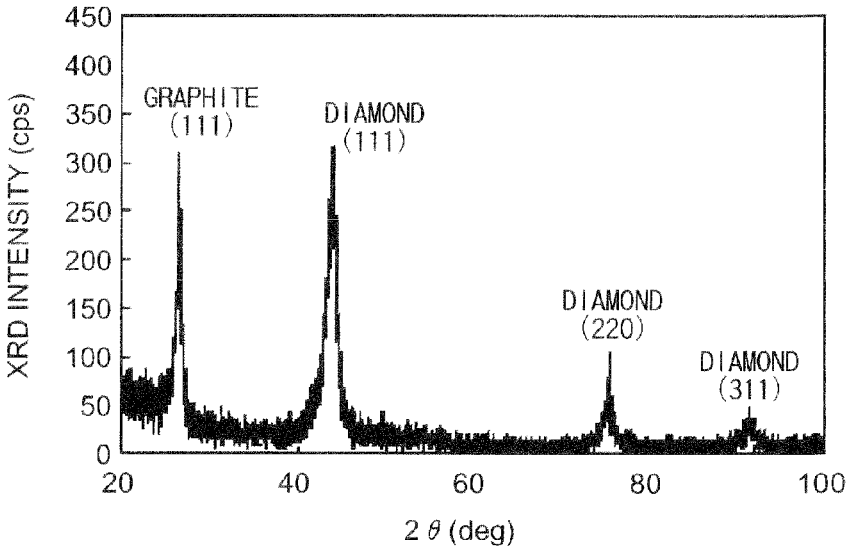
FIG. 34 is a diagram showing an X-ray diffraction spectrum of the electron emission film.

FIG. 34 is a diagram showing the spectrum of the electron emission film 130 obtained by XRD (X-Ray Diffraction spectroscopy).

Checking the X-ray diffraction pattern of the electron emission film 130, conspicuous peaks of diamond crystals and also a peak of crystalline carbon having the graphite structure are observed. The carbon having this crystalline graphite structure is the carbon-nanowall 132 as the base layer for the electron emission film 130.

Figure 35:
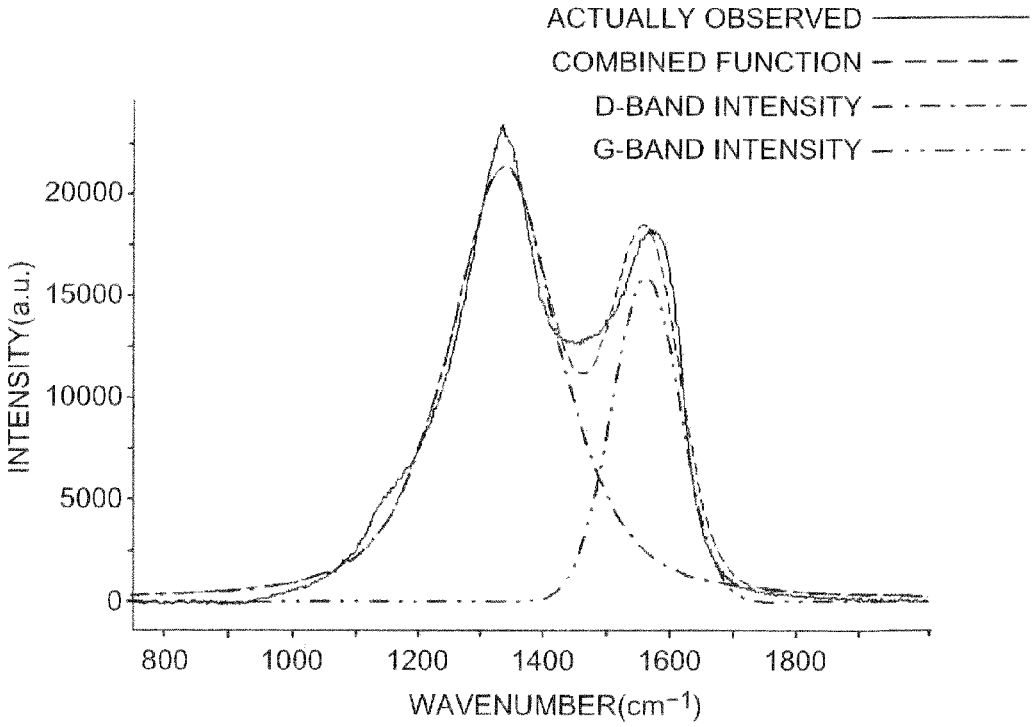
FIG. 35 is a diagram showing a Raman spectroscopy spectrum of the electron emission film.

FIG. 35 shows Raman spectrums obtained by performing Raman spectroscopy on the electron emission film 130 by using laser light having a wavelength of 532 nm, and then by performing fitting of the spectrum to two pseudo Voigt functions. In FIG. 35, the solid line indicates actually-observed Raman spectrum values of the electron emission film 130, the broken line indicates values obtained by fitting the actually-observed values of the electron emission film 130, the dashed line indicates the D-band intensity after being fitted, and the double-dashed line indicates the G-band intensity after being fitted.

As a specific fitting method for obtaining the above-described spectrum curves, the portion of the actually-observed Raman spectrum that is between 750 $cm^{-1}$ to 2000 $cm^{-1}$ is extracted, and with the line that connects both ends (750 $cm^{-1}$ and 2000 $cm^{-1}$) of the extracted portion seen as a baseline, values existing on the baseline are eliminated from the spectrum. Then, as initial values, 1333 $cm^{-1}$ and 1550 $cm^{-1}$ are set as peak positions, heights are set to the actually-observed intensities of the Raman spectrum respectively at the wavenumber of 1333 $cm^{-1}$ and the wavenumber of 1550 $cm^{-1}$, and the line widths are respectively set to 200 $cm^{-1}$ and 150 $cm^{-1}$.

Then, by a nonlinear least-squares method, the spectrum is fit to pseudo-Voigt functions indicated by the following equation (1).

$$F(x)=a*[g*\exp(-(\sqrt{2}*(x-p)/w^2))+(1-g)*1/(x-p)/w^2)] \quad \text{[Equation 1]}$$

where a=amplitude, g=Gauss/Lorenz ratio, p=peak position, and w=line width.

According to the nonlinear least-squares method, not only the peak intensity but also the peak position and the line width are allowed some tolerance, in fitting the spectrum to the pseudo-Voigt functions. Hence, as long as the initial values to be set first are appropriate ones, an optimum parameter that would restrict the error (×2) between the actually-observed spectrum and the set functions to the minimum can be obtained. Therefore, it is unnecessary to minutely and precisely set the peak wavelength. If spectrum fitting by the least-squares method under the following initial condition is available, a parameter that can have the optimum area ratio will be obtained. Though the nonlinear least-squares method is not algorithm-dependent, the Marquardt method is more preferable.

In this manner, the ratio of the area of the D band whose peak is at near 1333 $cm^{-1}$ to the area of the G band whose peak is at near 1550 $cm^{-1}$ is obtained in the form of a ratio (D-band intensity)/(G-band intensity). In FIG. 35, the broken line indicates the combined component of the D-band intensity and G-band intensity, the dashed line indicates the D-band intensity component extracted from the combined component, and the double-dashed line indicates the G-band intensity component extracted. The ratio (D-band intensity)/(G-band intensity) can be paraphrased as a ratio (the number of $sp^3$ bonds in the film)/(the number of $sp^2$ bonds in the film), i.e., a ratio (carbon having $sp^3$ bonds)/(carbon having $sp^2$ bonds).

Accordingly, although the electron emission film 30 is seemingly a single-layer film as a whole, it has, when microscopically seen, a complex structure including the aggregates of diamond fine grains 103*a*, 103*a*, . . . formed of carbon of $sp^3$ bonds indicated as D band and having a grain diameter of about 5 nm to 10 nm, and the carbon 103*b* formed of $sp^2$ bonds showing the G-band intensity and existing between the diamond fine grains 103*a*, 103*a*, . . . . It is preferable that the ratio (D-band intensity)/(G-band intensity) is 2.5 to 2.7.

Assuming that the thickness of the electron emission film 130 is 3 μm, several hundreds of diamond fine grains 103*a* are continuously stacked in the thickness-wise direction. These diamond fine grains 103*a* are themselves insulative, but the carbon 103*b* formed of $sp^2$ bonds existing in the clearances has conductivity, and therefore the electron emission film 130 as a whole has conductivity.

As described so far, the electron emission film 130 has been confirmed to include crystalline diamond in its composition from the X-ray diffraction pattern and to include carbon having $sp^2$ bonds having a broad peak whose half-value width is 50 cm or more from the Raman spectroscopy spectrum, and to therefore have a complex structure including these. And since the electron emission film 130 shows conductivity, it can be confirmed that the carbon having $sp^2$ bonds other than the insulative crystalline diamond includes carbon having the conductive graphite structure. And it can be confirmed by using a scanning electron microscope that this carbon is very thinly stacked in the uppermost surface of the electron emission film 130.

Figure 36:
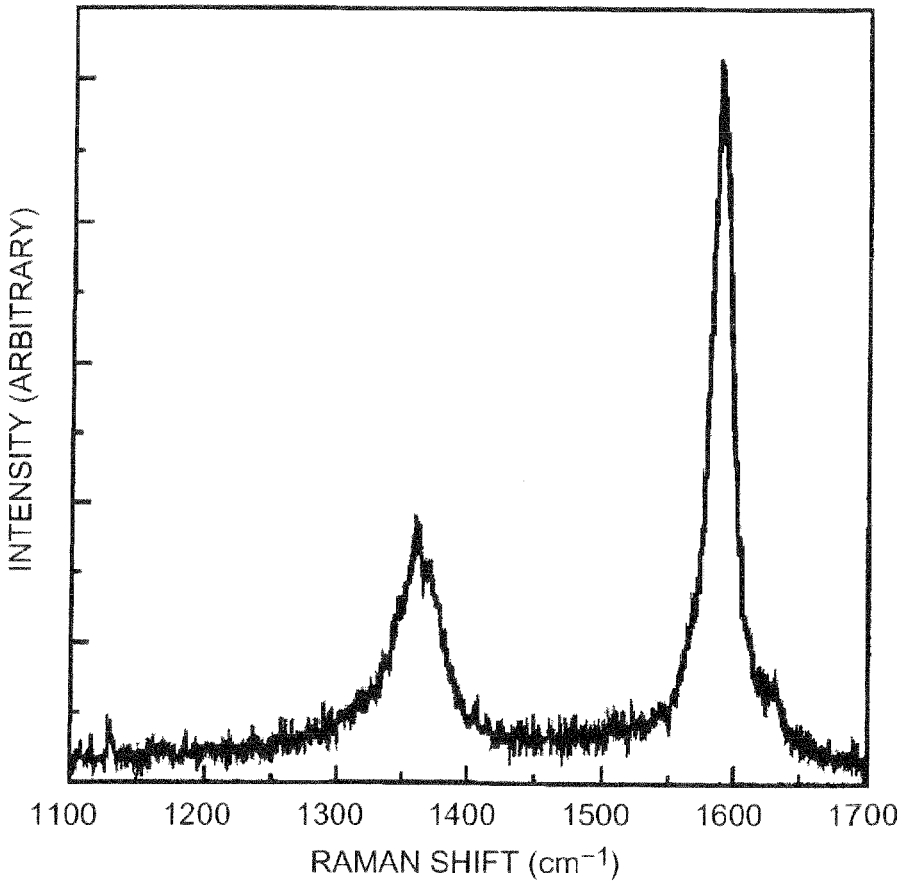
FIG. 36 is a diagram showing a Raman spectroscopy spectrum of a carbon-nanowall.

The spectrum of the carbon-nanowall 132 obtained by Raman spectroscopy is shown in FIG. 36. The carbon thin flakes of the carbon-nanowall 132 show a sharp ratio of intensity between a G-band peak at near 1580 $cm^{-1}$ having a half-value width of less than 50 $cm^{-1}$, which is due to the vibration of carbon atoms in the hexagon lattices formed by carbon-carbon bonds ($sp^2$ bonds) of the graphite structure, and a D-band peak at near 1350 $cm^{-1}$ having a half-value width of less than 50 $cm^{-1}$, and show almost no other peaks. It is therefore obvious that a carbon-nanowall 132 formed of a dense and highly-pure graphite structure has been grown.

Figure 37:
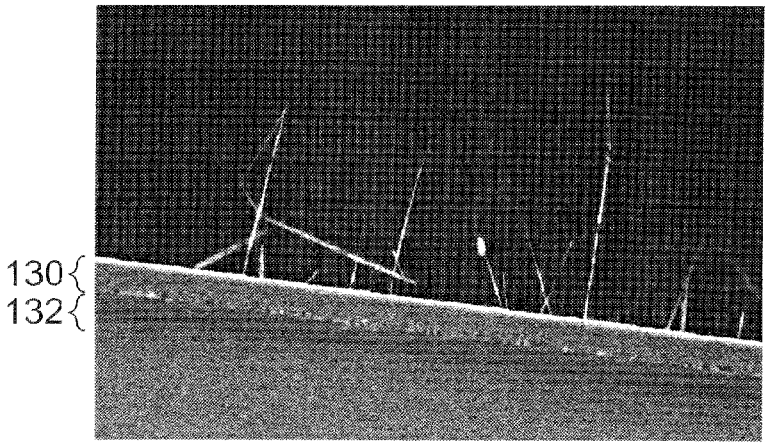
FIG. 37 is an image of a cross section of the field emission electrode.
Figure 38:
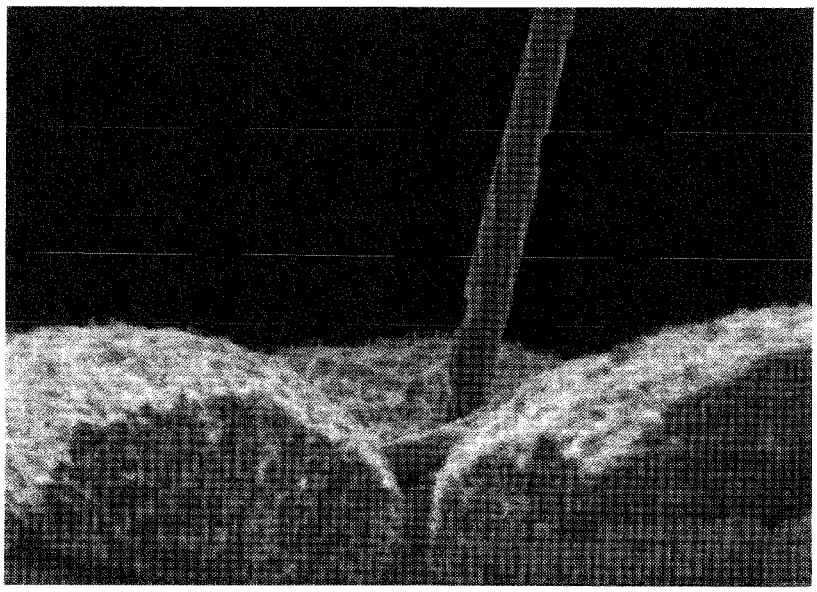
FIG. 38 is an expanded image of FIG. 37.
Figure 39:
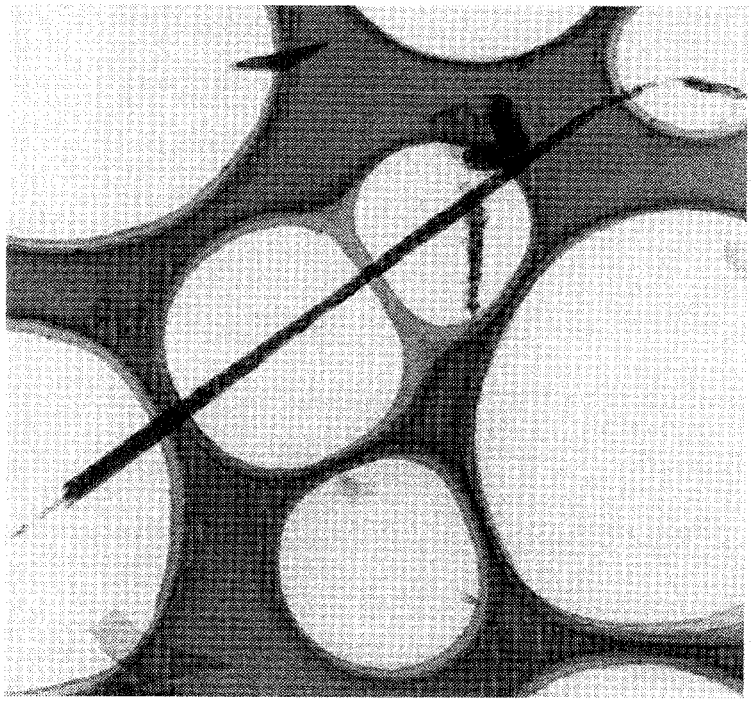
FIG. 39 is an image of a stick.
Figure 40:
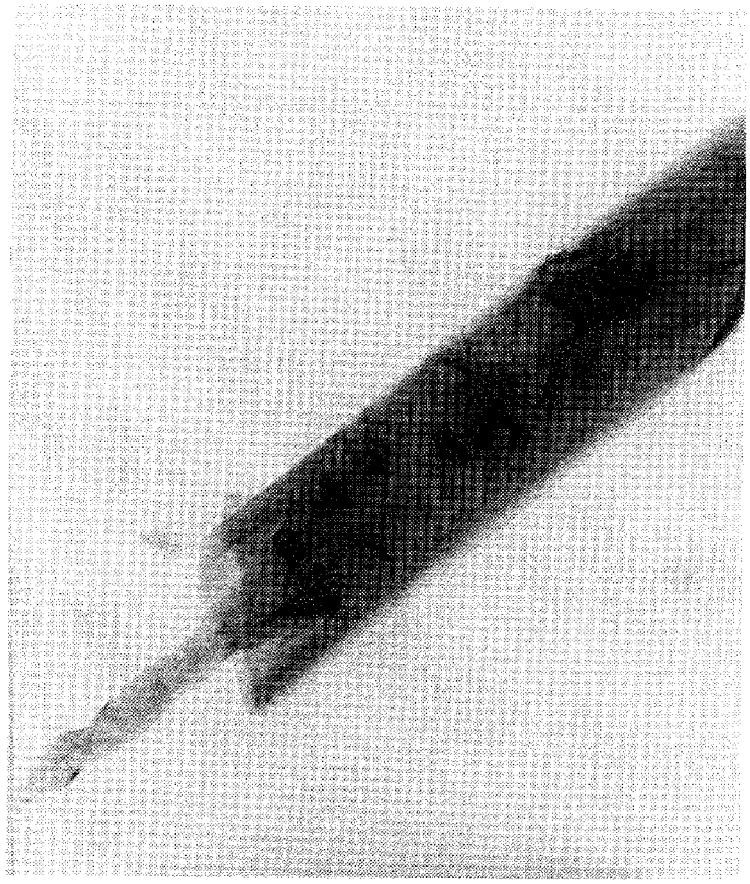
FIG. 40 is an expanded image of the stick.

A plurality of needle-like sticks as shown in FIG. 37 are formed on the surface of the electron emission film 130 in a standing state. FIG. 38 is an image of the electron emission film 130 that is expanded from that shown in FIG. 37, obtained by a scanning electron microscope. FIG. 39 is an image of an extracted stick. FIG. 40 is an expanded image of the stick shown in FIG. 39. The stick has an aspect ratio where its length is about 10 or more, preferably 30 or more times larger than its diameter (round measure). The stick comprises carbon having $sp^2$ bonds having a diameter of about 10 nm to 300 nm, and is structured such that its central core is surrounded by a sheath.

The stick, which originates from the nucleus of carbon 103*b* including carbon having the graphite structure formed of $sp^2$ bonds existing between the diamond find grains 103*a* and 103*a*, is grown in the vertical direction with respect to the direction of the surface of the electron emission film 130. Thus, the stick stands through the clearance between the diamond fine grains 103*a* and 103*a*.

Figure 41A:
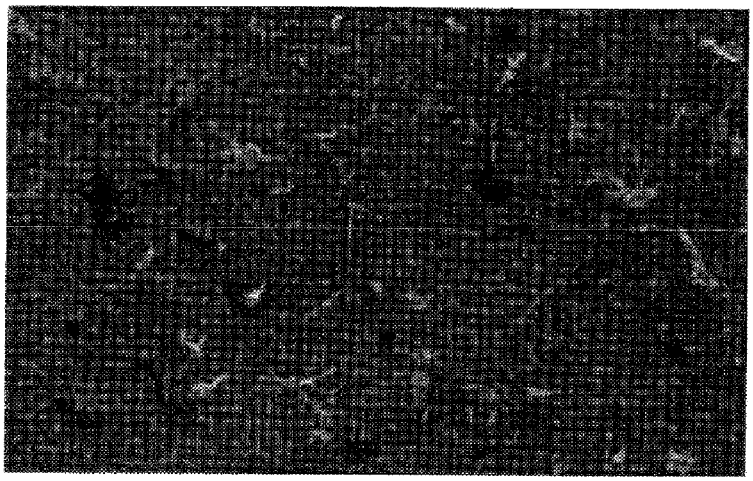
FIGS. 41A and 41B show an image of the electron emission film and a photographed image of a light emission state.
Figure 41B:
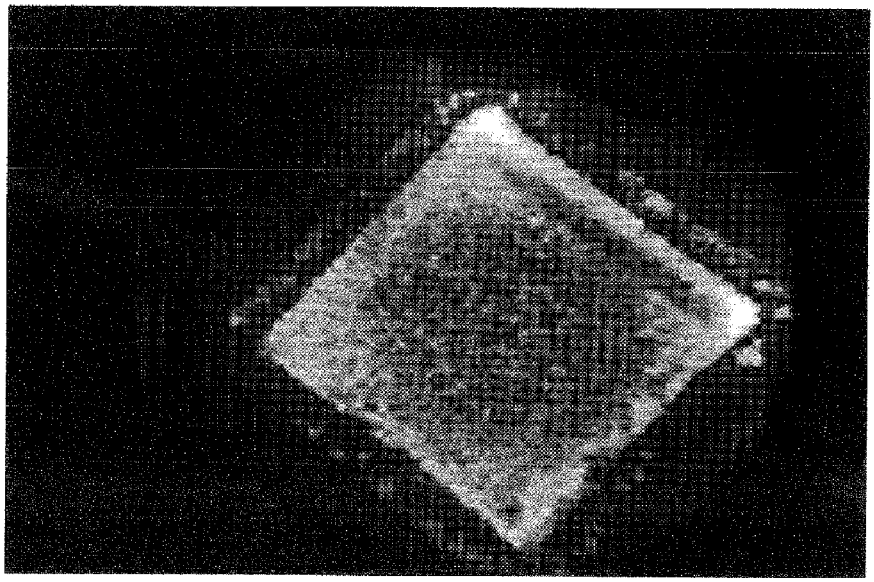

FIG. 41A is an image of the electron emission film 139 having the stick formed in its surface, obtained by a scanning electron microscope. FIG. 41B is a photographed image showing the state of light emission by the fluorescent tube 141 comprising the field emission electrode 131 in which the electron emission film of FIG. 41A is formed. The fluorescent tube 141 has a distance of 4.5 mm between its field emission electrode and its anode electrode, and has a voltage of 6000V applied between these electrodes. To sample specific portions of the electron emission film that correspond to the portions of the fluorescent film from which light having the luminance of 70% or more of the highest luminance of all the values obtained from the fluorescent film is emitted, that is, to sample specific portions where the electron emission characteristic is favorable, the density of the number of sticks in that portions is 5000 sticks/$mm^2$ to 20000 sticks/$mm^2$ This portions has the ratio (D-band intensity)/(G-band intensity), i.e. the ratio (carbon having $sp^3$ bonds)/(carbon having $sp^2$ bonds) of 2.6. Note that since the electric field is concentrated on the edge portion of the field emission electrode at the time of light emission and the field emission condition at the edge portion is therefore different from that of other portions, the light emission luminance at the portion of the fluorescent film 134 corresponding to the edge portion is not referred to as the highest luminance.

Figure 42A:
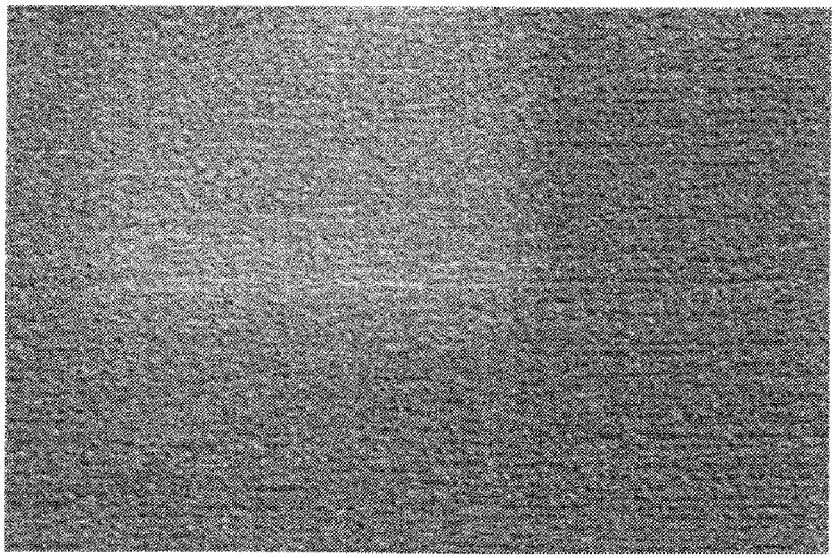
FIGS. 42A and 42B show an image of an electron emission film and a photographed image of a voltage applied state.
Figure 42B:
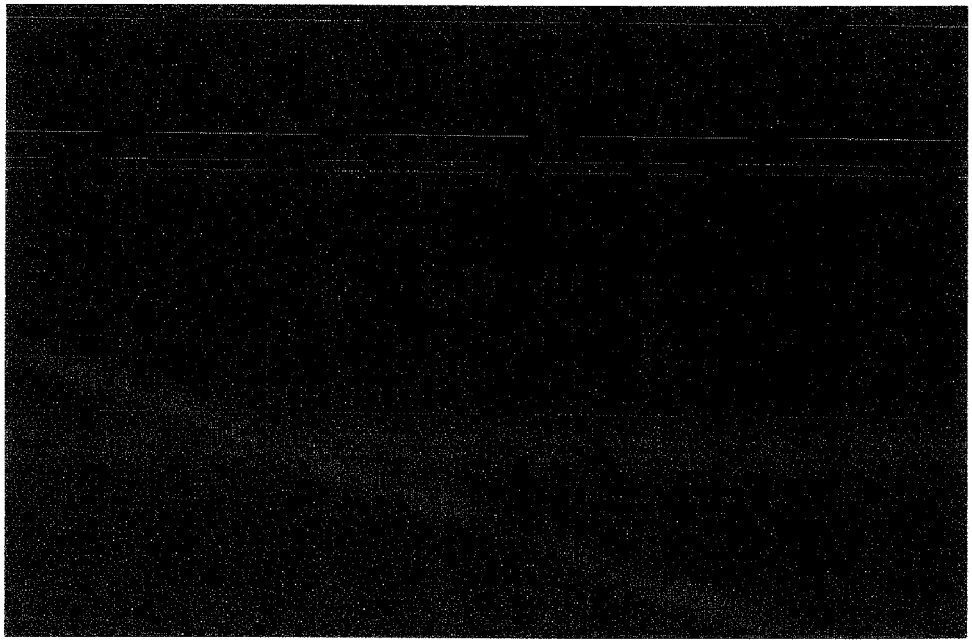

FIG. 42A is an image of an electron emission film having almost no stick in its surface, obtained by a scanning electron microscope, the ratio (carbon having $sp^3$ bonds)/(carbon having $sp^2$ bonds) of this electron emission film is 3.0. FIG. 42B is a photographed image showing the state of a voltage being applied, under the same condition as that of FIG. 41B, to a fluorescent tube comprising a field emission electrode in which the electron emission film shown in FIG. 42A is formed. Under this condition, the electron emission film having almost no stick formed in its surface does not trigger light emission, and is confirmed to have a worse electron emission characteristic than that of the electron emission film having sticks formed in its surface.

Figure 43:
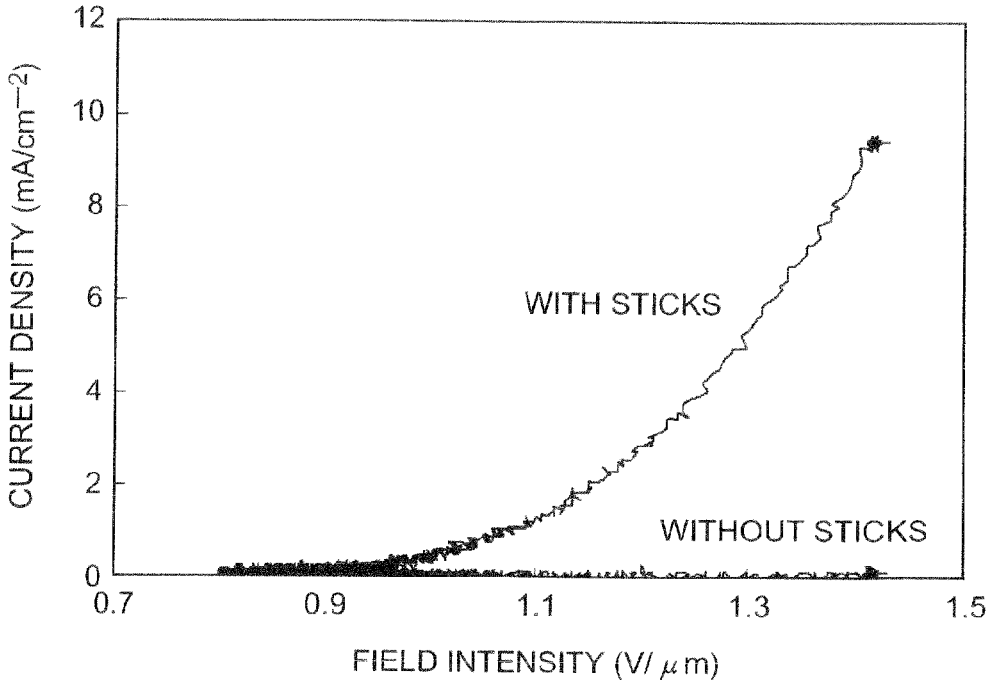
FIG. 43 is a diagram showing measured current densities of a fluorescent tube with sticks shown in FIG. 41B, and measured current densities of a fluorescent tube without sticks shown in FIG. 42B.
Figure 44A:
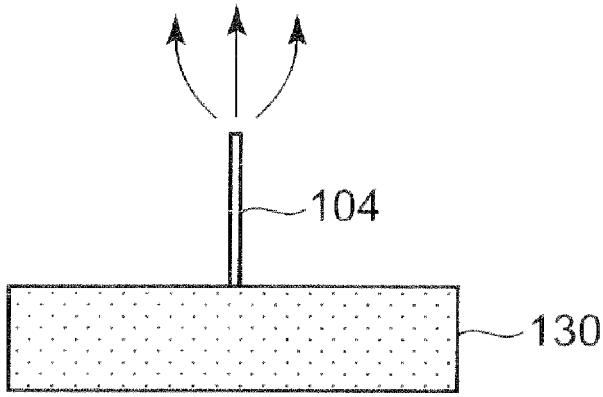
FIGS. 44A and 44B are schematic diagrams showing the field emission characteristics of the sticks and electron emission film.
Figure 44B:
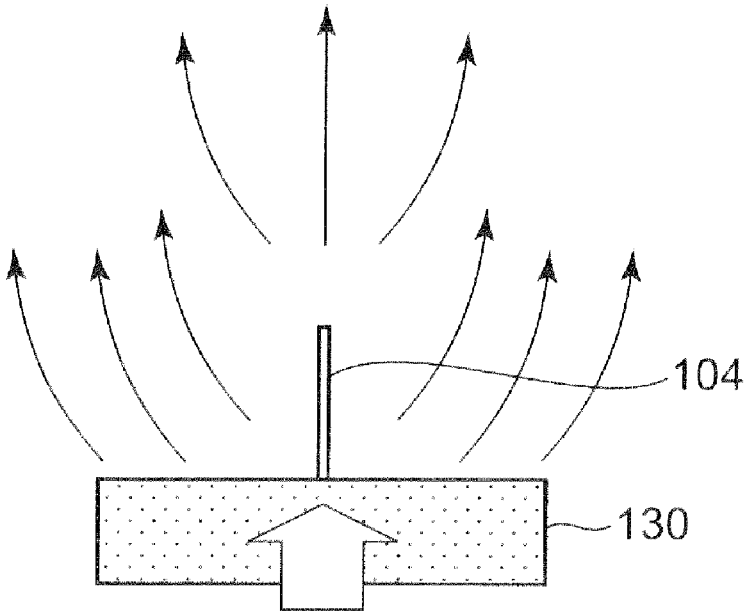

FIG. 43 shows current densities measured from the fluorescent tube with sticks shown in FIG. 41B, and those measured from the fluorescent tube without sticks shown in FIG. 42B. FIG. 44A and FIG. 44B are schematic diagrams showing the field emission characteristic of the electron emission film 130 having a stick 104 formed in its surface.

Since each diamond fine grain 103*a* in the electron emission film 130 has a negative electron affinity and has a very small grain diameter of 10 nm or less, it can emit an electron by the tunnel effect. Furthermore, not only the carbon 103*b* including carbon having the graphite structure formed of $sp^2$ bonds that exists in the clearances between the diamond fine grains 103*a* and 103*a* at a predetermined abundance ratio imparts conductivity to the film as a whole to thereby facilitate field emission, but also it is so arranged that the diamond fine grains be not stacked so continuously that the tunnel effect cannot be obtained.

That is, if about a hundred diamond fine grains 103*a* having a grain diameter of 10 nm are stacked in a predetermined direction with substantially no clearances therebetween, the thickness of the diamond will seemingly be 1000 nm, which will substantially inhibit the occurrence of the tunnel effect even if a strong field is applied. However, since the presence of the carbon 103*b* including carbon having conductivity separates the respective diamond fine grains 103*a*, each diamond fine grain 103*a* can exhibit the tunnel effect.

This tunnel effect allows an electron emitted from the substrate 101 upon a voltage application to be once injected via the carbon-nanowall 132 into a diamond fine grain 103*a* located on the surface of the carbon-nanowall 132, field-emitted from this diamond fine grain 103*a*, and again injected into a diamond fine grain 103*a* adjacent to that diamond fine grain 103*a* in the field direction, subsequently repeatedly causing such electron emission in the field direction of the electron emission film 130 and finally causing the electron to be moved to the surface of the electron emission film 130.

If the electric field between the field emission electrode 131 and the anode electrode 133 is small, the field is concentrated on the stick 104 that sticks out from the electron emission film 130 because field concentration is less likely to occur on the electron emission film 130 due to its surface being flat, and an electron is therefore field-emitted from the tip of the stick 104. Since the stick 104 has the steric structure, the electron emission film 130 having the stick 104 can cause field emission even if the field intensity between the field emission electrode 131 and the anode electrode 133 is small, whereas the electron emission film 130 having no stick 104 cannot cause field emission under such a condition.

When the field intensity between the field emission electrode 131 and the anode electrode 133 is increased, not only the stick 104 but also the surface of the electron emission film 130 cause field emission as shown in FIG. 44B.

Almost no stick 104 is found in the carbon-nanowall 132. This is because the growing speed of the carbon-nanowall 132 on the substrate 101 is relatively high, and this allows no stick 104 to grow by exceeding the growing speed of the carbon-nanowall 142.

The electron emission film 130 grows slowly at a speed of about 1 μm/h, and grows not only in the direction perpendicular to surface of the substrate 101 but also in the surface direction radially, whereas the stick 104 grows only in one direction and therefore grows faster than the electron emission film 130. Since the stick 104, because of its sticking structure, gets hotter than the surface of the electron emission film 130 while grown by being heated by plasma CVD described later, such a factor that the graphite structure formed of $sp^2$ bonds whose range of appropriate growing temperatures is higher than that of the diamond structure formed of $sp^3$ bonds is more likely to grow, also adds to the faster growing of the stick 104.

The surface of the electron emission film 130 has not only the stick 104 formed as shown in FIG. 41A, but also has dust-like carbon formed. The dust-like carbon includes carbon having the graphite structure or carbon having an amorphous structure, and is twined around the base of the stick 104, etc. The length of the portion of the stick 104 around which the dust-like carbon is twined is 50% or less than the total length of the stick 104.

With the dust-like carbon formed, the stick 104 has its surface area increased and thus can have its exoergicity improved. This prevents the adsorption gas from desorpting, prevents the ion bombardment on the electron emission film 130 by desorpting gas, and further prevents the tissue destruction due to the thermal vaporization of the stick 104. Furthermore, the dust-like carbon supports the thin stick 104 to save the stick from falling down or breaking down, and can improve the conductivity at the portion where the dust-like carbon contacts the stick 104.

Figure 45A:
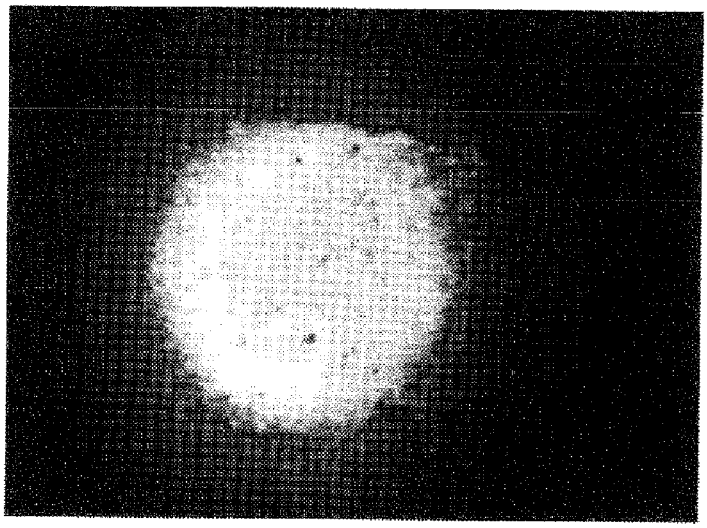
Figure 45B:
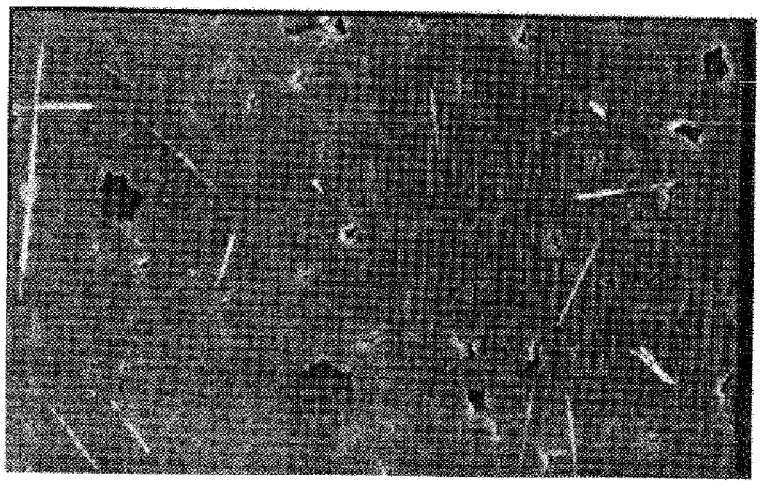

FIG. 45A is an image showing the state of light emission by a fluorescent tube comprising the field emission electrode 131 including the electron emission film 130, which film is sampled at about ten specific portions that correspond to the portions of the fluorescent film 134 from which light having the luminance of 70% or more of the highest luminance (cd/m$^2$) of all the values obtainable from the fluorescent film 134 is emitted under the conditions that the distance between the field emission electrode 131 and the anode electrode is 4.5 mm and a voltage of 6000V is applied between these electrodes, i.e., sampled at about ten specific portions where the electron emission characteristic is favorable, with the sampling result that the density of the number of sticks 104 at the about ten specific portions is between 5000 sticks/mm$^2$ to 15000 stick/mm$^2$. FIG. 45B is a photographed image of the surface of the electron emission film 130 of FIG. 45A, obtained by a scanning electron microscope. The time required to form the electron emission film 130 by DC plasma is three hours, and the heating temperature during the film formation is 905° C.

Figure 46A:
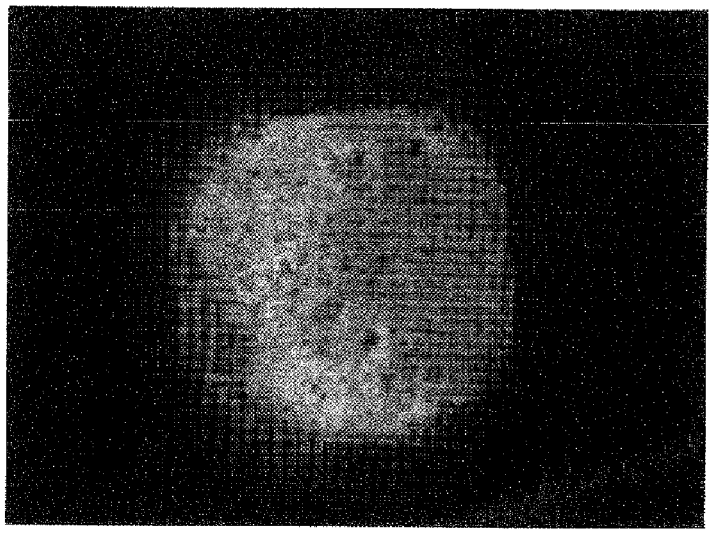
FIGS. 46A and 46B are an image showing a state of light emission by a fluorescent tube in a case where the density of the number of sticks is 15000 sticks/$mm^2$ to 25000 sticks/$mm^2$, and a photographed image of the surface of the electron emission film obtained by a scanning electron microscope.
Figure 46B:
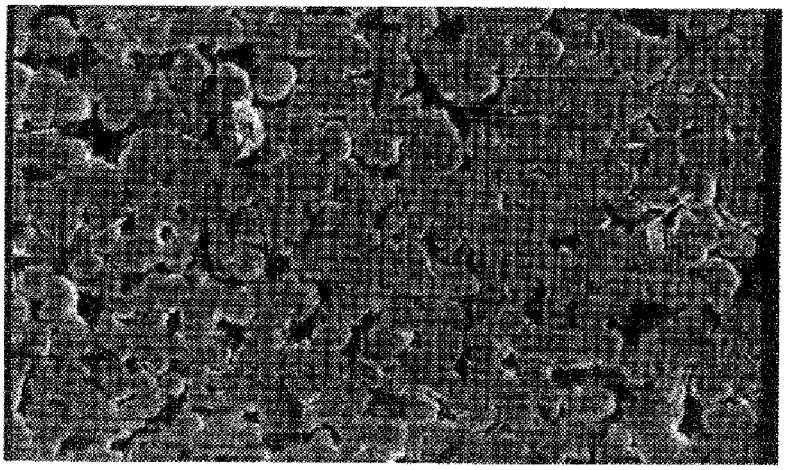

FIG. 46A is an image showing the state of light emission by a fluorescent tube comprising the field emission electrode 131 including the electron emission film 130, which film is sampled at about ten specific portions that correspond to the portions of the fluorescent film 134 from which light having the luminance of 70% or more of the highest luminance (cd/m$^2$) of all the values obtainable from the fluorescent film 134 is emitted under the conditions that the distance between the field emission electrode 131 and the anode electrode is 4.5 mm and a voltage of 6000V is applied between these electrodes, i.e., sampled at about ten specific portions where the electron emission characteristic is favorable, with the sampling result that the density of the number of sticks 104 at the about ten specific portions is between 15000 sticks/mm$^2$ to 25000 stick/mm$^2$. FIG. 46B is a photographed image of the surface of the electron emission film 130 of FIG. 46A, obtained by a scanning electron microscope. The time required to form the electron emission film 130 by DC plasma is two hours, and the heating temperature during the film formation is 905° C. Accordingly, it is confirmed that if the electron emission film 130 is heated by DC plasma to 905° C., the density of the number of sticks 104 lowers after two hours of heating time passes and before three hours of heating time passes. This is because the dust-like carbon to be described later grows in the surface of the electron emission film 130 together with the sticks 104 and covers the sticks 104, so that the sticks 104 seemingly disappear.

Figure 47A:
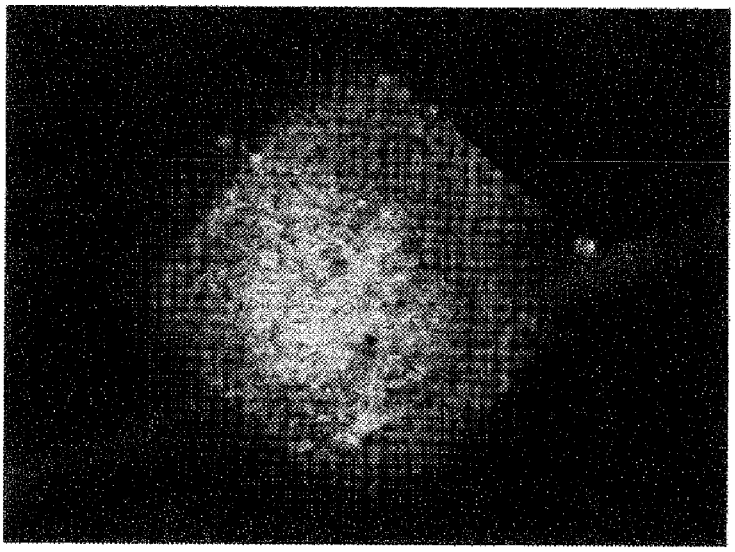
FIGS. 47A and 47B are an image showing a state of light emission by a fluorescent tube in a case where the density of the number of sticks is 45000 sticks/$mm^2$ to 55000 sticks/$mm^2$, and a photographed image of the surface of the electron emission film obtained by a scanning electron microscope.
Figure 47B:
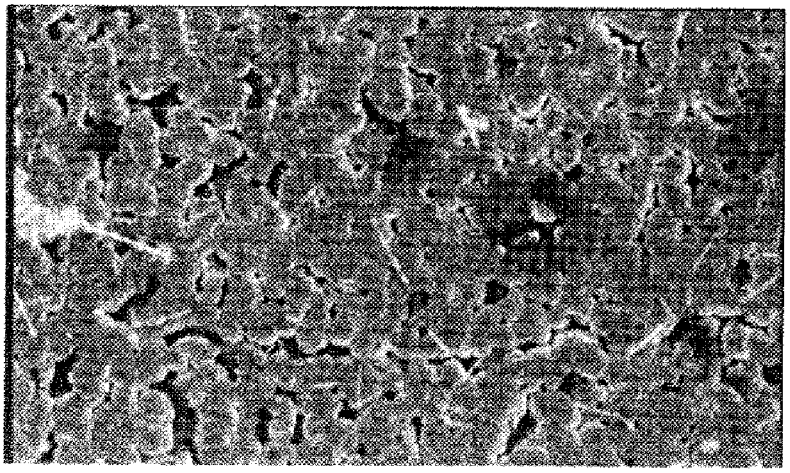

FIG. 47A is an image showing the state of light emission by a fluorescent tube comprising the field emission electrode 131 including the electron emission film 130, which film is sampled at about ten specific portions that correspond to the portions of the fluorescent film 134 from which light having the luminance of 70% or more of the highest luminance (cd/m$^2$) of all the values obtainable from the fluorescent film 134 is emitted under the conditions that the distance between the field emission electrode 131 and the anode electrode is 4.5 mm and a voltage of 6000V is applied between these electrodes, i.e., sampled at about ten specific portions where the electron emission characteristic is favorable, with the sampling result that the density of the number of sticks 104 at the about ten specific portions is between 45000 sticks/mm$^2$ to 55000 stick/mm$^2$. FIG. 47B is a photographed image of the surface of the electron emission film 130 of FIG. 47A, obtained by a scanning electron microscope.

The time required to form the electron emission film 130 by DC plasma is two hours, and the heating temperature during the film formation is 900° C. Accordingly, by slightly lowering the film forming temperature from 905° C., it is possible to increase the density of the number of sticks 104. However, since the electron emission film 130 shown in FIG. 47B has its sticks 104 formed too thin and does not have the dust-like carbon formed sufficiently, the dust-like carbon cannot fully support the sticks 104 to thereby have the sticks 104 fall down during their growing, resulting in a worse field emission characteristic than that of the fluorescent tubes shown in FIG. 45A and FIG. 46A.

Figure 48A:
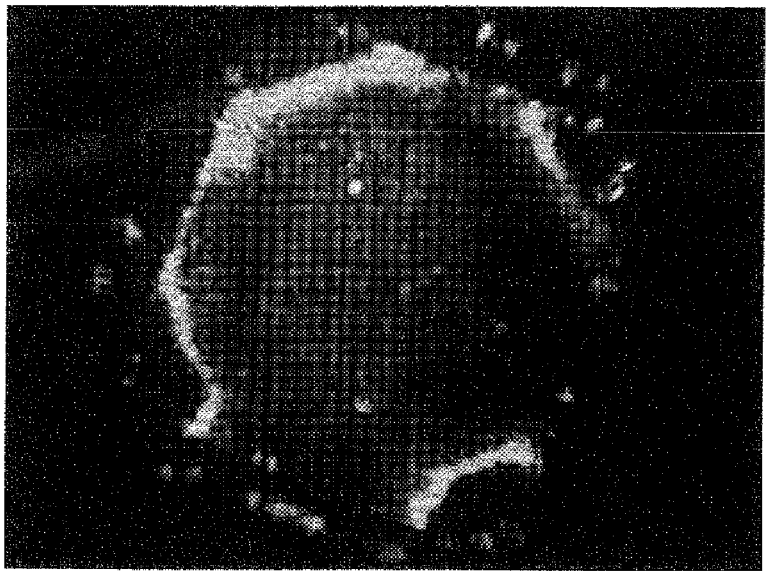
FIGS. 48A and 48B are an image showing a state of light emission by a fluorescent tube in a case where the density of the number of sticks is 65000 sticks/$mm^2$ to 75000 sticks/$mm^2$, and a photographed image of the surface of the electron emission film obtained by a scanning electron microscope.
Figure 48B:
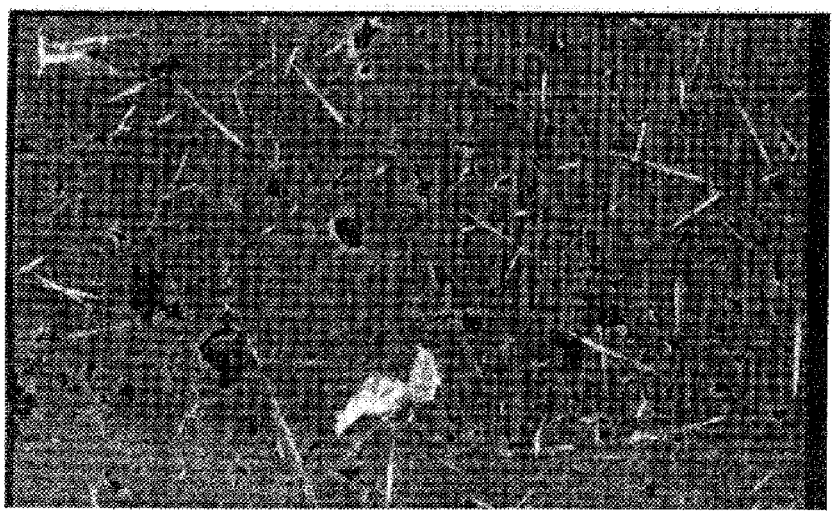

FIG. 48A is an image showing the state of light emission by a fluorescent tube comprising the field emission electrode 131 including the electron emission film 130, which film is sampled at about ten specific portions that correspond to the portions of the fluorescent film 134 from which light having the luminance of 70% or more of the highest luminance (cd/m$^2$) of all the values obtainable from the fluorescent film 134 is emitted under the conditions that the distance between the field emission electrode 131 and the anode electrode is 4.5 mm and a voltage of 6000V is applied between these electrodes, i.e. sampled at about ten specific portions where the electron emission characteristic is favorable, with the sampling result that the density of the number of sticks 104 at the about ten specific portions is between 65000 sticks/mm$^2$ to 75000 stick/mm$^2$. FIG. 48B is a photographed image of the surface of the electron emission film 130 of FIG. 48A, obtained by a scanning electron microscope.

The time required to form the electron emission film 130 by DC plasma is two hours, and the heating temperature during the film formation is 913° C. Accordingly, also by slightly raising the film forming temperature from 905° C., it is possible to increase the density of the number of sticks 104. However, the electron emission film 130 shown in FIG. 48B has its sticks 104 formed too thin and has the sticks 104 fall down during their growing, resulting in a worse field emission characteristic than that of the fluorescent tubes shown in FIG. 45A and FIG. 46A.

The growing speed of the diamond fine grain 103*a*, the carbon 103*b*, the stick 104, and the dust-like carbon in the electron emission film 130 is affected by various factors such as the material gas pressure and the gas convection in the DC plasma system, the shape and size of the positive electrode and negative electrode in the system, the distance between the positive electrode and the negative electrode, etc., and is not determined only by the film forming temperature and film forming time.

The electron emission film 130 whose stick number density is 5000 sticks/mm$^2$ to 15000 stick/mm$^2$ has the most favorable electron emission characteristic, followed by the electron emission film 130 whose stick number density is 15000 sticks/mm$^2$ to 25000 stick/mm$^2$, the electron emission film 130 whose stick number density is 45000 sticks/mm$^2$ to 55000 stick/mm$^2$, and the electron emission film 130 whose stick number density is 65000 sticks/mm$^2$ to 75000 stick/mm$^2$, in this order.

The method of manufacturing the electron emission film 130 will now be explained.

Figure 49:
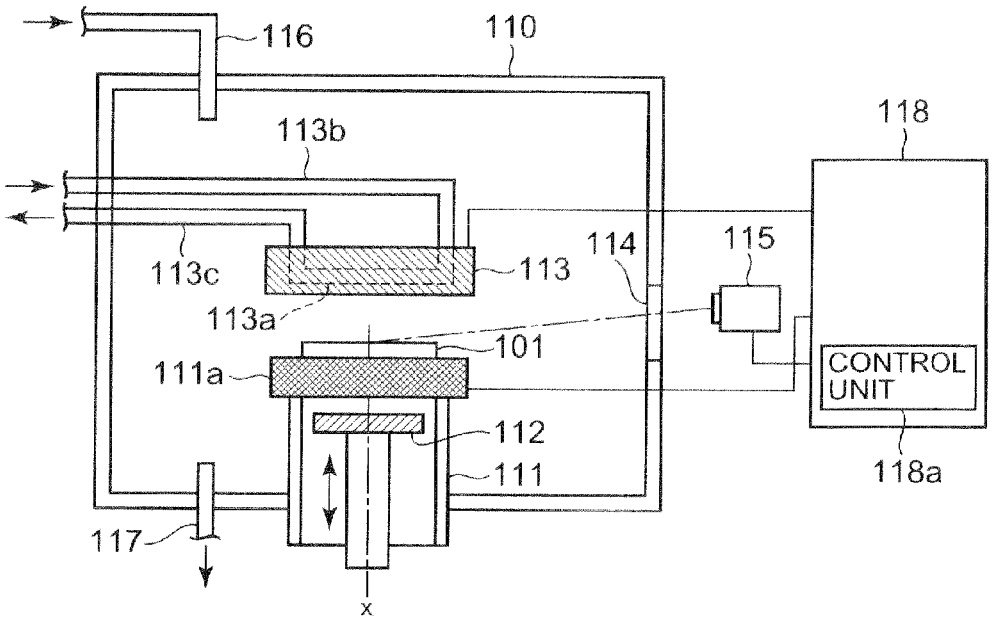
FIG. 49 is a diagram showing a manufacturing apparatus for the electron emission electrode according to the embodiment 3.

A DC plasma CVD system shown in FIG. 49 is a system for forming a film on the surface of the process-target substrate 101, and comprises a chamber 110 for shutting the substrate 101 from the surrounding atmosphere.

The chamber 110 has a table 111 thereinside, and a positive electrode 111*a* having a disk-like shape is mounted on the upper portion of the table 111. The substrate 101 is fixed on the upper placement surface of the positive electrode 111*a*. The table 111 is designed to rotate together with the positive electrode 111*a* about an axis "x".

A cooling member 112 is disposed under the lower surface of the positive electrode 111*a*, and is structured to move upward and downward by an unillustrated moving system. The cooling member 112 is made of metal having a high heat conductivity such as copper, etc., and includes therein an unillustrated cooling medium such as water, calcium chloride aqueous solution, or the like that circulates therein to cool the entire cooling member 112. The cooling member 112 abuts on the positive electrode 111*a* by moving upward, and steals the heat from the substrate 101 via the positive electrode 111*a*.

A negative electrode 113 is disposed above the positive electrode 111*a* so as to face the positive electrode 111*a* with a predetermined distance therebetween. A flow path 113*a* through which a cooling medium flows is formed in the negative electrode 113, and tubes 113*b* and 113*c* are connected to both ends of the flow path 113*a*. The tubes 113*b* and 113*c* go through the holes formed in the chamber 110 and lead to the flow path 113*a*. The holes in the chamber 110 passed through by the tubes 113*b* and 113*c* are sealed by a sealing agent to ensure the airtightness in the chamber 110. The tube 113*b*, the flow path 113*a*, and the tube 113*c* restricts the heat generation of the negative electrode 113, by letting a cooling medium flow therethrough. Water, calcium chloride aqueous solution, air, inert gas, or the like is preferable as the cooling medium.

A window is formed in a side wall of the chamber 110, allowing the interior of the chamber 110 to be observed. Glass is set inside the window 114 to ensure the airtightness in the chamber 110. A radio-spectrometer 115 is disposed outside the chamber 110, for measuring the temperature of the substrate 101 via the glass of the window 114.

This DC plasma CVD system comprises a material system (unillustrated) for introducing material gas through a gas supply pipe 116, a gas ejection system (unillustrated) for adjusting the atmospheric pressure in the chamber 110 by ejecting gaseous body from the chamber 110 through a gas ejection pipe 117, and an output setting unit 118.

The pipes 116 and 117 passes through holes formed in the chamber 110. A sealing agent seals between these holes, the circumference of the pipes 116 and 117, and the chamber 110 to ensure the airtightness in the chamber 110.

The output setting unit 118 is a means for setting the voltage or the current density between the positive electrode 111*a* and the negative electrode 113, and is connected to the positive electrode 111*a* and to the negative electrode 113 by lead lines respectively. Each lead line passes through a hole formed in the chamber 110. The holes in the chamber 110 passed through by the lead lines are sealed by a sealing agent.

The output setting unit 118 comprises a control unit 118*a*, and the control unit 118*a* is connected to the radio-spectrometer 115 by a lead line. The control unit 118*a*, when activated, refers to the temperature of the film forming surface of the substrate 101 based on the emissivity of the film forming surface measured by the radio-spectrometer 115, and adjusts the voltage or the current density between the positive electrode 111*a* and the negative electrode 113 so that the temperature of the film forming surface of the substrate 101 will be an intended value.

Next, a film forming process for forming the electron emission film 130 by using the DC plasma CVD system of FIG. 49 to thereby form a field emission electrode, will be explained.

In this film forming process, an electron emission film 20 which comprises a layer including the carbon-nanowall 132 and the electron emission film 130 formed on the carbon-nanowall 132 and including a plurality of diamond fine grains, is to be formed on the surface of the substrate 101 made of nickel or the like.

First, for example, a nickel plate is cut into substrates 101, and the substrate 101 is degreased and ultrasonic-cleaned sufficiently by using ethanol or acetone. The substrate 101 is fixed on the placement surface of the positive electrode 111*a* in the DC plasma CVD system.

When the substrate 101 is fixed, the interior of the chamber 110 is depressurized by the gas ejection system, and then hydrogen gas and gas comprising a compound (carbon-containing compound) that contains carbon in its composition such as methane are introduced through the gas supply pipe 116. The gas supply pipe 116 may include separate pipes for hydrogen gas and methane respectively, or may include one pipe in case the gases are mixed.

It is preferable that the gas comprising a compound that contains carbon in its composition is 3vol % to 30vol % of the whole material gas. For example, the mass flow of methane is set at 50 SCCM while that of hydrogen is set at 500 SCCM, and the whole pressure is set at 0.05 to 1.5 atm, preferably at 0.07 to 0.1 atm. The positive electrode 111*a* together with the substrate 101 is rotated at 10 rpm, and a DC power is applied between the positive electrode 111*a* and the negative electrode 113 to generate plasma, in a manner that the temperature variation on the substrate 101 is restricted within 5° C. and the state of plasma and the temperature of the substrate 101 are controlled.

Figure 50:
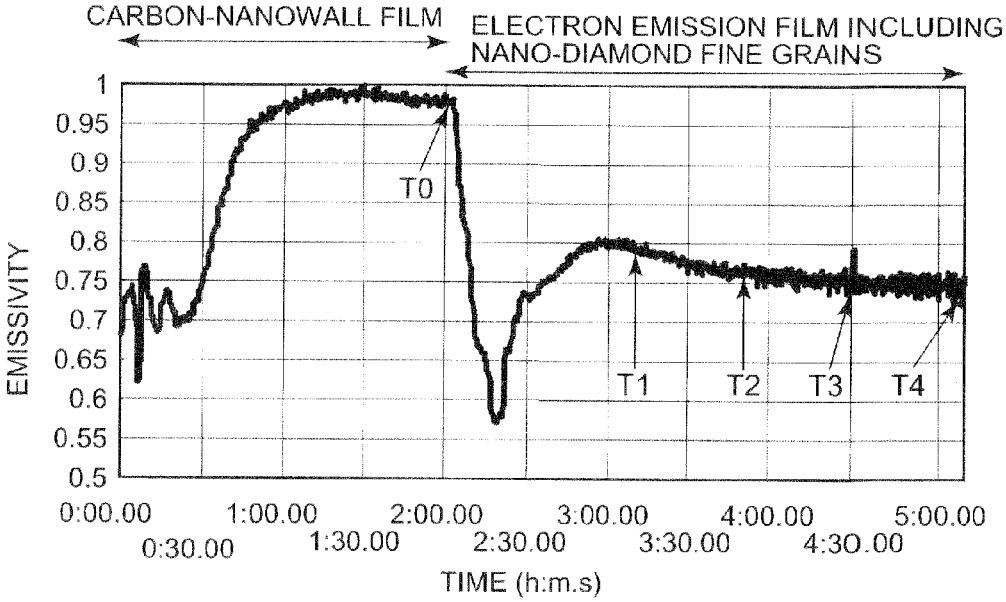
FIG. 50 is a diagram showing the emissivity of the surfaces where the carbon-nanowall and electron emission film of the field emission electrode according to the embodiment 3 are being formed.

For forming the carbon-nanowall 132, the temperature of the portion of the substrate 101 where the carbon-nanowall 132 is to be formed is maintained at 900° C. to 1100° C. and the film formation is carried out for a predetermined time. Radiation from the surface of the carbon-nanowall 132 being formed is measured by the radio-spectrometer 115. At this time, the cooling member 112 is set sufficiently apart from the positive electrode 111*a*, so that the temperature of the positive electrode 111*a* will not be affected. The radio-spectrometer 115 is designed to measure the temperature only from the thermal radiation from the surface of the substrate 101, by subtracting plasma radiation of the DC plasma CVD system, as shown in FIG. 50. When the carbon-nanowall 132 as the base layer has been sufficiently formed, with the gas atmosphere unchanged, the cooling member 112 retaining a much lower temperature than that of the positive electrode 111*a* having been heated by plasma, is lifted upward to abut on the lower surface of the positive electrode 111*a* (at a timing T0).

At this time, the cooled positive electrode 111*a* cools the substrate 101 fixed thereon, and as shown in FIG. 50, the surface of the substrate 101 is rapidly cooled down to an appropriate temperature for forming a film of a plurality of diamond fine grains 103*a*, which is 10° C. or more lower than that when the carbon-nanowall 132 was being formed. At this time, the temperature is set to 890° C. to 950° C., preferably to 920° C. to 940° C. Note that it is preferable that the value of the voltage to be applied or current to be applied between the positive electrode 111*a* and the negative electrode 113 be not changed at the timing TO. Since the emissivity of the carbon-nanowall 132 is almost 1 because of its graphite structure formed of $sp^2$ bonds, using the carbon-nanowall 132 as the base film and setting 0.7 as the emissivity of the upper film in accordance with the diamond fine grains 103*a* as the main component of the upper film would allow the film forming state of the diamond fine grains 103*a* to be controlled and the temperature to be measured stably.

Since the substrate 101 is cooled down rapidly at the timing TO, the growth of the carbon-nanowall 132 is stopped, and the plurality of diamond fine grains 103*a* start to grow from the nuclei of carbon-nanowall 132, eventually forming the electron emission film 130 on the carbon-nanowall 132, that includes the plurality of diamond fine grains 103*a* having a grain diameter of 5 nm to 10 nm formed of $sp^3$ bonds and the conductive carbon 103*b* formed of $sp^2$ bonds and existing in the clearances between the diamond fine grains 103*a*. In the process of the diamond fine grains 103*a* and carbon 103*b* growing, the sticks 104 are grown from such carbon 103*b*, which is exposed on the surface of the electron emission film 130.

When the cooling member 112 abutting on the positive electrode 111*a* is moved downward, the emissivity starts to rise together with the surface temperature of the substrate 101 due to the plasma. At this time, if the temperature rise is up to 950° C., the diamond fine grain 103*a* and the carbon 103*b* continue to grow without switching to grow into the carbon-nanowall 132.

By the manufacturing method described above, the state of the electron emission film 130 was checked at the timing T1, the timing T2, the timing T3, and the timing 14 shown in FIG. 50, at which the plasma output from the DC plasma CVD system was stopped.

Figure 51A:
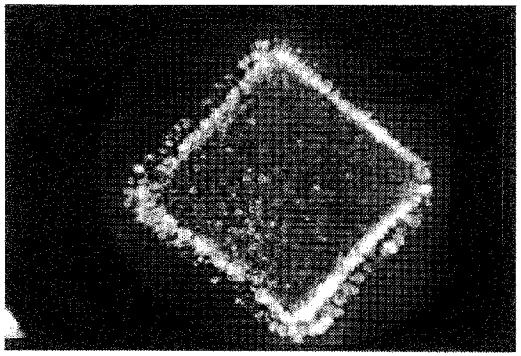
FIGS. 51A to 51D are an image showing a state of light emission by a fluorescent tube employing the electron emission film, a photographed image of the surface of the electron emission film, a photographed image of the surface of the electron emission film, and a photographed image of a cross section of the field emission electrode.
Figure 51B:
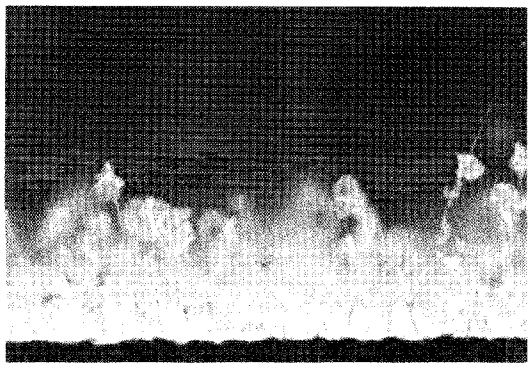
Figure 51C:
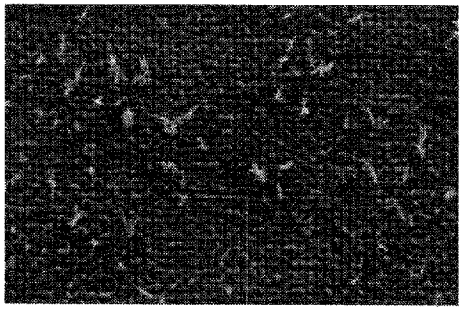
Figure 51D:
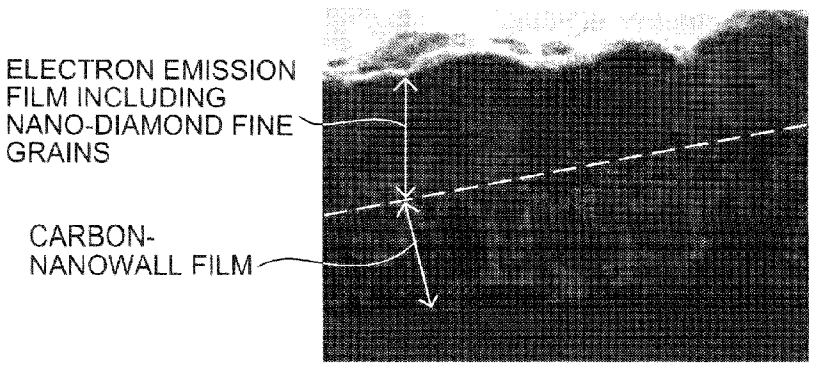

FIG. 51A is an image showing the state of light emission by the fluorescent tube 141 which employs the electron emission film 130, for which the plasma output was stopped at the timing T1 during the DC plasma manufacturing. FIG. 51B is a photographed image of the surface of the electron emission film 130 of FIG. 51A, obtained by a scanning electron microscope. FIG. 51C is a photographed image of the surface of the electron emission film 130 of FIG. 51A, obtained by a scanning electron microscope. FIG. 51D is a photographed image of a cross section of the field emission electrode 131 of FIG. 51A, obtained by a scanning electron microscope.

Under conditions that the distance between the field emission electrode 131 and the anode electrode 133 was 4.5 mm and a voltage of 6000V was applied between these electrode to cause light emission, about 10 portions of the electron emission film 130 that correspond to the portions of the fluorescent film 134 from which light having the luminance of 70% or more of the highest luminance (cd/$m^2$) of all the values obtained from the fluorescent film 134 was emitted, i.e., about 10 portions of the electron emission film 130 where the electron emission characteristic was favorable were sampled, with a sampling result that the density of the number of sticks 104 was 17000 sticks/$mm^2$ to 21000 sticks/$mm^2$. The ratio (number of $sp^3$ bonds in the film)/(number of $sp^7$ bonds in the film) of the electron emission film 130 was 2.50. As shown in FIG. 51B and FIG. 51C, sticks 104 and dust-like carbon twining around the sticks 104 were already formed.

Note that since the electric field was concentrated on the edge portion of the field emission electrode 131 at the time of light emission and the field emission condition at the edge portion was therefore different from that of other portions, the light emission luminance at the portion of the fluorescent film 134 corresponding to the edge portion was not referred to as the highest luminance.

Figure 52A:
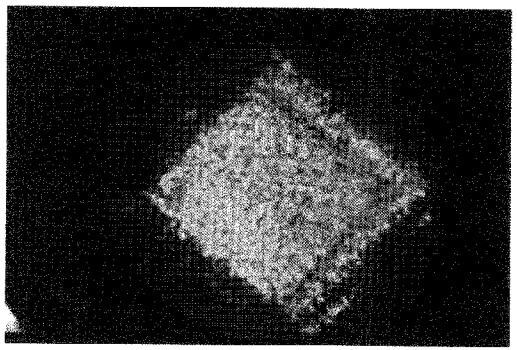
FIGS. 52A to 52D are an image showing a state of light emission by a fluorescent tube employing the electron emission film, a photographed image of the surface of the electron emission film, a photographed image of the surface of the electron emission film, and a photographed image of a cross section of the field emission electrode.
Figure 52B:
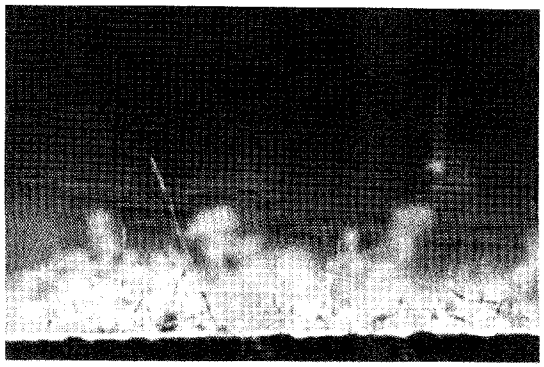
Figure 52C:
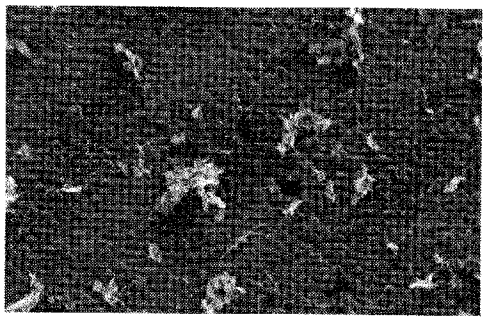
Figure 52D:
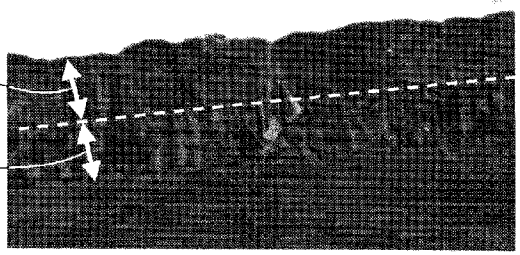

FIG. 52A is an image showing the state of light emission by the fluorescent tube 141 which employs the electron emission film 130, for which the plasma output was stopped at the timing T2 during the DC plasma manufacturing. FIG. 52B is a photographed image of the surface of the electron emission film 130 of FIG. 52A, obtained by a scanning electron microscope. FIG. 52C is a photographed image of the surface of the electron emission film 130 of FIG. 52A, obtained by a scanning electron microscope. FIG. 52D is a photographed image of a cross section of the field emission electrode 131 of FIG. 52A, obtained by a scanning electron microscope.

Under conditions that the distance between the field emission electrode 131 and the anode electrode 133 was 4.5 mm and a voltage of 6000V was applied between these electrode to cause light emission, about 10 portions of the electron emission film 130 that correspond to the portions of the fluorescent film 134 from which light having the luminance of 70% or more of the highest luminance (cd/$m^2$) of all the values obtained from the fluorescent film 134 was emitted, i.e., about 10 portions of the electron emission film 130 where the electron emission characteristic was favorable were sampled, with a sampling result that the density of the number of sticks 104 was 16000 sticks/$mm^2$ to 20000 sticks/$mm^2$. The ratio (number of $sp^3$ bonds in the film)/(number of $sp^2$ bonds in the film) of the electron emission film 130 was 2.52. As shown in FIG. 52B and FIG. 52C, sticks 104 and dust-like carbon twining around the sticks 104 were formed but had some of them lost as compared to those shown in FIGS. 51B and 51C. This is because the speed of etching by the plasma was higher than the speed of growing by the plasma.

Note that since the electric field was concentrated on the edge portion of the field emission electrode 131 at the time of light emission and the field emission condition at the edge portion was therefore different from that of other portions, the light emission luminance at the portion of the fluorescent film 134 corresponding to the edge portion was not referred to as the highest luminance.

Figure 53A:
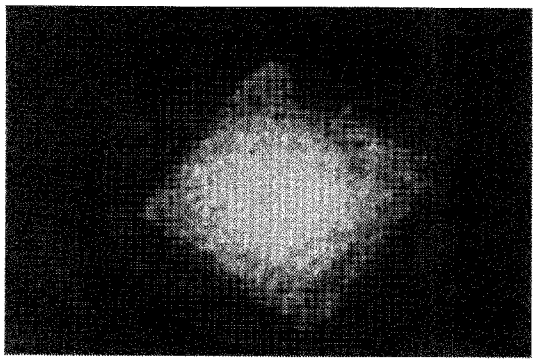
FIGS. 53A to 53D are an image showing a state of light emission by a fluorescent tube employing the electron emission film, a photographed image of the surface of the electron emission film, a photographed image of the surface of the electron emission film, and a photographed image of a cross section of the field emission electrode.
Figure 53B:
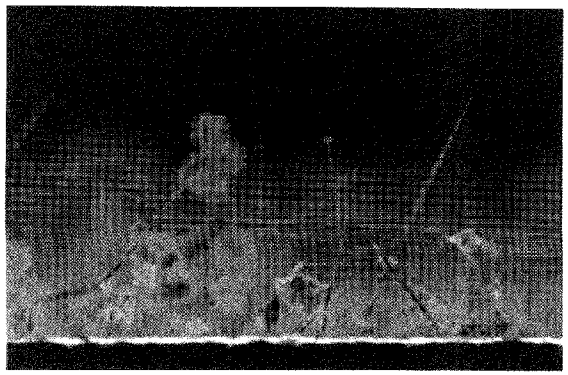
Figure 53C:
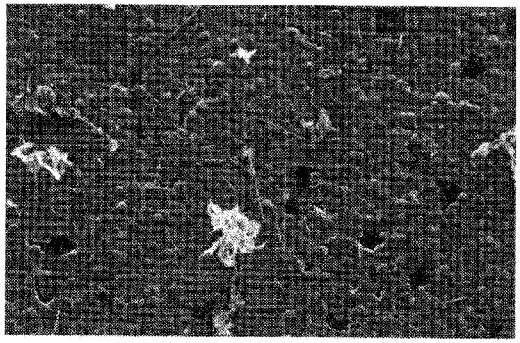
Figure 53D:
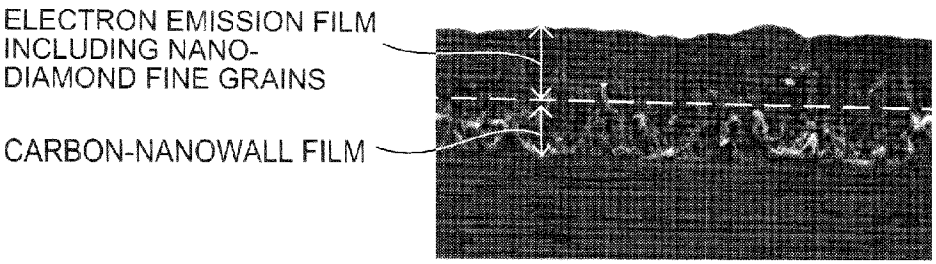

FIG. 53A is an image showing the state of light emission by the fluorescent tube 141 which employs the electron emission film 130, for which the plasma output was stopped at the timing T3 during the DC plasma manufacturing. FIG. 53B is a photographed image of the surface of the electron emission film 130 of FIG. 53A, obtained by a scanning electron microscope. FIG. 53C is a photographed image of the surface of the electron emission film 130 of FIG. 53A, obtained by a scanning electron microscope. FIG. 53D is a photographed image of a cross section of the field emission electrode 131 of FIG. 53A, obtained by a scanning electron microscope.

Under conditions that the distance between the field emission electrode 131 and the anode electrode 133 was 4.5 mm and a voltage of 6000V was applied between these electrode to cause light emission, about 10 portions of the electron emission film 130 that correspond to the portions of the fluorescent film 134 from which light having the luminance of 70% or more of the highest luminance (cd/$m^2$) of all the values obtained from the fluorescent film 134 was emitted, i.e., about 10 portions of the electron emission film 130 where the electron emission characteristic was favorable were sampled, with a sampling result that the density of the number of sticks 104 was 8000 sticks/$mm^2$ to 12000 sticks/$mm^2$. The ratio (number of $sp^3$ bonds in the film)/(number of $sp^2$ bonds in the film) of the electron emission film 130 was 2.60. As shown in FIG. 53B and FIG. 53C, sticks 104 and dust-like carbon twining around the sticks 104 were formed but had some of them lost as compared to those shown in FIGS. 52B and 52C. This is because the speed of etching by the plasma was higher than the speed of growing by the plasma. Some portions of the electron emission film 130 once grown by the plasma were caused to be lost by etching.

Note that since the electric field was concentrated on the edge portion of the field emission electrode 131 at the time of light emission and the field emission condition at the edge portion was therefore different from that of other portions, the light emission luminance at the portion of the fluorescent film 134 corresponding to the edge portion was not referred to as the highest luminance.

Figure 54A:
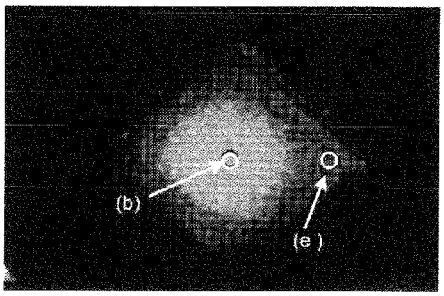
FIGS. 54A to 54E are an image showing a state of light emission by a fluorescent tube employing the electron emission film, a photographed image of the surface of the electron emission film at its central portion, a photographed image of the surface of the electron emission film, a photographed image of a cross section of the field emission electrode, and a photographed image of the surface of the electron emission film at its edge portion.
Figure 54B:
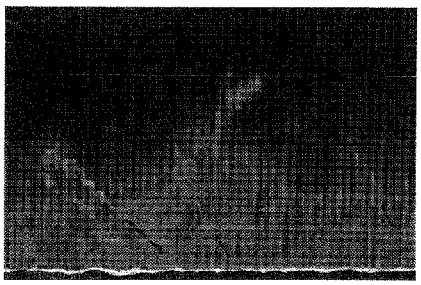
Figure 54C:
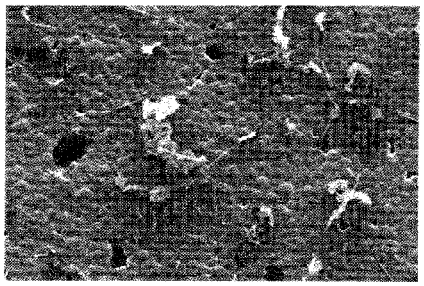
Figure 54D:
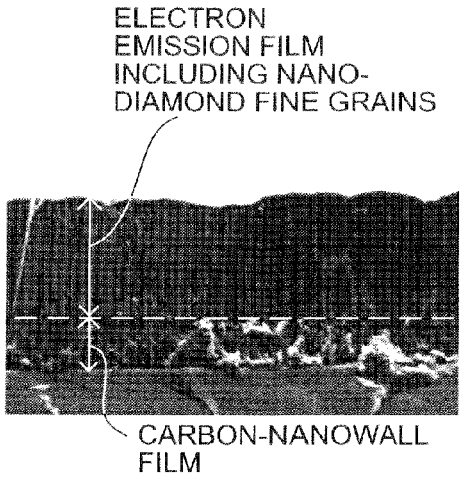
Figure 54E:
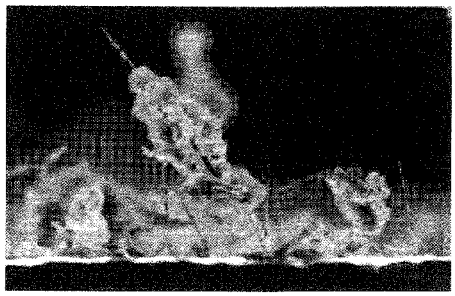

FIG. 54A is an image showing the state of light emission by the fluorescent tube 141 which employs the electron emission film 130, for which the plasma output was stopped at the timing T4 during the DC plasma manufacturing. FIG. 54B is a photographed image of the surface of the electron emission film 130 at a position (b) of FIG. 54A, obtained by a scanning electron microscope. FIG. 54C is a photographed image of the surface of the electron emission film 130 of FIG. 54A, obtained by a scanning electron microscope. FIG. 54D is a photographed image of a cross section of the field emission electrode 131 of FIG. 54A, obtained by a scanning electron microscope. FIG. 54E is a photographed image of the surface of the electron emission film 130 at an edge position (e) of FIG. 54A, obtained by a scanning electron microscope.

Under conditions that the distance between the field emission electrode 131 and the anode electrode 133 was 4.5 mm and a voltage of 6000V was applied between these electrode to cause light emission, about 10 portions of the electron emission film 130 that correspond to the portions of the fluorescent film 134 from which light having the luminance of 70% or more of the highest luminance (cd/$m^2$) of all the values obtained from the fluorescent film 134 was emitted, i.e., about 10 portions of the electron emission film 130 where the electron emission characteristic was favorable were sampled, with a sampling result that the density of the number of sticks 104 was 5000 sticks/$mm^2$ to 9000 sticks/$mm^2$. The ratio (number of $sp^3$ bonds in the film)/(number of $sp^2$ bonds in the film) of the electron emission film 130 was 2.55. As shown in FIG. 54B and FIG. 54C, sticks 104 and dust-like carbon twining around the sticks 104 were formed but had some of them lost as compared to those shown in FIGS. 53B and 53C. This is because the speed of etching by the plasma was higher than the speed of growing by the plasma.

Furthermore, etching on some portions of the electron emission film 130 once grown by the plasma was more proceeding than as shown in FIG. 53C. Note that since the electric field was concentrated on the edge portion of the field emission electrode 131 at the time of light emission and the field emission condition at the edge portion was therefore different from that of other portions, the light emission luminance at the portion of the fluorescent film 134 corresponding to the edge portion was not referred to as the highest luminance.

Figure 55:
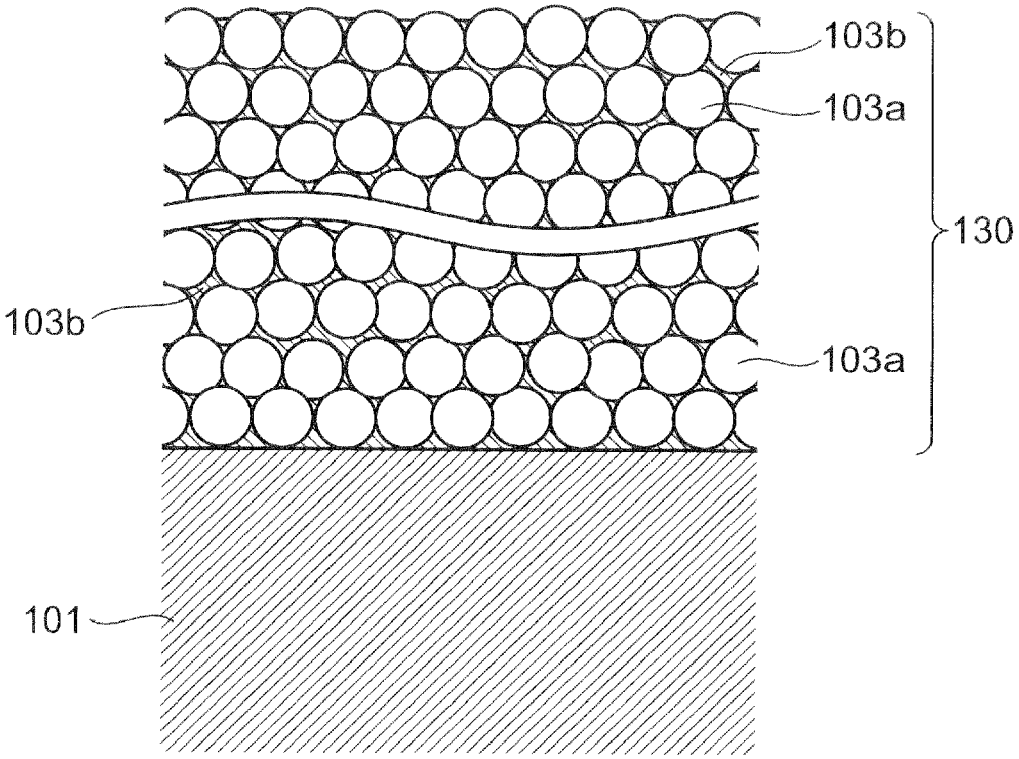
FIG. 55 is a model diagram of a cross section showing an electron emission film directly formed on a substrate.

In the above-described embodiment, the carbon-nanowall 132 was formed between the substrate 101 and the electron emission film 130. However, also by forming the electron emission film 130 directly on the substrate 101 as shown in FIG. 55, it is possible to form the sticks 104 and the dust-like carbon likewise the above-described embodiment.

Figure 56:
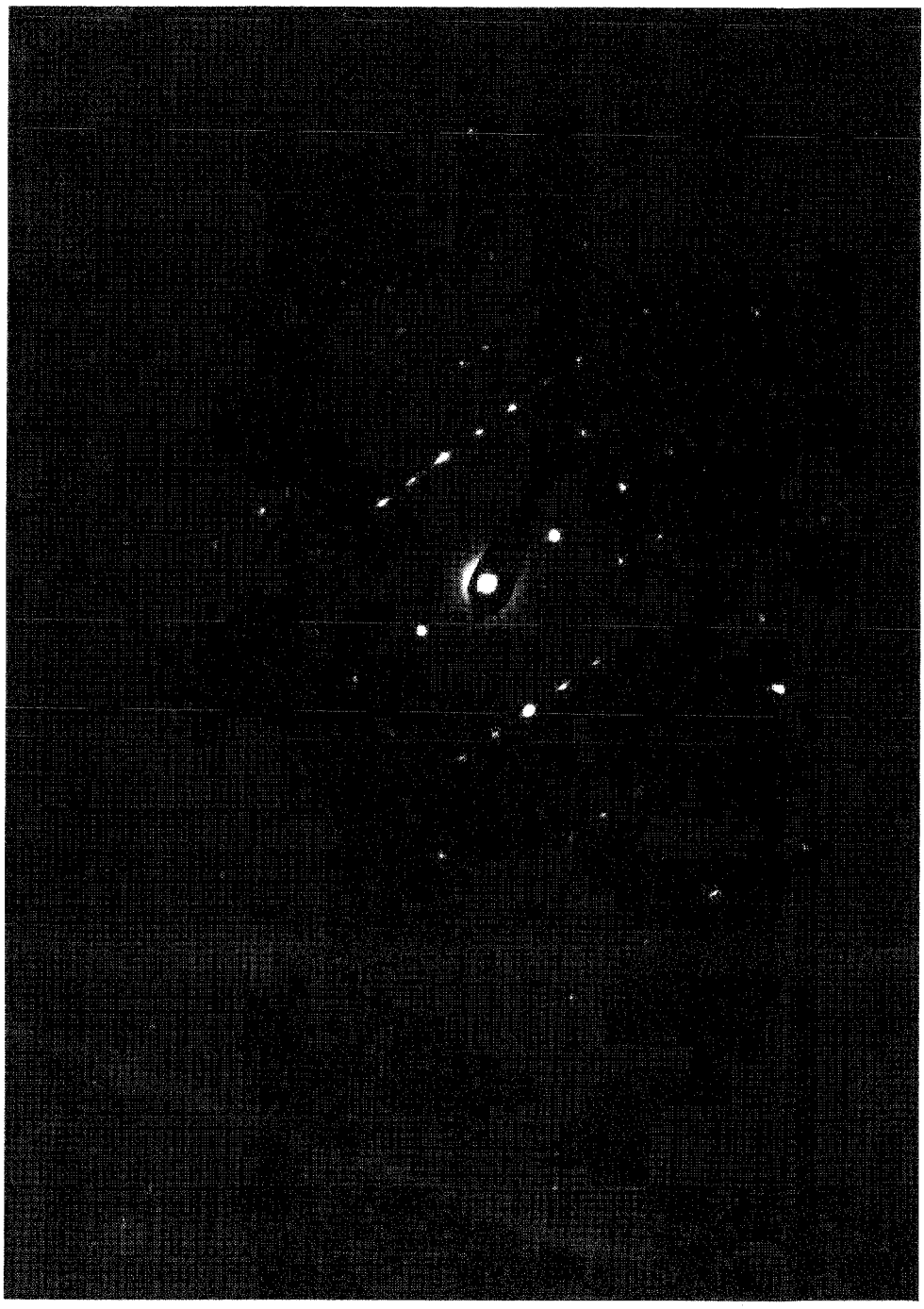
FIG. 56 is an electron diffraction image of the sticks according to the embodiment 3.

FIG. 56 shows an electron diffraction image of needle-like sticks. The interval between these sticks on the latticed surface is 0.34 nm, which corresponds to the surface interval of the graphite structure. Since an electron emission film having sticks formed has a more favorable discharge characteristic than an electron emission film having no sticks formed, it can be considered that the sticks themselves have conductivity. It can therefore be confirmed that the sticks are formed of the graphite structure of $sp^2$ bonds.

A light source comprising the field emission electrode according to the present invention can be applied not only to an FED, but also to a backlight for a liquid crystal panel and other home-use light sources, and furthermore to light sources for a personal computer, a digital camera, a cellular phone, etc. and to a vehicle-mountable light source.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2004-343203 filed on Nov. 26, 2004, Japanese Patent Application No. 2005-252928 filed on Aug. 31, 2005, and Japanese Patent Application No. 2005-299468 filed on Oct. 13, 2005 and including specification, claims, drawings and summary. The disclosure of the above Japanese Patent Application is incorporated herein by reference in its entirety.

What is claimed is:

1. A field emission electrode, comprising:

a film including a plurality of diamond fine grains; and at least one stick projecting from a surface of the film, wherein the stick comprises a core and a sheath surrounding the core, wherein a length of the stick is at least 10 times a diameter of the stick, and wherein the stick is 10 nm to 300 nm in diameter.

2. The field emission electrode according to claim 1, wherein the film comprises carbon between the diamond fine grains.

3. The field emission electrode according to claim 2, wherein the stick is grown from the carbon of the film as a nucleus.

4. The field emission film according to claim 1, wherein the film has a ratio (D-band intensity)/(G-band intensity) of 2.5 to 2.7.

5. The field emission electrode according to claim 1, wherein the stick is formed of carbon.

6. The field emission electrode according to claim 1, wherein the stick has a needle-like shape, and stands on the surface of the film.

7. The field emission electrode according to claim 1, wherein dust-like carbon is formed around the stick.

8. The field emission electrode according to claim 1, wherein the stick is formed between the diamond fine grains.

9. The field emission electrode according to claim 1, wherein the film is formed on a layer of carbon-nanowall.

10. The field emission electrode according to claim 9, wherein the stick is grown from the layer of carbon-nanowall as a nucleus.

11. The field emission electrode according to claim 1, wherein a plurality of sticks project from the surface of the film, and the plurality of sticks have a density of 5000 to 75000 sticks/$mm^2$.

12. An electronic device, comprising:

a field emission electrode which comprises a film including a plurality of diamond fine grains, and at least one stick projecting from a surface of the film;

an opposing electrode facing the field emission electrode; and a fluorescent film which emits light by electrons emitted from the field emission electrode, wherein the stick comprises a core and a sheath surrounding the core, wherein a length of the stick is at least 10 times a diameter of the stick, and wherein the stick is 10 nm to 300 nm in diameter.

13. The electronic device according to claim 12, wherein the film comprises carbon between the diamond fine grains.

14. The electronic device according to claim 13, wherein the stick is grown from the carbon of the film as a nucleus.

15. The electronic device according to claim 12, wherein the stick is formed of carbon.

16. The electronic device according to claim 12, wherein the stick has a needle-like shape, and stands on the surface of the film.

17. The electronic device according to claim 12, wherein dust-like carbon is formed around the stick.

18. The electronic device according to claim 12, wherein the stick is formed between the diamond fine grains.

19. The electronic device according to claim 12, wherein the film is formed on a layer of carbon-nanowall.

20. The electronic device according to claim 19, wherein the stick is grown from the layer of carbon-nanowall as a nucleus.

21. The electronic device according to claim 12, wherein a plurality of sticks project from the surface of the film, and the plurality of sticks have a density of 5000 to 75000 sticks/$mm^2$.

* * * * *

UNITED STATES PATENT AND TRADEMARK OFFICE

CERTIFICATE OF CORRECTION

PATENT NO. : 8,035,291 B2
APPLICATION NO. : 12/779583
DATED : October 11, 2011
INVENTOR(S) : Kazyhito Nishimura It is certified that error appears in the above-identified patent and that said Letters Patent is hereby corrected as shown below:

In the Claims:

Column 30, line 39; Claim 4, line 1:

change “emission film” to --emission electrode--.

Signed and Sealed this
Eleventh Day of June, 2013

Teresa Stanek Rea
*Acting Director of the United States Patent and Trademark Office*